US011341933B2

(12) United States Patent
Shin et al.

(10) Patent No.: US 11,341,933 B2
(45) Date of Patent: May 24, 2022

(54) FOLDABLE DISPLAY AND DRIVING METHOD THEREOF

(71) Applicant: LG Display Co., Ltd., Seoul (KR)

(72) Inventors: Seung Hwan Shin, Paju-si (KR); Yong Won Jo, Paju-si (KR); Jin Woo Jung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/863,875

(22) Filed: Apr. 30, 2020

(65) Prior Publication Data

US 2020/0357362 A1 Nov. 12, 2020

(30) Foreign Application Priority Data

May 7, 2019 (KR) ..... 10-2019-0053096

(51) Int. Cl.

| | |
|---|---|
| ***G09G 5/14*** | (2006.01) |
| ***G09G 3/3233*** | (2016.01) |
| ***G09G 3/3266*** | (2016.01) |
| ***G09G 3/3275*** | (2016.01) |
| ***G09G 5/373*** | (2006.01) |

(52) U.S. Cl.

CPC ..... *G09G 5/14* (2013.01); *G09G 3/3233* (2013.01); *G09G 3/3266* (2013.01); *G09G 3/3275* (2013.01); *G09G 5/373* (2013.01); *G09G 2310/0221* (2013.01); *G09G 2310/0286* (2013.01); *G09G 2310/08* (2013.01); *G09G 2340/0407* (2013.01); *G09G 2380/02* (2013.01)

(58) Field of Classification Search

None

See application file for complete search history.

(56) References Cited

U.S. PATENT DOCUMENTS

| | | | | |
|---|---|---|---|---|
| 2006/0145964 | A1* | 7/2006 | Park | G09G 3/3233 345/76 |
| 2012/0280924 | A1* | 11/2012 | Kummer | G06F 1/1647 345/173 |
| 2013/0057532 | A1* | 3/2013 | Lee | G09G 3/3225 345/211 |
| 2020/0202774 | A1 | 6/2020 | Cho | |
| 2020/0335037 | A1* | 10/2020 | Kim | G09G 3/3225 |

FOREIGN PATENT DOCUMENTS

| | | | |
|---|---|---|---|
| CN | 111402726 | A | 7/2020 |
| KR | 20160070445 | A | 6/2016 |
| KR | 20170077911 | A | 7/2017 |
| KR | 20180066629 | A | 6/2018 |

* cited by examiner

*Primary Examiner* — Matthew Yeung

(74) *Attorney, Agent, or Firm* — Seed IP Law Group LLP

(57) ABSTRACT

Disclosed herein are a foldable display and a driving method thereof which activate an entirety of a screen of a flexible display panel and display an image on a maximum screen when the flexible display panel is unfolded in an unfolded state, and activate a part of the screen when the flexible display panel is folded in a folded state to display the image on a screen that is smaller than the maximum screen and to display a black color on a deactivated screen.

20 Claims, 47 Drawing Sheets

| BLACK BRIGHTNESS (NIT) | | | | | | | | | | | | |
|---|---|---|---|---|---|---|---|---|---|---|---|---|
| ITEMS | ROOM TEMPERATURE | 60℃ | | | | | | | | | | |
| | | ZERO MINUTE | 5 MINUTES | 10 MINUTES | 15 MINUTES | 20 MINUTES | 25 MINUTES | 30 MINUTES | 35 MINUTES | 40 MINUTES | 45 MINUTES | 50 MINUTES |
| BLACK DATA DRIVING | 0.0280 | 0.0445 | 0.0450 | 0.0447 | 0.0450 | 0.0449 | 0.0450 | 0.0452 | 0.0449 | 0.0450 | 0.0450 | 0.0451 |
| Vini DRIVING | 0.0020 | 0.0018 | 0.0018 | 0.0020 | 0.0018 | 0.0018 | 0.0019 | 0.0019 | 0.0019 | 0.0020 | 0.0019 | 0.0019 |

(a)

(b)

FOLDABLE DISPLAY AND DRIVING METHOD THEREOF

CROSS-REFERENCE TO RELATED APPLICATION

This application claims priority to and the benefit of Korean Patent Application No. 10-2019-0053096, filed on May 7, 2019, the disclosure of which is incorporated herein by reference in its entirety.

BACKGROUND

Technical Field

The present disclosure relates to a foldable display in which a screen is capable of being folded using a flexible display panel, and a driving method thereof.

Description of Related Art

Electroluminescent display devices are roughly classified into inorganic light emitting display devices and organic light emitting display devices according to materials of light emitting layers. Active matrix type organic light emitting display devices include organic light emitting diodes (hereinafter referred to as "OLEDs"), which emit light by themselves and have fast response speeds and advantages in which light emission efficiencies, brightness, and viewing angles are high. In the organic light emitting display devices, the OLEDs are formed in pixels. Since the organic light emitting display devices have fast response speeds and are excellent in light emission efficiency, brightness, and viewing angle as well as capable of exhibiting a black gray scale in a full black color, the organic light emitting display devices are excellent in a contrast ratio and color reproducibility.

The organic light emitting display devices do not require backlight units and may be implemented on a plastic substrate, a thin glass substrate, or a metal substrate, which is made of a flexible material. Therefore, flexible displays may be implemented as the organic light emitting display devices.

A screen size of the flexible display may be varied by winding, folding, and bending a flexible display panel. The flexible display may be implemented as a rollable display, a bendable display, a foldable display, a slidable display, or the like. The flexible display devices may be applied not only to mobile devices such as smartphones and tablet personal computers (PCs), but also to televisions (TVs), vehicle displays, and wearable devices, and application fields of the flexible display device are expanding.

The screen size of the foldable display may be varied by folding or unfolding a large screen. An information device employing a foldable display has a problem in that power consumption is greater than that of a conventional mobile device due to a large screen. For example, since a foldable phone employs a foldable display of 7 inches or more, a load of a display panel increases 5.7 times as compared to that of the existing smart phone, and thus power consumption increases largely. The increase in power consumption causes a reduction in battery lifetime. Consequently, the foldable phone requires a battery which is much larger in capacity than that of the existing smart phone.

SUMMARY OF THE INVENTION

The present disclosure is directed to solving all the above-described necessity and problems.

It should be noted that objects of the present disclosure are not limited to the above-described objects, and other objects of the present disclosure will be apparent to those skilled in the art from the following descriptions.

According to an aspect of the present disclosure, there is provided a foldable display including a flexible display panel having a screen in which data lines, to which data voltages are applied, cross gate lines to which a scan signal and a light emission control signal are applied, and pixels are disposed, and a display panel driver configured to activate an entirety of the screen of the flexible display panel and display an image on a maximum screen when the flexible display panel is unfolded in an unfolded state and activate a part of the screen when the flexible display panel is folded in a folded state to display the image on a screen that is smaller than the maximum screen and to display a black color on a deactivated screen.

The screen of the flexible display panel may at least include a first screen, a second screen, and a folding boundary which is located between the first screen and the second screen. The folding boundary is foldable.

Each of the pixels may include a light emitting element, a drive element (DT) disposed between a pixel drive voltage and the light emitting element and configured to supply a current to the light emitting element, a first switching element configured to switch or control a current path between the pixel drive voltage and the light emitting element in response to a light emission control signal, and a second switching element configured to apply an initialization voltage, which suppresses light emission of the light emitting element, to an anode of the light emitting element in response to a scan signal in the folded state.

According to another aspect of the present disclosure, there is provided a method of driving a foldable display, which includes activating an entirety of a screen (full portion of a screen) of a flexible display panel when the flexible display panel is in an unfolded state in which the screen is unfolded to display an image on a maximum screen (full screen) thereof, and activating a part of the maximum screen when the flexible display panel is in a folded state in which the screen is folded to display the image on a screen that is smaller than the maximum screen and display a black color on a deactivated screen.

BRIEF DESCRIPTION OF THE SEVERAL VIEWS OF THE DRAWINGS

The above and other objects, features and advantages of the present disclosure will become more apparent to those skilled in the art by describing exemplary embodiments thereof in detail with reference to the accompanying drawings, in which.

DETAILED DESCRIPTION

Figure 1:
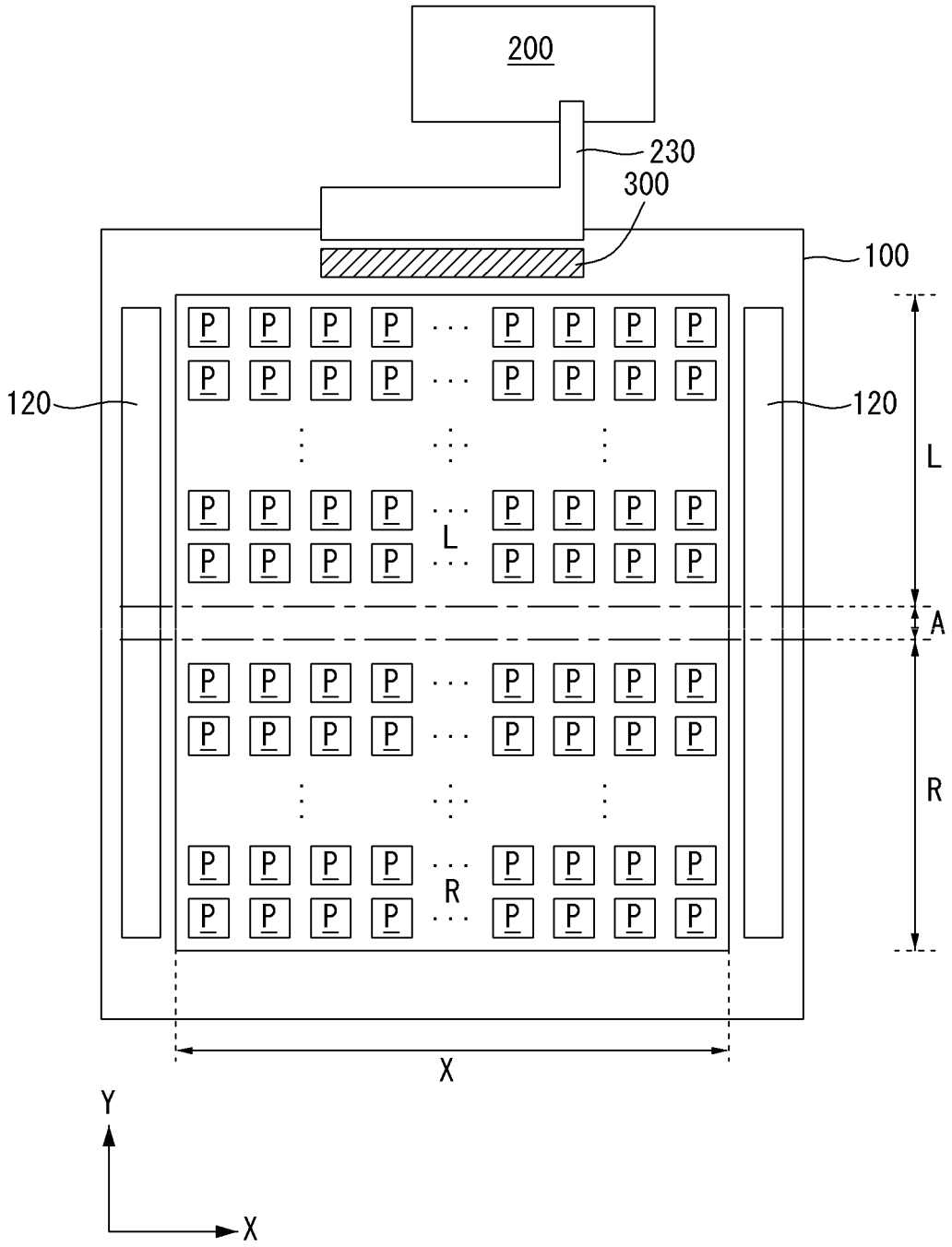
FIG. 1 is a block diagram illustrating a foldable display according to one embodiment of the present disclosure.

Advantages, features, and implementations thereof will be apparent from embodiments which are described in detail below together with the accompanying drawings. The present disclosure may, however, be implemented in many different forms and should not be construed as being limited to the embodiments set forth herein, and the embodiments are provided such that this disclosure will be thorough and complete and will fully convey the scope of the present disclosure to those skilled in the art to which the present disclosure pertains, and the present disclosure is defined by only the scope of the appended claims.

Shapes, sizes, ratios, angles, numbers, and the like disclosed in the drawings for describing the embodiments of the present disclosure are illustrative, and thus the present disclosure is not limited to the illustrated matters. The same reference numerals refer to the same components throughout this disclosure. Further, in the following description of the present disclosure, when a detailed description of a known related art is determined to unnecessarily obscure the gist of the present disclosure, the detailed description thereof will be omitted herein. When the terms "including," "having," "consisting of," and the like mentioned in this disclosure are used, other parts may be added unless the term "only" is used herein. When a component is expressed as a singular number, the plural number is included unless otherwise specified.

In analyzing a component, it is interpreted as including an error range even when there is no explicit description.

In describing a positional relationship, for example, when a positional relationship of two parts is described as being "on," "above," "below, "next to," or the like, unless "immediately" or "directly" is used, one or more other parts may be located between the two parts.

In describing the embodiments, although the terms first, second, and the like are used to describe various components, these components are not substantially limited by these terms. These terms are used only to distinguish one component from another component. Therefore, a first component described below may substantially be a second component within the technical spirit of the present disclosure.

The same reference numerals refer to the same components throughout this disclosure.

Features of various embodiments of the present disclosure may be partially or entirely coupled or combined with each other and may technically be various interlocking and driving, and the embodiments may be independently implemented with respect to each other or implemented together with a correlation.

In a foldable display of the present disclosure, each of a pixel circuit and a gate driver may include a plurality of transistors. The transistors may be implemented as oxide thin film transistors (TFTs) including oxide semiconductors, low temperature poly silicon (LTPS) TFTs including LTPSs, and the like. Each of the transistors may be implemented as a p-channel TFT or an n-channel TFT. In the embodiment, the transistors of a pixel circuit are mainly described as an example implemented as p-channel TFTs, but the present disclosure is not limited thereto.

The transistor is a three-electrode element including a gate, a source, and a drain. The source is an electrode for supplying a carrier to the transistor. In the transistor, the carries begins to flow from the source. The drain is an electrode in which the carrier is discharged from the transistor to the outside. In the transistor, the carrier flows from the source to the drain. In the case of an n-channel transistor, since the carrier is an electron, a source voltage is lower than a drain voltage so as to allow electrons to flow from the source to the drain. In the n-channel transistor, a current flows in a direction from the drain to the source. In the case of a p-channel transistor (a p-type metal oxide semiconductor (PMOS)), since the carrier is a hole, the source voltage is higher than the drain voltage so as to allow holes to flow from the source to the drain. In the p-channel transistor, since the holes flow from the source to the drain, a current flows from the source to the drain. It should be noted that the source and the drain of the transistor are not fixed. For example, the source and the drain may be changed according to an applied voltage. Therefore, the present disclosure is not limited due to the source and the drain of the transistor. In the following description, the source and the drain of the transistor will be referred to as a first electrode and a second electrode, respectively.

A gate signal swings between a gate on voltage and a gate off voltage. The gate on voltage is set to a voltage that is higher than a threshold voltage of the transistor, and the gate off voltage is set to a voltage that is lower than the threshold voltage of the transistor. The transistor is turned on in response to the gate on voltage, whereas the transistor is turned off in response to the gate off voltage. In the case of the n-channel transistor, the gate on voltage may be a gate high voltage (VGH), and the gate off voltage may be a gate low voltage (VGL). In the case of the p-channel transistor, the gate on voltage may be the VGL, and the gate off voltage may be the VGH.

Hereinafter, various embodiments of the present disclosure will be described in detail with reference to the accompanying drawings.

Referring to FIGS. 1 to 6, a foldable display of the present disclosure includes a flexible display panel 100 (shown in FIG. 1) and a display panel driver.

When the flexible display panel 100 is unfolded, the display panel driver activates an entire screen (i.e., full portion of the screen) of the flexible display panel 100 to display an image on a maximum screen (i.e., full portion of the screen). When the flexible display panel 100 is folded, the display panel driver activates a part of the screen to display an image on a screen that is smaller than the maximum screen and display a black color on a deactivated screen.

Figure 6:
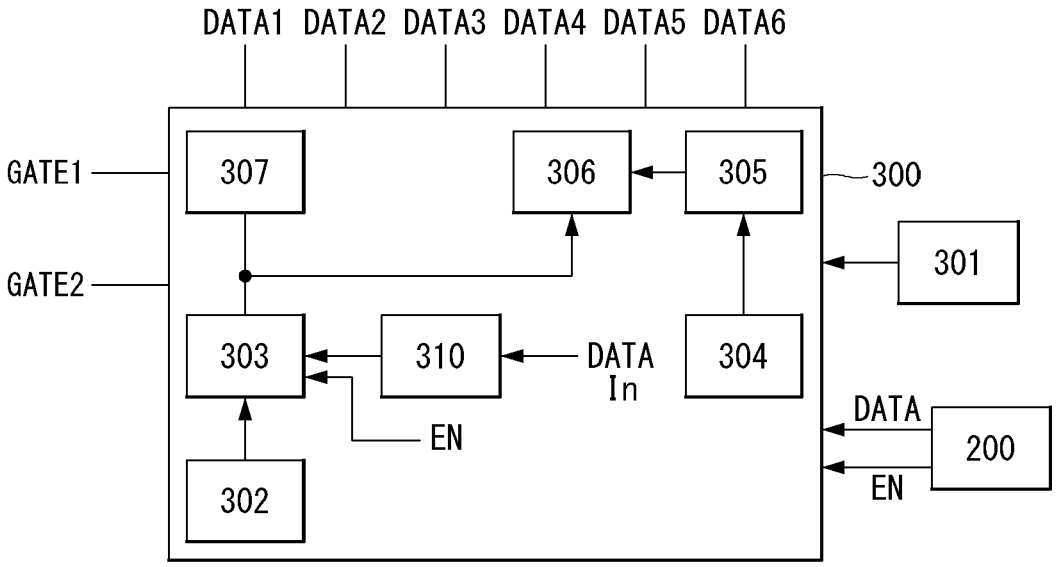
FIG. 6 is a block diagram illustrating a configuration of a drive integrated circuit (IC)

As shown in FIGS. 1 and 6, the display panel driver includes a gate driver 120 (shown in FIG. 1) for supplying gate signals to gate lines GL1 and GL2 of the flexible display panel 100 (shown in FIG. 1), a data driver 306 (shown in FIG. 6) for converting pixel data into a voltage of a data signal and supplying the voltage to data lines through activated data output channels, and a timing controller 303 (shown in FIG. 6) for activating data output channels of the data driver 306 according to a folded angle of the flexible display panel and controlling an operating timing of the data driver 306 and the gate driver 120. The data driver 306 and the timing controller 303 may be integrated in a drive integrated circuit (IC) 300 (shown in FIG. 6).

In the flexible display panel 100, a screen on which an input image is reproduced includes data lines DL1 to DL6, the gate lines GL1 and GL2 overlapping the data lines DL1 to DL6, and a pixel array in which pixels P are disposed in the form of a matrix. The screen is at least divided into a first screen L and a second screen R. A folding boundary A is present between the first screen L and the second screen R. The screen of the flexible display panel 100 may include a plurality of folding boundaries to be folded in various forms.

Figure 2A:
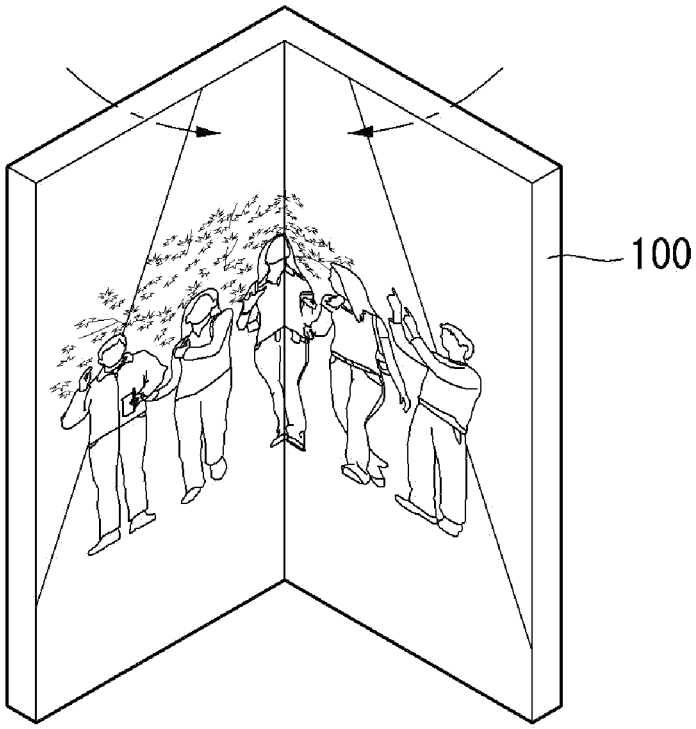
FIGS. 2A and 2B are diagrams illustrating examples in which the foldable display is folded.
Figure 2B:
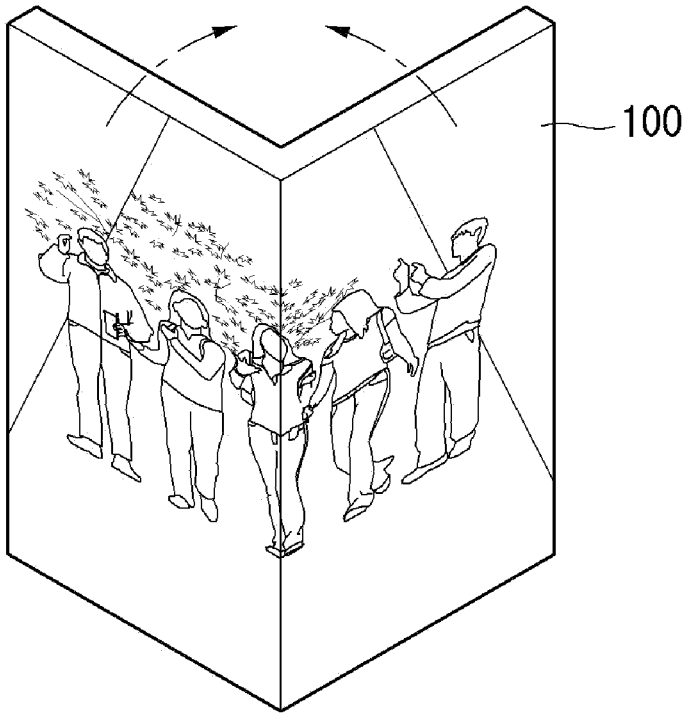

As shown in FIGS. 2A and 2B, the flexible display panel 100 may be folded with the folding boundary A as a boundary. The first screen L, the second screen R, and the folding boundary A are selectively driven according to folded/unfolded states, a folded angle, and the like of the flexible display panel 100, and thus a size and resolution of an activated screen displaying an image or information may be varied.

The timing controller 303 may determine a folded or unfolded state of the flexible display panel 100 on the basis of an enable signal EN from a host system 200 and further determine a folded angle of the flexible display panel 100. The timing controller 303 may control a size and resolution of an activated screen in the unfolded state of the flexible display panel 100 as a maximum screen (i.e., full screen of the flexible display) and maximum resolution thereof. In the unfolded state of the screen, the first screen L is substantially coplanar with the second screen R.

The flexible display panel 100 may be folded in an in-folding method shown in FIG. 2A or an out-folding method shown in FIG. 2B. In the in-folding method, the first screen L is brought into contact with the second screen R on an inner surface of the folded flexible display panel 100. In the in-folding method, since the first screen L and the second screen R are the inner surface of the folded flexible display panel 100, the first screen L and the second screen R are not exposed to the outside. In the out-folding method, the first screen L and the second screen R are outer surfaces of the folded flexible display panel 100. In the out-folding method, the first screen L and the second screen R are exposed to the outside.

When the first screen L and the second screen R are folded with the folding boundary A as a boundary, a resolution of one driven surface may be X*Y or X*(Y+A). The first screen L may be an upper half portion or a left half portion of the screen, and the second screen R may be a lower half portion or a right half portion of the screen.

The folding boundary A is a screen between the first screen L and the second screen R. An input image or information may also be displayed on the pixels P of the folding boundary A. Since the pixels P are disposed in the folding boundary A, in the unfolded state in which the first screen L and the second screen R are unfolded, a portion in which an image is cut off is not present between the first screen L and the second screen R. A width of the folding boundary A, that is, a Y-axis length, is determined according to a curvature of the folding boundary A. A resolution and a size of the folding boundary A are proportional to a radius of curvature of the folding boundary A.

In FIG. 1, X is a resolution in an X-axis direction of the screens L, A, and R. Y is a resolution in a Y-axis direction of the screens L, A, and R.

Figure 3:
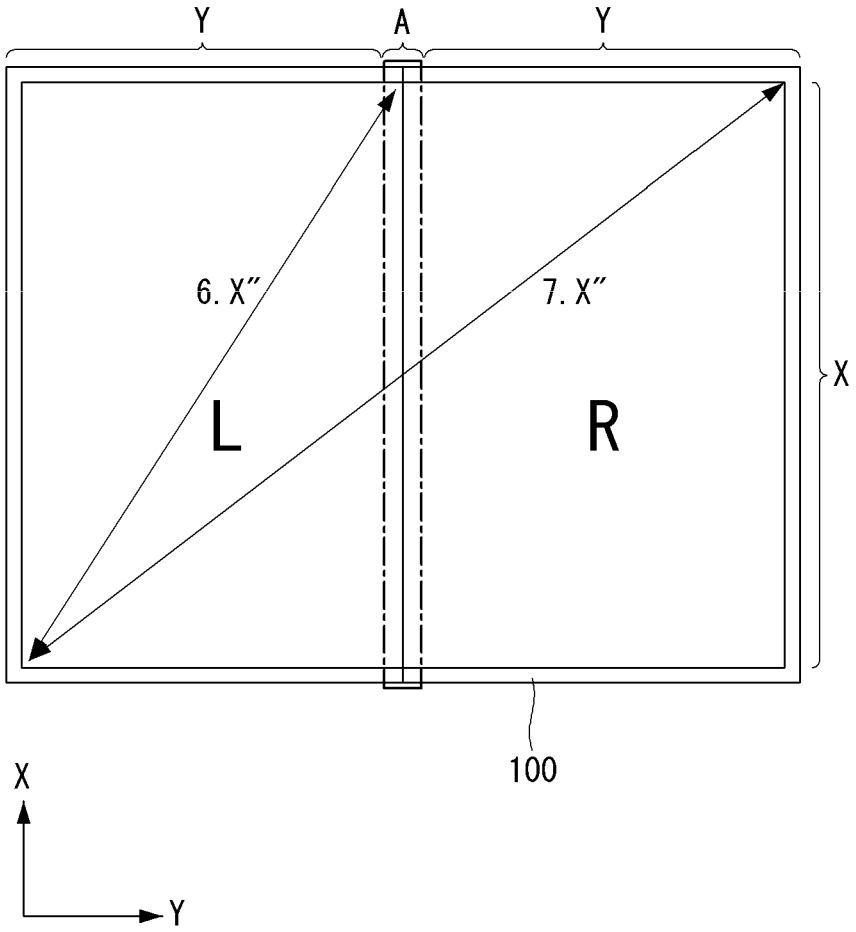
FIG. 3 is a diagram illustrating an example in which a screen size of a flexible display panel is varied.

When the flexible display panel 100 is unfolded and all of the first screen L, the second screen R, and the folding boundary A are driven, the size and resolution of the screens L, A, and R are maximized or increased. When the flexible display panel 100 is folded in half with the folding boundary A and either the first screen L or the second screen R is driven, the size and resolution of the screen are reduced. For example, when either the first screen L or the second screen R is driven, a size of a screen on which an image is displayed may be reduced to 6 inches (6.x") and resolution of the screen may be 2160*1080 as shown in FIG. 3. Meanwhile, for example, when all the screens L, A, and R are driven, a size of a screen on which an image is displayed may be increased to 7 inches (7.x") and a resolution of the screen may be increased to 2160*2160 as shown in FIG. 3.

Figure 7A:
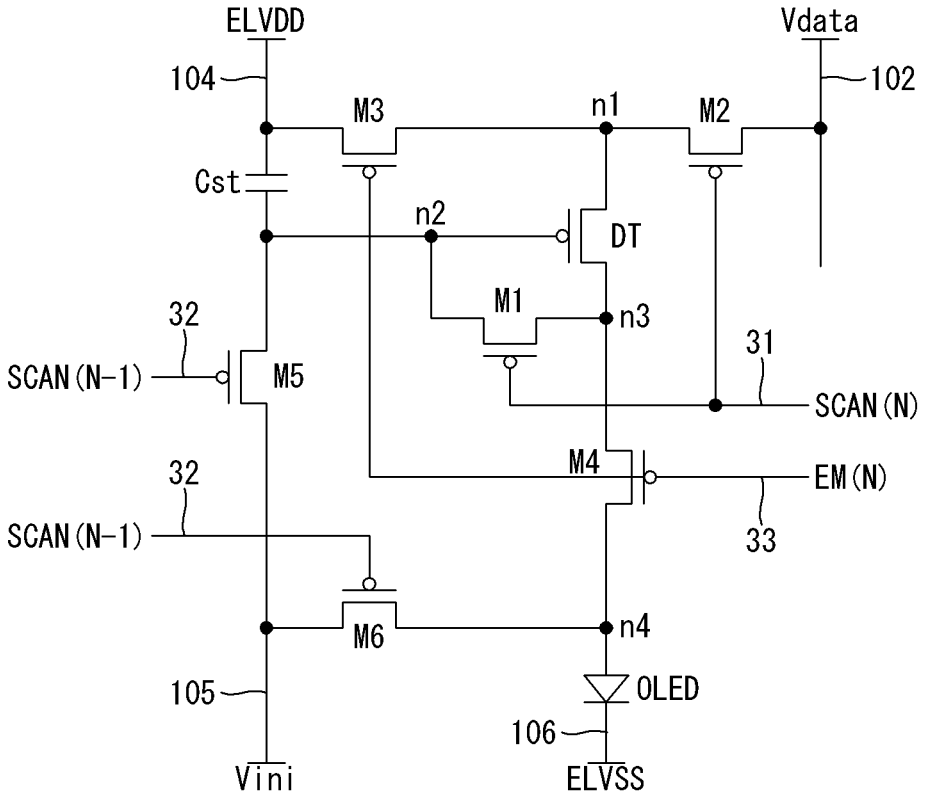
FIG. 7A is a circuit diagram illustrating an example of a pixel circuit.

In order to implement colors, each of the pixels P includes sub-pixels having different colors. The sub-pixels include red (hereinafter referred to as an "R sub-pixel"), green (hereinafter referred to as a "G sub-pixel"), and blue (hereinafter referred to as a "B sub-pixel"). Although not shown in the drawings, a white sub-pixel may be further included. As shown in FIG. 7A, each of the sub-pixels may be implemented as a pixel circuit including an internal compensation circuit.

Figure 4:
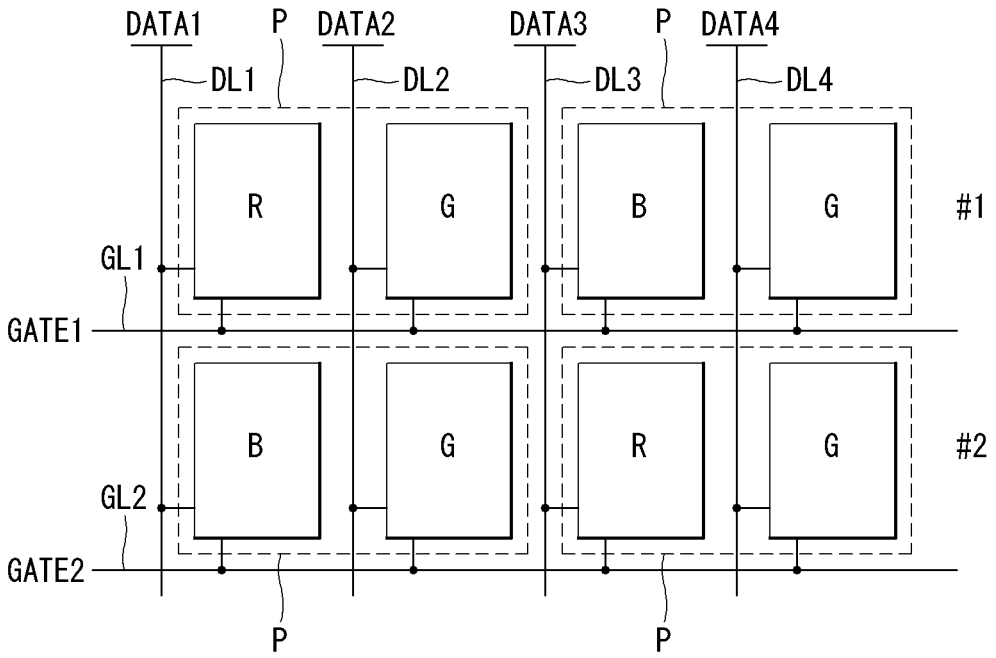
FIG. 4 is a diagram illustrating an example of a pentile pixel arrangement.

The pixels P may be disposed as real color pixels and pentile pixels. As shown in FIG. 4, the pentile pixel may drive two sub-pixels having different colors as one pixel P using a preset pentile pixel rendering algorithm to implement a resolution that is higher than that of the real color pixel. The pentile pixel rendering algorithm compensates for a color expression, which is insufficient in each of the pixels P, with a color of light emitted from an adjacent pixel.

Figure 5:
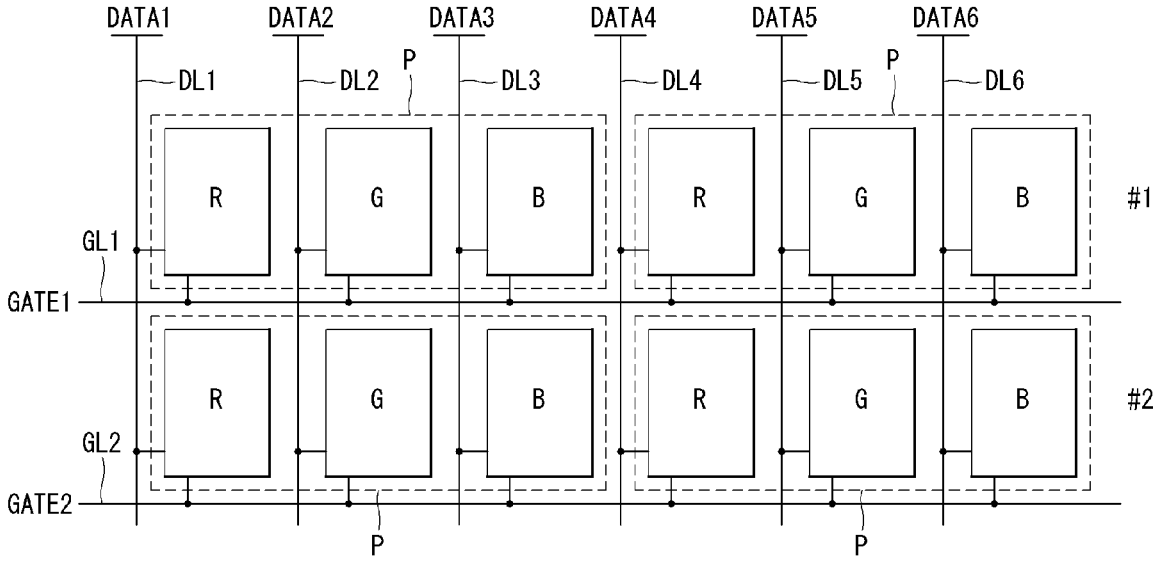
FIG. 5 is a diagram illustrating an example of a real pixel arrangement.

As shown in FIG. 5, in the case of the real color pixel, one pixel P is comprised of R, G, and B sub-pixels.

In FIGS. 4 and 5, when a resolution of a pixel array is n*m, the pixel array includes n pixel columns and m pixel lines crossing the n pixel columns. The pixel column includes pixels disposed in the Y-axis direction. The pixel line includes pixels disposed in the X-axis direction. One horizontal time 1H is a time obtained by dividing one frame interval by the m pixel lines.

The flexible display panel 100 may be implemented of a plastic organic light emitting diode (OLED) panel. The plastic OLED panel includes a pixel array on an organic thin film bonded to a back plate. A touch sensor array may be formed on the pixel array. The back plate may be a polyethylene terephthalate (PET) substrate. The back plate blocks moisture permeation so as to prevent the pixel array from being exposed to humidity and supports the organic thin film on which the pixel array is formed. The organic thin film may be a thin polyimide (PI) film substrate. A multilayer buffer film may be formed of an insulating material (not shown) on the organic thin film. Lines for supplying power or signals applied to the pixel array and the touch sensor array may be formed on the organic thin film. As shown in FIG. 7A, in the plastic OLED panel, the pixel circuit includes an OLED used as a light emitting element, a drive element for driving the OLED, a plurality of switching elements for switching current paths between the drive element and the OLED, and a capacitor connected to the drive element.

The drive IC 300 (shown in FIG. 6) drives a pixel array of the screens L, A, and R displaying an image or information. As shown in FIG. 4 or 5, in the pixel array, the data lines DL1 to DL6 overlap with the gate lines GL1 and GL2. The pixel array includes pixels P disposed in the form of a matrix which is defined by the data lines DL1 to DL6 and the gate lines GL1 and GL2.

The gate driver 120 (shown in FIG. 1) may be mounted on a substrate of the flexible display panel 100 together with the pixel array. The gate driver 120 may be implemented as a gate in panel (GIP) circuit which is directly formed on the flexible display panel 100.

The gate driver 120 may be disposed on one of a left bezel and a right bezel of the flexible display panel 100 to supply gate signals to the gate lines GL1 and GL2 in a single feeding manner. In this case, one of the two gate drivers 120 in FIG. 1 is not necessary.

The gate driver 120 may be disposed on each of the left bezel and the right bezel of the flexible display panel 100 to supply gate signals to the gate lines GL1 and GL2 in a double feeding manner. In the double feeding manner, the gate signals are simultaneously applied at both ends of one gate line.

Figure 7B:
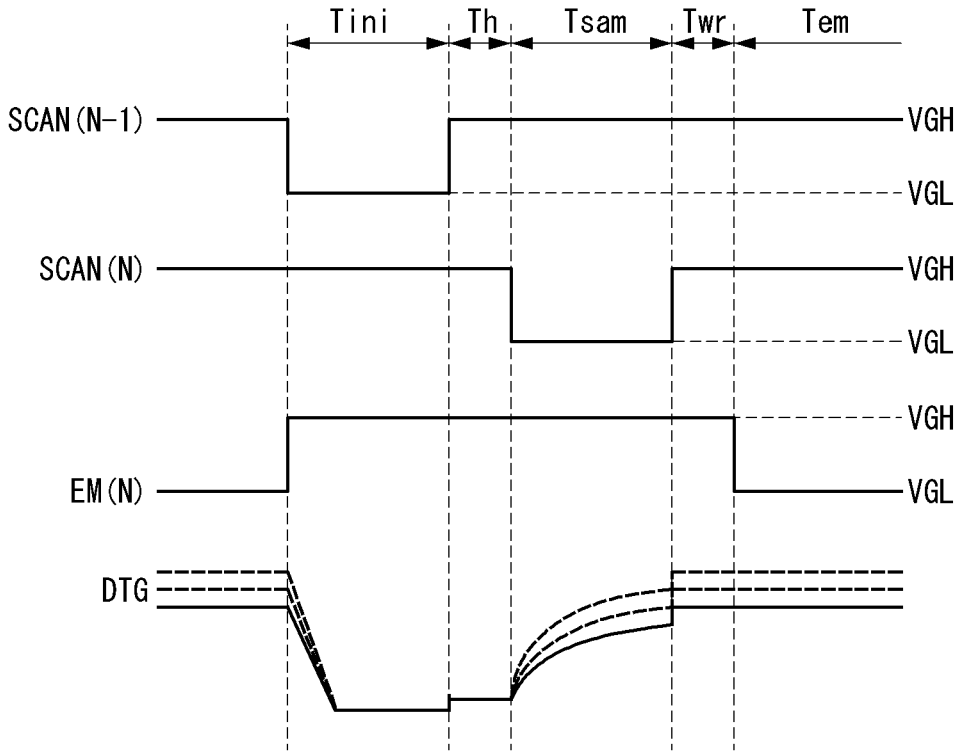
FIG. 7B is a diagram illustrating a method of driving the pixel circuit shown in FIG. 7A.

The gate driver 120 is driven according to a gate control signal supplied from the drive IC 300 using a shift register to sequentially supply gate signals GATE 1 and GATE 2 to the gate lines GL1 and GL2. The shift register may sequentially supply the gate signals GATE 1 and GATE 2 to the gate lines GL1 and GL2 by shifting the gate signals GATE 1 and GATE 2. The gate signals GATE 1 and GATE 2 may include scan signals SCAN (N−1) and SCAN (N), a light emission control signal EM (N), and the like which are shown in FIGS. 7A and 7B. Hereinafter, the "light emission control signal" is referred to as an EM signal.

In the foldable display of the present disclosure, the flexible display panel 100 includes the first screen L, the second screen R, and the foldable folding boundary A located between the first screen L and the second screen R. The drive IC 300 may be connected to the data lines and the gate lines of the first screen L, the second screen R, and the folding boundary A to supply voltages of data signals to the data lines and supply the gate signals to the gate lines.

The drive IC 300 is connected to the host system 200, a first memory 301, and the flexible display panel 100. As shown in FIG. 6, the drive IC 300 includes a data receiving and calculating part 310, the timing controller 303, and the data driver 306.

The drive IC 300 may further include a gamma compensation voltage generator 305, a power supply 304, a second memory 302, and a level shifter 307. The drive IC 300 may generate gate control signals for driving the gate driver 120 through the level shifter 307. The gate control signal includes gate timing signals such as a gate start pulse VST and a gate shift clock CLK, and gate voltages such as a gate on voltage VGL and a gate off voltage VGH.

The data receiving and calculating part 310 includes a receiver RX for receiving pixel data which is input as a digital signal from the host system 200, and a data calculator for processing the pixel data input through the receiver RX to improve image quality. The data calculator may include a data restoration part for decoding and restoring compressed pixel data, and an optical compensator for adding a predetermined optical compensation value to the pixel data. The optical compensation value may be set to a value for correcting brightness of the pixel data on the basis of brightness of the screen measured based on a camera image which is captured in a manufacturing process.

The timing controller 303 provides the data driver 306 with pixel data of an input image received from the host system 200. The timing controller 303 generates a gate timing signal for controlling the gate driver 120 and a source timing signal for controlling the data driver 306 to control operation timings of the gate driver 120 and the data driver 306.

The data driver 306 converts the pixel data (a digital signal) received from the timing controller 303 into a gamma compensation voltage through a digital-to-analog converter (DAC) to output voltages of data signals DATA1 to DATA6 (hereinafter referred to as "data voltages").

The data voltages output from the data driver 306 are supplied to the data lines DL1 to DL6 of the pixel array through an output buffer connected to data channels of the drive IC 300. The gamma compensation voltage generator 305 distributes an input voltage from the power supply 304 through a voltage divider circuit to generate a gamma compensation voltage for each gray scale. The gamma compensation voltage is an analog voltage in which a voltage is set for each gray scale of the pixel data. The gamma compensation voltage output from the gamma compensation voltage generator 305 is provided to the data driver 306.

The level shifter 307 converts a low level voltage of the gate timing signal received from the timing controller 303 into the gate on voltage VGL and converts a high level voltage of the gate timing signal into the gate off voltage VGH. The gate timing signal and the gate voltages VGH and VGL, which are output from the level shifter 307, are supplied to the gate driver 120 through the gate channels of the drive IC 300.

The power supply 304 generates power required for driving the pixel array, the gate driver 120, and the drive IC 300 of the flexible display panel 100 using a direct current (DC)-DC converter. The DC-DC converter may include a charge pump, a regulator, a buck converter, and a boost converter. The power supply 304 may adjust a DC input voltage from the host system 200 to generate DC power such as a gamma reference voltage, the gate on voltage VGL, the gate off voltage VGH, a pixel drive voltage ELVDD, a low potential power voltage ELVSS, and an initialization voltage Vini. The gamma reference voltage is supplied to the gamma compensation voltage generator 305. The gate on voltage VGL and the gate off voltage VGH are supplied to the level shifter 307 and the gate driver 120. Pixel power such as the pixel drive voltage ELVDD, the low potential power voltage ELVSS, and the initialization voltage Vini are commonly supplied to the pixels P.

The gate voltages may be set to VGH=8V and VGL=−7V, and the pixel power may be set to ELVDD=4.6V, ELVSS=−2 to −3V, and Vini=−3 to −4V, but the present disclosure is not limited thereto. A data voltage Vdata may be set to Vdata=3 to 6V, but the present disclosure is not limited thereto.

Vini is set to a DC voltage that is lower than the ELVDD and a threshold voltage of a light emitting element OLED to suppress light emission of the light emitting element OLED. Vini may be continuously applied to an anode of the light emitting element OLED for one frame interval or more in a deactivated pixel.

When power is supplied to the drive IC 300, the second memory 302 stores a compensation value, register setting data, and the like which are received from the first memory 301. The compensation value may be applied to various algorithms for improving image quality. The compensation value may include an optical compensation value.

The register setting data defines operations of the data driver 306, the timing controller 303, and the gamma compensation voltage generator 305. The first memory 301 may include a flash memory. The second memory 302 may include a static random access memory (SRAM).

The host system 200 may be implemented of an application processor (AP). The host system 200 may transmit pixel data of an input image to the drive ICs 300 through a mobile industry processor interface (MIPI). The host system 200 may be connected to the drive IC 300 through a flexible printed circuit, for example, a flexible printed circuit (FPC). In FIG. 1, reference numeral "230" indicates the FPC.

The host system 200 may include an enable signal EN for controlling driving of the drive IC 300 according to whether the flexible display panel 100 is folded. The enable signal EN may include angle information indicating an angle when the flexible display panel 100 is folded.

The host system 200 may be connected to various sensors to control the screens L, A, and R in response to sensor signals. The host system 200 may detect a folded angle of the flexible display panel 100. The host system 200 may detect a variance in attitude of the foldable display using a motion sensor and control the drive IC 300 in response to a motion sensor signal to control an ON or OFF of each of the first screen and the second screen. The motion sensor may include a gyro sensor or an acceleration sensor.

For example, when a user folds the foldable display and looks at either the first screen L or the second screen R, the drive IC 300 may activate a screen facing eyes of the user to display an image on that screen, whereas the drive IC 300 may deactivate an opposite screen to drive the opposite screen as a black screen.

FIG. 7A is a circuit diagram illustrating an example of a pixel circuit. FIG. 7B is a diagram illustrating a method of driving the pixel circuit shown in FIG. 7A.

Referring to FIGS. 7A and 7B, the pixel circuit includes the light emitting element OLED, a drive element DT which supplies a current to the light emitting element OLED, and an internal compensation circuit for sampling a threshold voltage Vth of the drive element DT using a plurality of switching elements M1 to M6 to compensate for a gate voltage of the drive element DT by as much as the threshold voltage Vth of the drive element DT. Each of the drive element DT and the switching elements M1 to M6 may be implemented as a p-channel transistor, but the present disclosure is not limited thereto.

An operation of the internal compensation circuit is divided into an initialization time Tini in which fifth and sixth switching elements M5 and M6 are turned on according to a gate on voltage VGL of an (N−1)th scan signal SCAN (N−1) to initialize the pixel circuit, a sampling time Tsam in which first and second switching elements M1 and M2 are turned on according to a gate on voltage VGL of an Nth scan signal SCAN (N) to sample the threshold voltage Vth of the drive element DT and store the sampled threshold voltage Vth in a capacitor Cst, a data write time Twr in which the first to sixth switching elements M1 to M6 are maintained in an OFF state, and a light emission time Tem in which third and fourth switching elements M3 and M4 are turned on such that the light emitting element OLED emits light. In the light emission time Tem, in order to precisely express brightness of a low gray scale with a duty ratio of the EM signal EM (N), the EM signal EM (N) may swing between the gate on voltage VGL and the gate off voltage VGH at a predetermined duty ratio to repeat ON/OFF of the third and fourth switching elements M3 and M4.

The light emitting element OLED may be implemented of an "organic light emitting diode" or an inorganic light emitting diode. Hereinafter, an example in which the light emitting element OLED is implemented of an "organic light emitting diode" will be described, but the present disclosure is not limited thereto.

The light emitting element OLED may be implemented of an organic compound layer formed between an anode and a cathode as an OLED. The organic compound layer may include a hole injection layer (HIL), a hole transport layer (HTL), a light emitting layer (EML), an electron transport layer (ETL), and an electron injection layer (EIL), but the present disclosure is not limited thereto. The anode of the light emitting element OLED is connected to a fourth node n4 between the fourth and sixth switching elements M4 and M6. The fourth node n4 is connected to the anode of the light emitting element OLED, a second electrode of the fourth switching element M4, and a second electrode of the sixth switching element M6. The cathode of the light emitting element OLED is connected to a VSS electrode 106 to which the low potential power voltage ELVSS is applied. The light emitting element OLED emits light in response to a current Ids flowing according to a gate-source voltage Vgs of the drive element DT. A current path of the light emitting element OLED is switched or controlled by the third and fourth switching elements M3 and M4.

The storage capacitor Cst is connected between a VDD line 104 and a second node n2. The data voltage Vdata compensated for by as much as the threshold voltage Vth of the drive element DT is charged in the storage capacitor Cst. Since the data voltage Vdata in each sub-pixel is compensated for by as much as the threshold voltage Vth of the drive element DT, a characteristic deviation of the drive element DT in each sub-pixel is compensated.

The first switching element M1 is turned on in response to the gate on voltage VGL of the Nth scan signal SCAN (N) to connect a second node n2 to a third node n3. The second node n2 is connected to a gate of the drive element DT, a first electrode of the storage capacitor Cst, and a first electrode of the first switching element M1. The third node n3 is connected to a second electrode of the drive element DT, a second electrode of the first switching element M1, and a first electrode of the fourth switch element M4. A gate of the first switching element M1 is connected to a first gate line 31 to receive the Nth scan signal SCAN (N). The first electrode of the first switching element M1 is connected to the second node n2, and the second electrode thereof is connected to the third node n3.

The second switching element M2 is turned on in response to the gate on voltage VGL of the Nth scan signal SCAN (N) to supply the data voltage Vdata to the first node n1. A gate of the second switching element M2 is connected to the first gate line 31 to receive the Nth scan signal SCAN (N). A first electrode of the second switching element M2 is connected to the first node n1. A second electrode of the second switching element M2 is connected to a data line 102 to which the data voltage Vdata is applied. The first node n1 is connected to the first electrode of the second switching element M2, a second electrode of the third switching element M3, and a first electrode of the drive element DT.

The third switching element M3 is turned on in response to a gate on voltage VGL of the EM signal EM (N) to connect the VDD line 104 to the first node n1. A gate of the third switching element M3 is connected to a third gate line 33 to receive the EM signal EM (N). A first electrode of the third switching element M3 is connected to the VDD line 104. The second electrode of the third switching element M3 is connected to the first node n1.

The fourth switching element M4 is turned on in response to the gate on voltage VGL of the EM signal EM (N) to connect the third node n3 to the anode of the light emitting element OLED. A gate of the fourth switching element M4 is connected to the third gate line 33 to receive the EM signal EM (N). The first electrode of the fourth switching element M4 is connected to the third node n3, and the second electrode thereof is connected to the fourth node n4.

The EM signal EM (N) controls ON/OFF of the third and fourth switching elements M3 and M4 to switch the current path of the light emitting element OLED, thereby controlling a turning on/off time of the light emitting element OLED.

The fifth switching element M5 is turned on in response to a gate on voltage VGL of the (N−1)th scan signal SCAN (N−1) to connect the second node n2 to a *Vini* line 105. A gate of the fifth switching element M5 is connected to a second gate line 32 to receive the (N−1)th scan signal SCAN (N−1). A first electrode of the fifth switching element M5 is connected to the second node n2, and a second electrode thereof is connected to the *Vini* line 105.

The sixth switching element M6 is turned on in response to the gate on voltage VGL of the (N−1)th scan signal SCAN (N−1) to connect the *Vini* line 105 to the fourth node n4. A gate of the sixth switching element M6 is connected to a second gate line 32 to receive the (N−1)th scan signal SCAN (N−1). A first electrode of the sixth switching element M6 is connected to the *Vini* line 105, and a second electrode thereof is connected to the fourth node n4.

Figure 18:
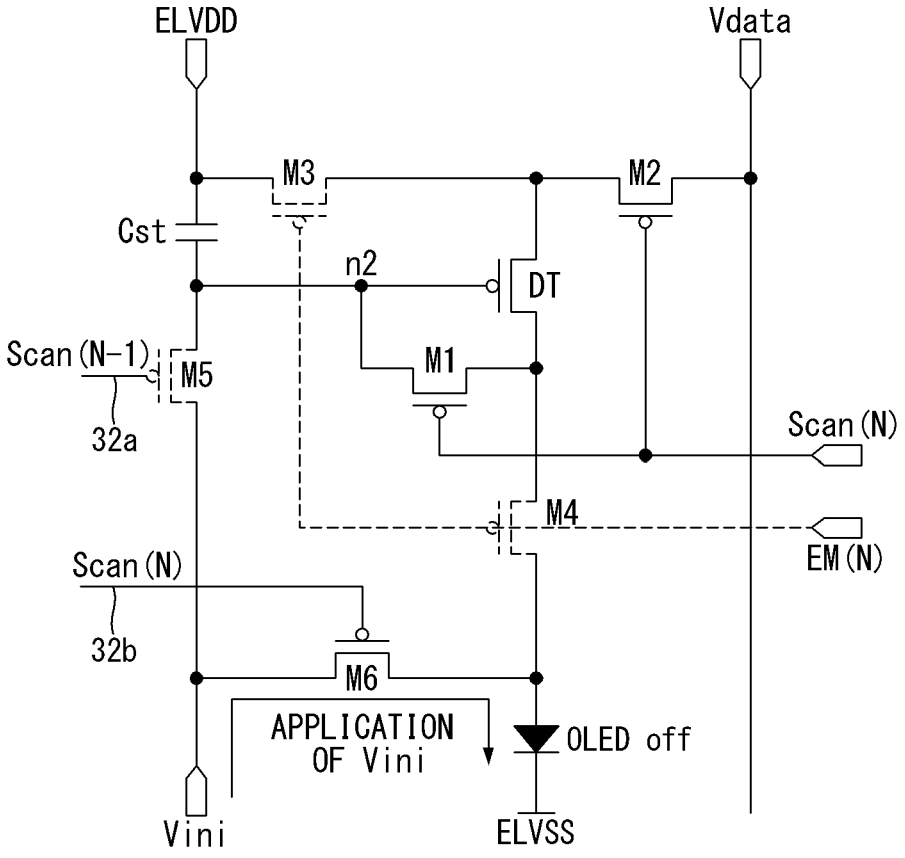
FIG. 18 is a circuit diagram illustrating an operation of a pixel in a deactivated screen.

In a pixel of an activated screen, the (N−1)th scan signal SCAN (N−1) is applied to the gates of the fifth and sixth switching elements M5 and M6. The activated screen is a screen of a display area in which an image is displayed. Meanwhile, as shown in FIG. 18, in the case of a pixel of a deactivated screen, the Nth scan signal SCAN (N) is applied to the sixth switching element M6 to reduce an anode voltage of the light emitting element OLED to Vini, thereby suppressing light emission of the light emitting element OLED. The deactivated screen may be a screen of a non-display area in which a black color is displayed.

Thus, as shown in FIG. 18, the gates of the fifth and sixth switching elements M5 and M6 may be connected to the different gate lines 32*a* and 32*b* each other. In the activated screen and the deactivated screen, the scan signals of the sixth switching element M6 may be different. In the activated screen, the (N−1)th scan signal SCAN (N−1) is applied to the gate of the sixth switching element M6. In the deactivated screen, the Nth scan signal SCAN (N) is applied to the gate of the sixth switching element M6.

The drive element DT controls the current Ids flowing in the light emitting element OLED according to the gate-source voltage Vgs, thereby driving the light emitting element OLED. The drive element DT includes the gate connected to the second node n2, the first electrode connected to the first node n1, and the second electrode connected to the third node n3.

During the initialization time Tini, the (N−1)th scan signal SCAN (N−1) is generated as the gate on voltage VGL. During the initialization time Tini, the Nth scan signal SCAN (N) and the EM signal EM (N) are maintained at the gate off voltage VGH. Thus, during the initialization time Tini, the fifth and sixth switching elements M5 and M6 are turned on so that the second and fourth nodes n2 and n4 are initialized at Vini. A hold time Th may be set between the initialization time Tini and the sampling time Tsam. During the hold time Th, the gate signals SCAN (N), EM (N) are maintained in previous states thereof.

During the sampling time Tsam, the Nth scan signal SCAN (N) is generated as the gate on voltage VGL. A pulse of the Nth scan signal SCAN (N) is synchronized with a data voltage Vdata of an Nth pixel line. During the sampling time Tsam, the $(N-1)^{th}$ scan signal SCAN (N−1) and the EM signal EM (N) are maintained at the gate off voltage VGH. Therefore, during the sampling time Tsam, the first and second switching elements M1 and M2 are turned on.

During the sampling time Tsam, a gate voltage DTG of the drive element DT rises due to a current flowing through the first and second switching elements M1 and M2. Since the gate voltage the drive element DT is rises until the drive element DT is turned off, the gate node voltage DTG is changed to Vdata−|Vth|. During the sampling time Tsam, the gate-source voltage Vgs of the drive element DT satisfies |Vgs|=Vdata−(Vdata−|Vth|)=|Vth|.

During the data write time Twr, the Nth scan signal SCAN (N) is inverted to the gate off voltage VGH. During the sampling time Tsam, the (N−1)th scan signal SCAN (N−1) and the EM signal EM (N) are maintained at the gate off voltage VGH. Therefore, during the data write time Twr, all the switching elements M1 to M6 remain in an off state.

During the light emission time Tem, the EM signal EM (N) is turned on and off at a predetermined duty ratio to swing between the gate on voltage VGL and the gate off voltage VGH. When the EM signal EM (N) is the gate on voltage VGL, a current flows between an ELVDD and the light emitting element OLED so that the light emitting element OLED may emit light. During the light emission time Tem, the (N−1)th and Nth scan signals SCAN (N−1) and SCAN (N) are maintained at the gate off voltage VGH. During the light emission time Tem, the third and fourth switching elements M3 and M4 are repeatedly turned on and off according to a voltage of the EM signal EM (N). When the EM signal EM (N) is the gate on voltage VGL, the third and fourth switching elements M3 and M4 are turned on so that a current flows in the light emitting element OLED. In this case, Vgs of the drive element DT satisfies |Vgs|=ELVDD−(Vdata−|Vth|), and the current flowing in the light emitting element OLED is $K*(ELVDD-Vdata)^2$. K is a proportional constant determined by charge mobility, parasitic capacitance, and a channel capacity of the drive element DT.

Figure 8:
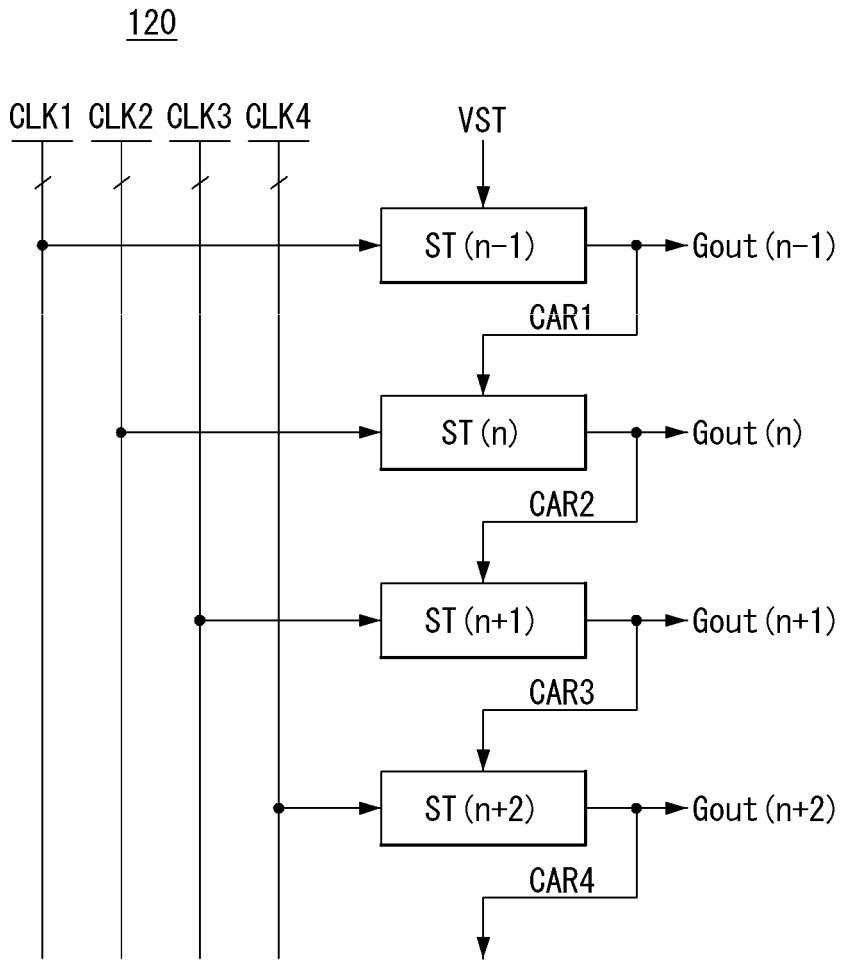
FIG. 8 is a schematic diagram illustrating a circuit configuration of a shift register in a gate driver.
Figure 9A:
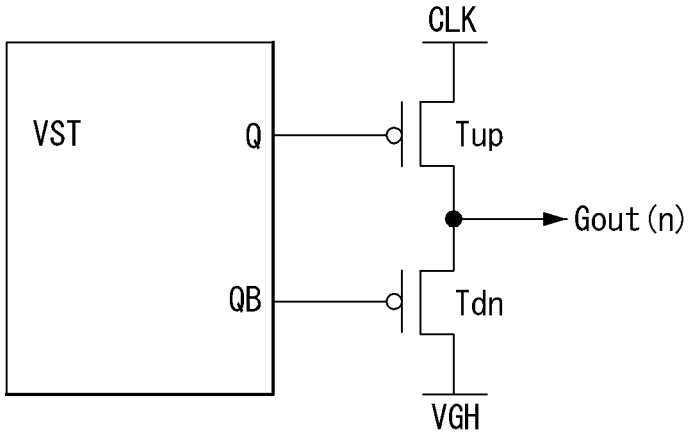
FIGS. 9A and 9B are schematic diagrams illustrating a pass gate circuit and an edge trigger circuit.
Figure 9B:
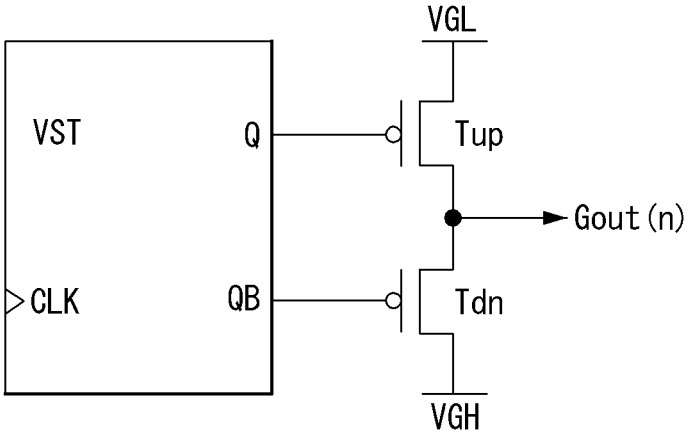

FIG. 8 is a schematic diagram illustrating a circuit configuration of a shift register in the gate driver 120. FIGS. 9A and 9B are schematic diagrams illustrating a pass gate circuit and an edge trigger circuit.

Referring to FIG. 8, the shift register of the gate driver 120 includes stages ST (n−1) to ST (n+2) which are connected in cascade. The shift register receives the gate start pulse VST or carry signals CAR1 to CAR4 received from previous stages as a start pulse and generates output signal Gout (n−1) to Gout (n+2) in synchronization with rising edges of gate shift clocks CLK1 to CLK4. The output signals of the shift register include the gate signals SCAN (N−1), SCAN (N), and EM (N).

Each of the stages ST (n−1) to ST (n+2) of the shift register may be implemented as a pass-gate circuit as shown in FIG. 9A or an edge trigger circuit as shown in FIG. 9B.

Figure 10:
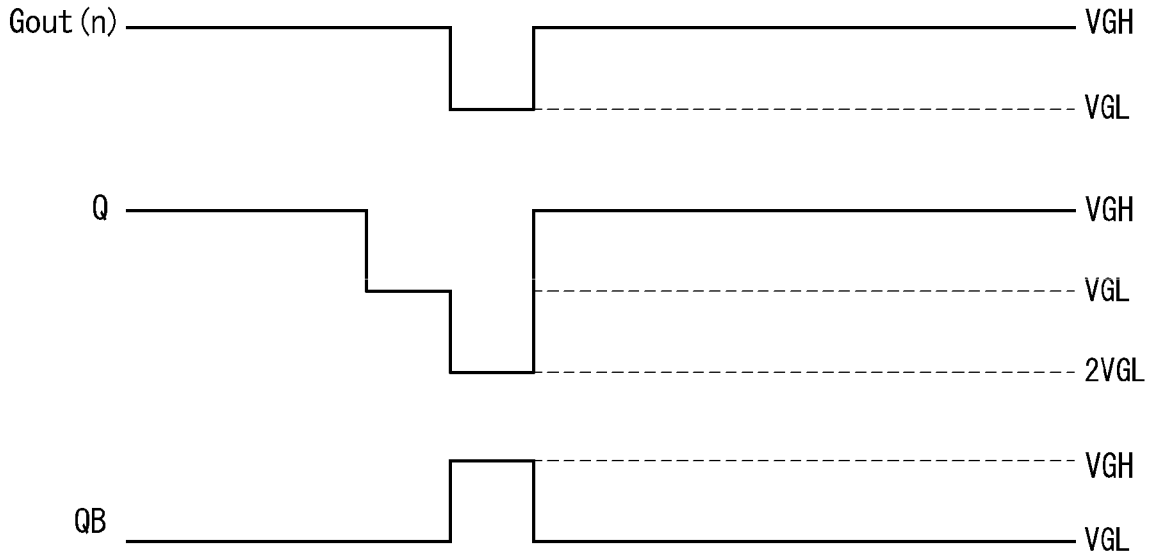
FIG. 10 is a waveform diagram showing a Q node voltage, a QB node voltage, and an output voltage of an nth stage shown in FIG. 8.

In the pass gate circuit, a clock CLK is input to a pull-up transistor Tup which is turned on or off according to a voltage of a Q node. Meanwhile, the gate on voltage VGL is supplied to a pull-up transistor Tup of the edge trigger circuit, and the gate start pulse VST and the gate shift clocks CLK1 to CLK4 are input to the edge trigger circuit. A pull-down transistor Tdn is turned on or off according to a voltage of a QB node. In the pass gate circuit, the Q node is pre-charged according to a start signal and floated. When the clock CLK is applied to the pull-up transistor Tup in a state in which the Q node is floated, the voltage of the Q node is changed to a voltage 2VGL that is larger than the gate on voltage VGL shown in FIG. 10 due to bootstrapping so that a voltage of the output signal Gout (n) rises as a pulse with the gate on voltage VGL.

Since the voltage of the output signal Gout (n) is changed to a voltage of the start signal in synchronization with the edge of the clock CLK, the edge trigger circuit generates the output signal Gout (N) in the same waveform as a phase of the start signal. When a waveform of the start signal is changed, the waveform of the output signal is changed accordingly. In the edge trigger circuit, an input signal may overlap the output signal.

Figure 11:
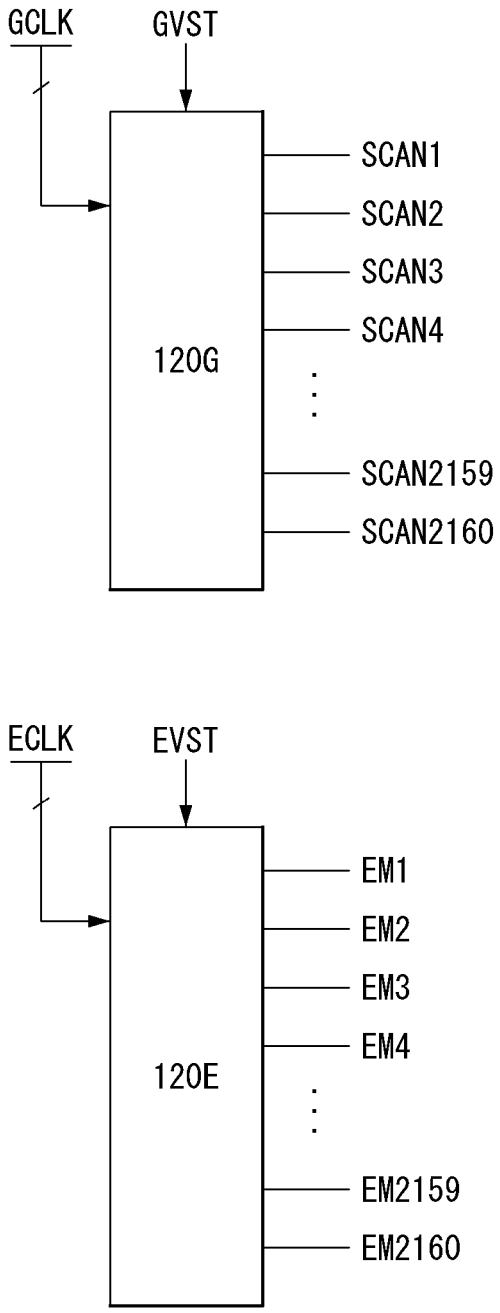
FIG. 11 is a diagram illustrating first and second shift registers of the gate driver.

FIG. 11 is a diagram illustrating first and second shift registers of the gate driver 120.

Referring to FIG. 11, the gate driver 120 may include a first shift register 120G and a second shift register 120E. The first shift register 120G may receive a gate start pulse GVST and gate shift clocks GCLK and sequentially output scan signals SCAN1 to SCAN2160. The second shift register 120E may receive a gate start pulse EVST and gate shift clocks ECLK and sequentially output EM signals EM1 to EM2160.

Figure 12:
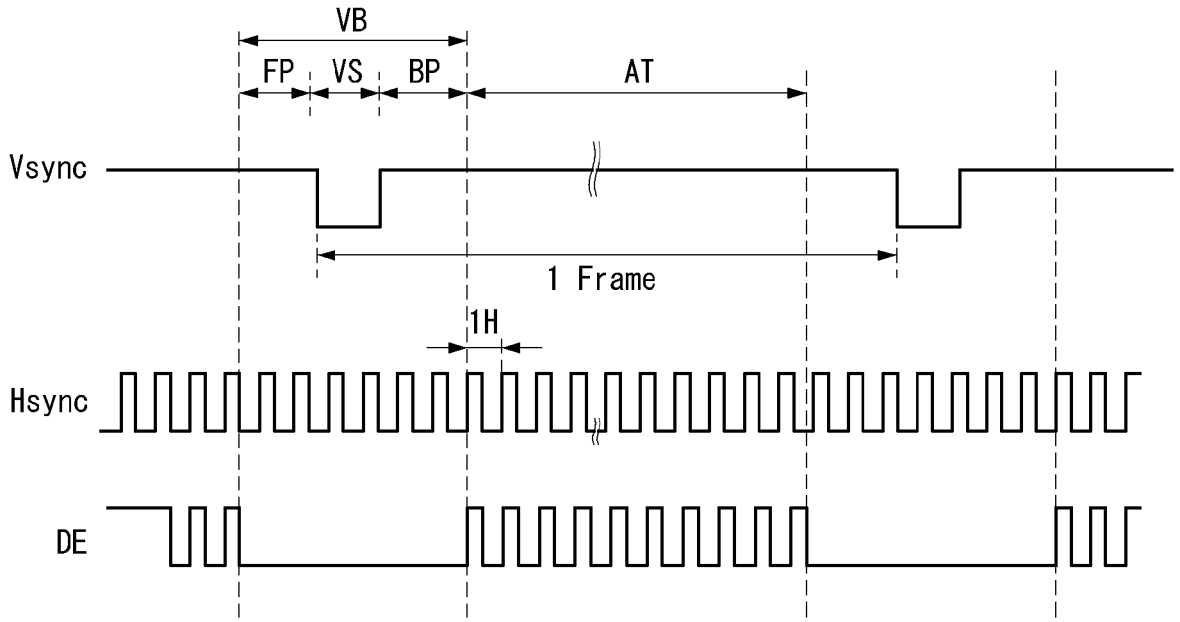
FIG. 12 is a detailed diagram illustrating an active interval and a vertical blank interval of one frame interval.

FIG. 12 is a detailed diagram illustrating an active interval and a vertical blank interval of one frame interval.

Referring to FIG. 12, one frame interval FR Total is divided into an active interval AT, in which pixel data is input, and a vertical blank interval VB in which pixel data is not present.

During the active interval AT, pixel data of one frame, which is to be written in all the pixels P on the screens L, A, and R of the display panel 100, is received by the drive IC 300 and written in the pixels P.

The vertical blank interval VB is a blank interval in which pixel data is not received by a timing controller between an active interval AT of a $(N-1)^{th}$ frame interval (N is a natural number) and an active interval AT of an $N^{th}$ frame interval. The vertical blank interval VB includes a vertical sync time VS, a vertical front porch FP, and a vertical back porch BP.

The vertical blank interval VB is a time from a falling edge of a last pulse in a data enable signal DE received at the $(N-1)^{th}$ frame interval to a rising edge of a first pulse in the data enable signal DE received at the $N^{th}$ frame interval. A start time of the $N^{th}$ frame interval is a rising timing of the first pulse in the data enable signal DE.

A vertical synchronization signal Vsync defines one frame interval. A horizontal synchronization signal Hsync defines one horizontal time. The data enable signal DE defines a valid data interval including pixel data which is to be displayed on the screen.

A pulse of the data enable signal DE is synchronized with the pixel data which is to be written in the pixels of the display panel 100. One pulse period of the data enable signal DE is one horizontal time 1H.

Figure 13:
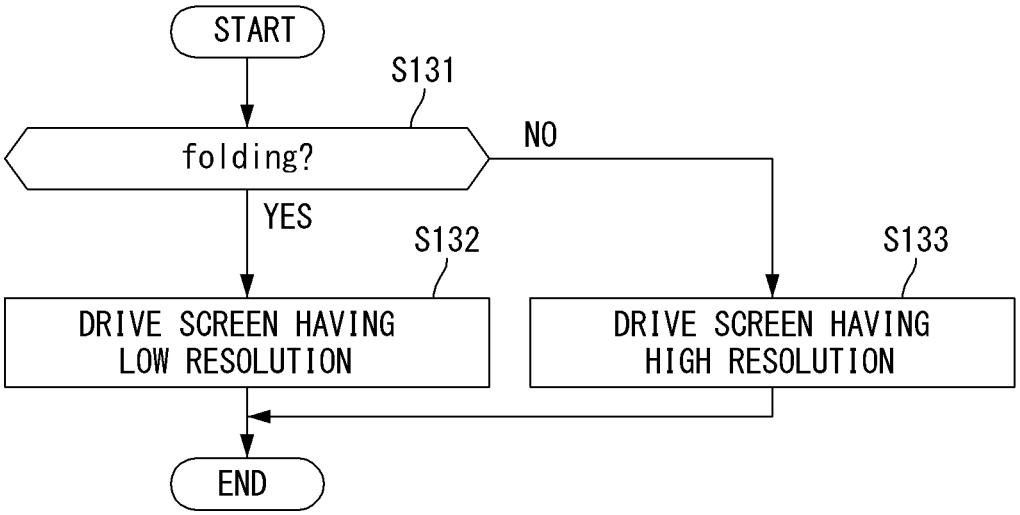
FIG. 13 is a flowchart illustrating a method of driving a foldable display according to a first embodiment of the present disclosure.

FIG. 13 is a flowchart illustrating a method of driving a foldable display according to a first embodiment of the present disclosure.

Figure 16A:
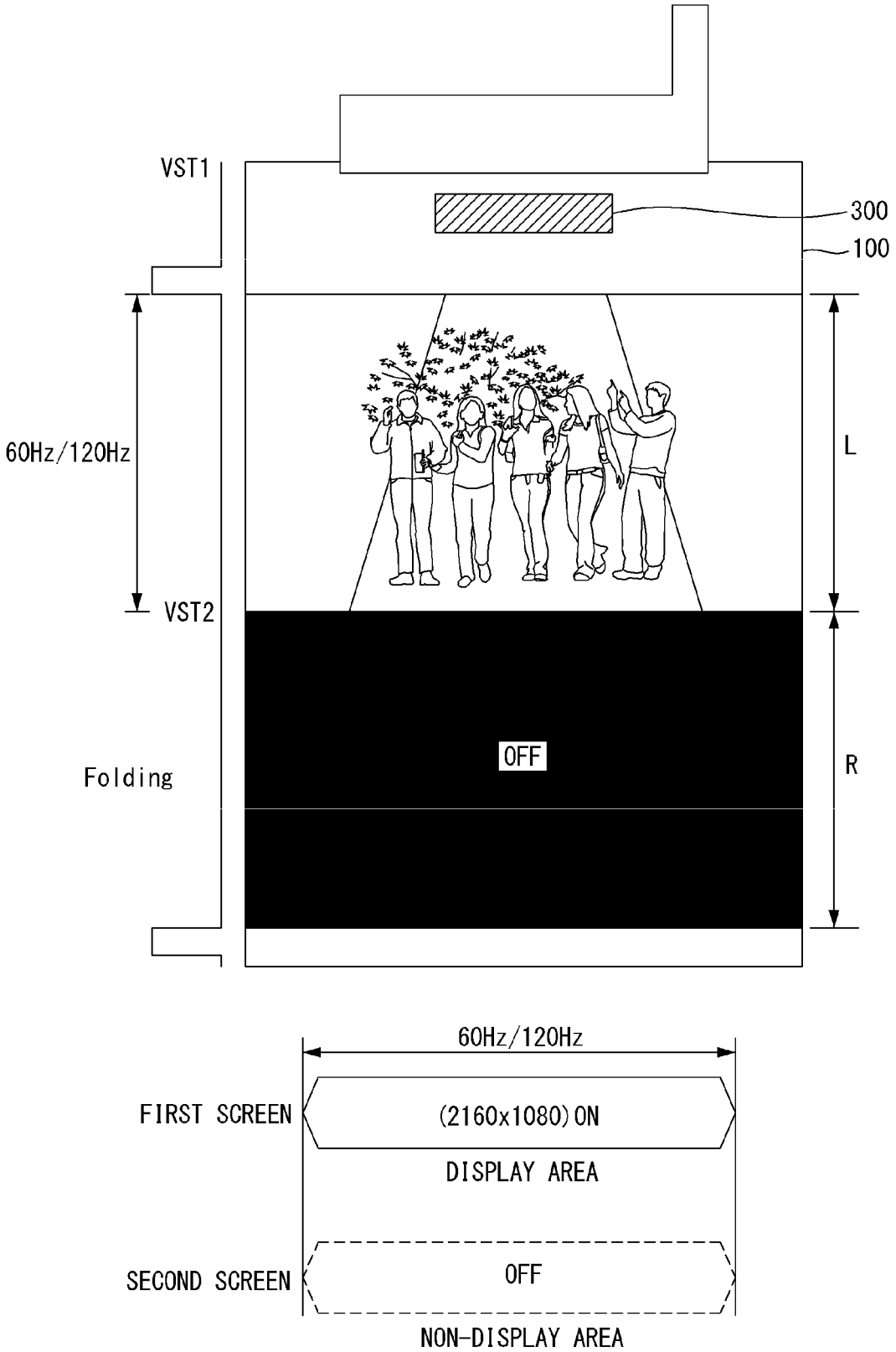
FIGS. 16A and 16B are diagrams illustrating screens in a folded state on the foldable display of the present disclosure.
Figure 16B:
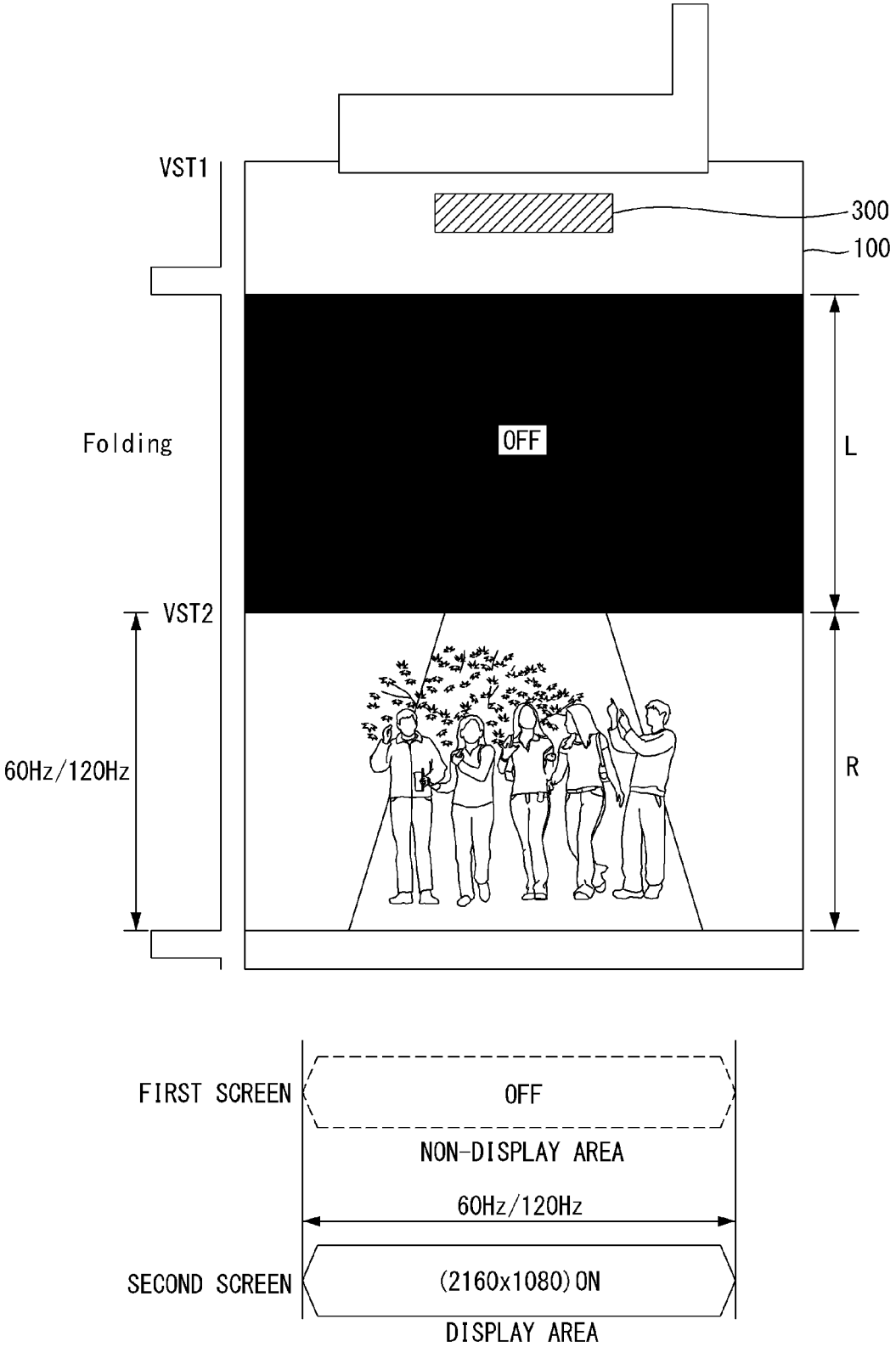

Referring to FIG. 13, when the flexible display panel 100 is folded, the drive IC 300 drives a screen (i.e., partial portion of the flexible display panel 100) having a low resolution (S131 and S132). As shown in FIGS. 16A and 16B, the screen having a low resolution is a screen having 2160*1080 resolution and may be any screen of the first and second screens L and R at which a user looks. The screen having a low resolution may be driven at a predetermined reference frequency or at a frequency different from the reference frequency. The reference frequency may be a frame frequency of 60 Hz. The frequency different from the reference frequency may be a frequency that is larger or smaller than the reference frequency.

Figure 17:
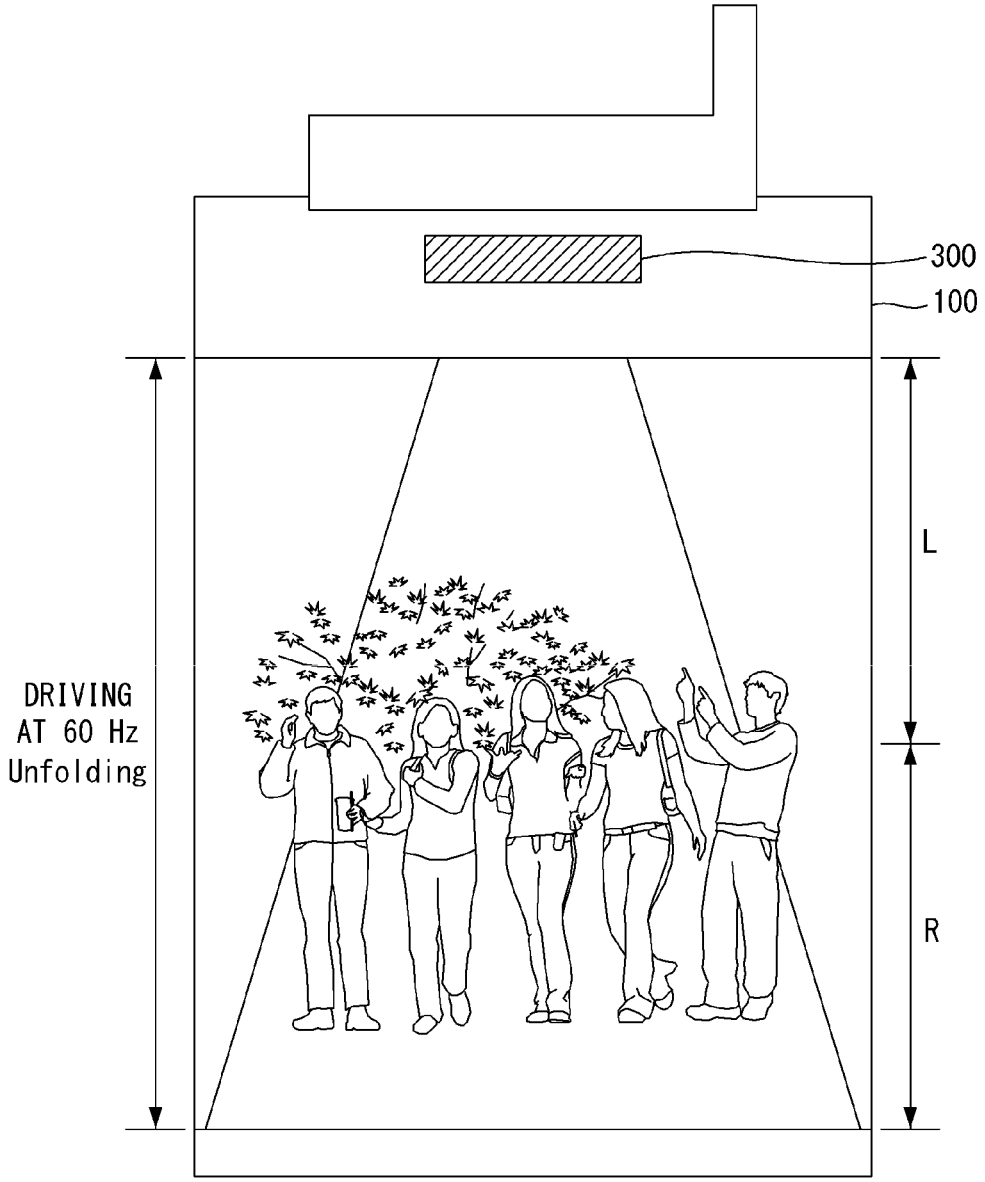
FIG. 17 is a diagram illustrating a screen in an unfolded state on the foldable display of the present disclosure.
Figure 17:
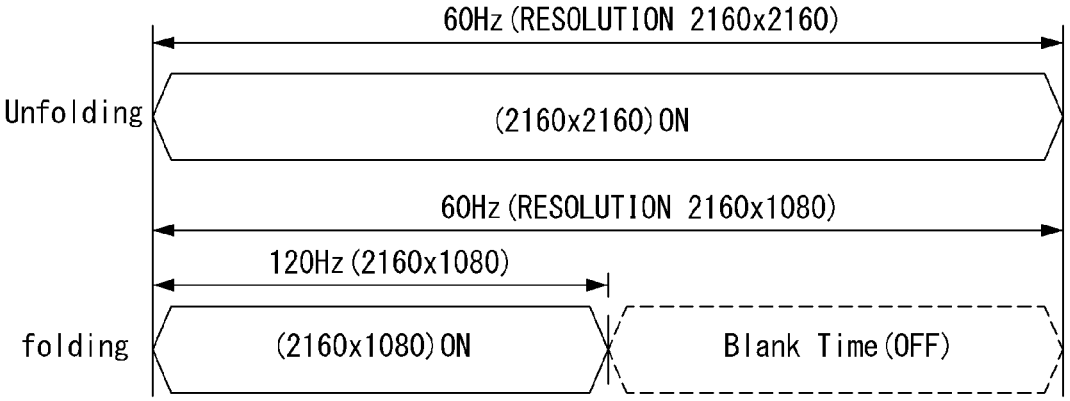

When the flexible display panel 100 is in an unfolded state in which the flexible display panel 100 is not folded, the drive IC 300 drives a screen (i.e., full portion of the flexible display panel 100) having a high resolution (S131 and S133). The screen having a high resolution is a screen in which the folding boundary A and the first and second screens L and R are combined. As shown in FIG. 17, the screen having a high resolution may be driven at the reference frequency or the frequency different from the reference frequency.

Figure 14:
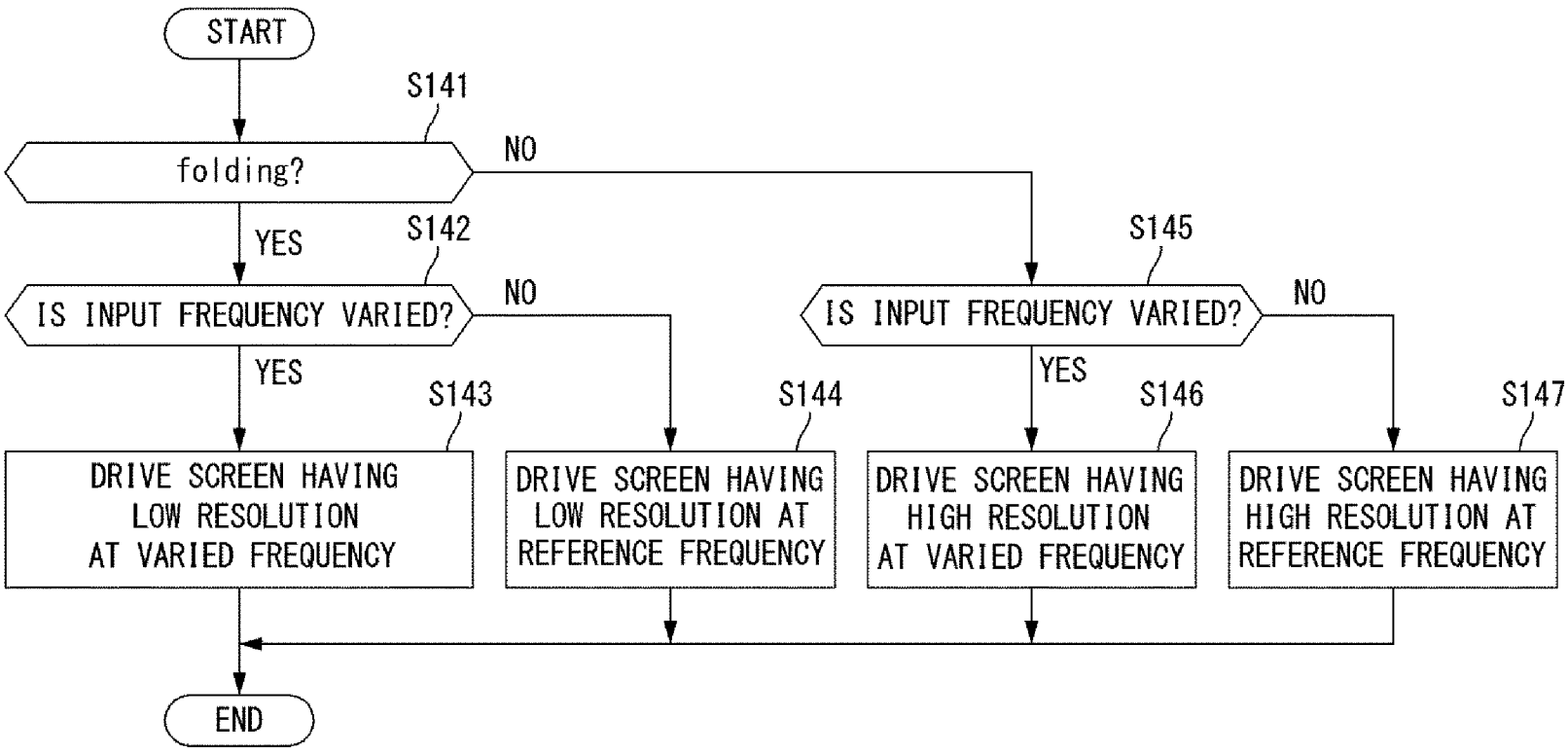
FIG. 14 is a flowchart illustrating a method of driving a foldable display according to a second embodiment of the present disclosure.

FIG. 14 is a flowchart illustrating a method of driving a foldable display according to a second embodiment of the present disclosure.

Referring to FIG. 14, when the flexible display panel 100 is folded, the drive IC 300 drives the screen (i.e., partial portion of the flexible display panel 100) having a low resolution (S141 to S144). In the folded state, a frame frequency of an image signal input to the drive IC 300 may be varied. In this case, the drive IC 300 detects the frame frequency of the input image signal and drives the screen having a low resolution at the varied frequency (S142 and S143). The varied frequency means the frame frequency different from the reference frequency. When the input frequency of the drive IC 300 is not varied in the folded state, the drive IC 300 drives the screen having a low resolution at the reference frequency (S142 and S144).

When the flexible display panel 100 is in the unfolded state in which the flexible display panel 100 is not folded, the drive IC 300 drives the screen (i.e., full portion of the flexible display panel 100) having a high resolution (S145 to S147). In the unfolded state, a frame frequency of an image signal input to the drive IC 300 may be varied. In this case, the drive IC 300 detects the frame frequency of the input image signal and drives the screen having a high resolution at the varied frequency (S145 and S146). When the input frequency of the drive IC 300 is not varied in the unfolded state, the drive IC 300 drives the screen having a high resolution at the reference frequency (S145 and S147).

The foldable display of the present disclosure may drive any one screen in a virtual reality (VR) mode in the folded state. In the VR mode, in order to prevent a user from feeling motion sickness and fatigue, it is necessary to move an image by reflecting movement of the user in real time at a high frame frequency when the user moves.

Figure 15:
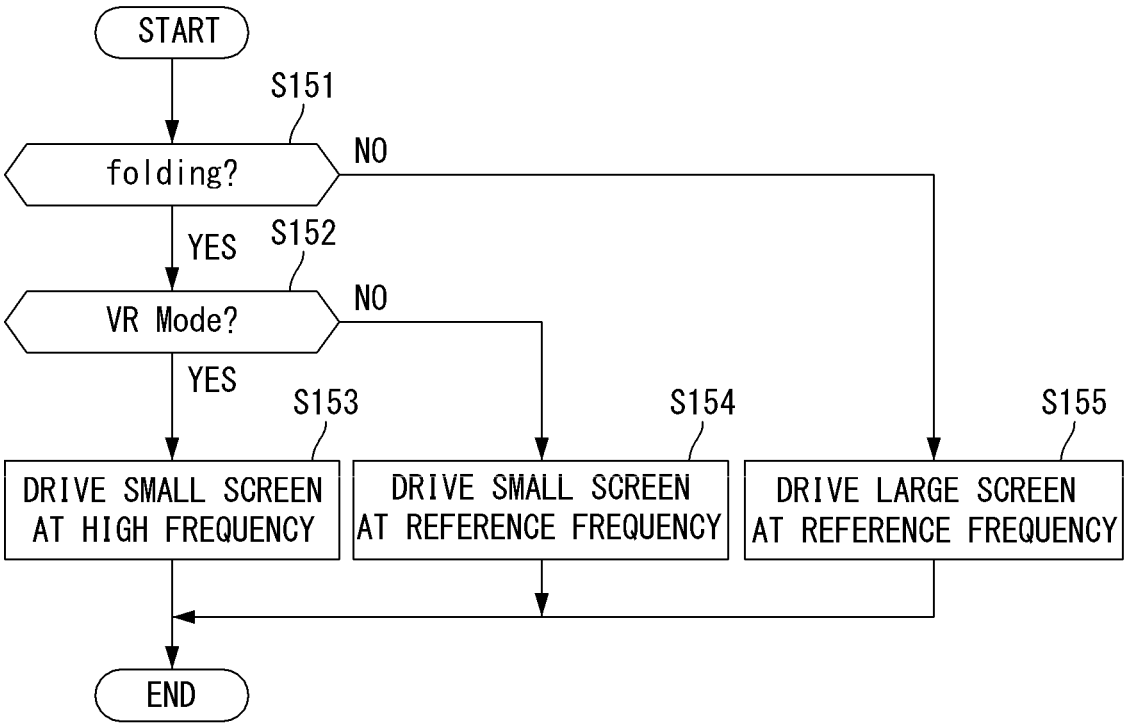
FIG. 15 is a flowchart illustrating a method of driving a foldable display according to a third embodiment of the present disclosure.

FIG. 15 is a flowchart illustrating a method of driving a foldable display according to a third embodiment of the present disclosure.

Referring to FIG. 15, when the flexible display panel 100 is folded, the drive IC 300 drives the screen (i.e., partial portion of the flexible display panel 100) having a low resolution (S151 to S154).

In the folded state, the user may select the VR mode in a state in which the foldable display is folded. In this case, the host system 200 transmits an image signal of a VR content selected by the user to the drive IC 300. In response to a motion sensor signal, the host system 200 may generate and transmit an image signal of a high frame frequency to the drive IC 300 by rendering pixel data to which movement of the user is reflected. In the VR mode, the drive IC 300 receives an input image signal having a frequency that is higher than the reference frequency and drives the screen having a low resolution at a high frequency. The high frequency may be a frame frequency of 120 Hz (S152 and S153). When the VR mode is not selected in the folded state, the drive IC 300 drives the screen having a low resolution at the reference frequency (S152 and S153).

When the flexible display panel 100 is in the unfolded state in which the flexible display panel 100 is not folded, the drive IC 300 drives the screen (i.e., full portion of the flexible display panel 100) having a high resolution at the reference frequency (S151 and S155).

FIG. 18 is a circuit diagram illustrating an operation of a pixel in a deactivated screen. The second screen R is a deactivated screen in the example of FIG. 16A, and the first screen L is a deactivated screen in the example of FIG. 16B.

Referring to FIG. 18, pixels of the inactivated screen do not emit light and are maintained in a black display state. The deactivated screen may be a screen at which the user does not look when the flexible display panel 100 is folded.

In order to allow the deactivated screen to be maintained in a black display, a pixel circuit of the deactivated screen suppresses light emission of the light emitting element OLED. To this end, in response to the gate on voltage VGL of the $N^{th}$ scan signal SCAN (N), the sixth switching element M6 of the deactivated screen applies Vini to the anode of the light emitting element OLED. When Vini is applied to the anode, since a voltage between the anode and the cathode is lower than the threshold voltage Vth, the light emitting element OLED is turned off to not emit light.

Figure 21:
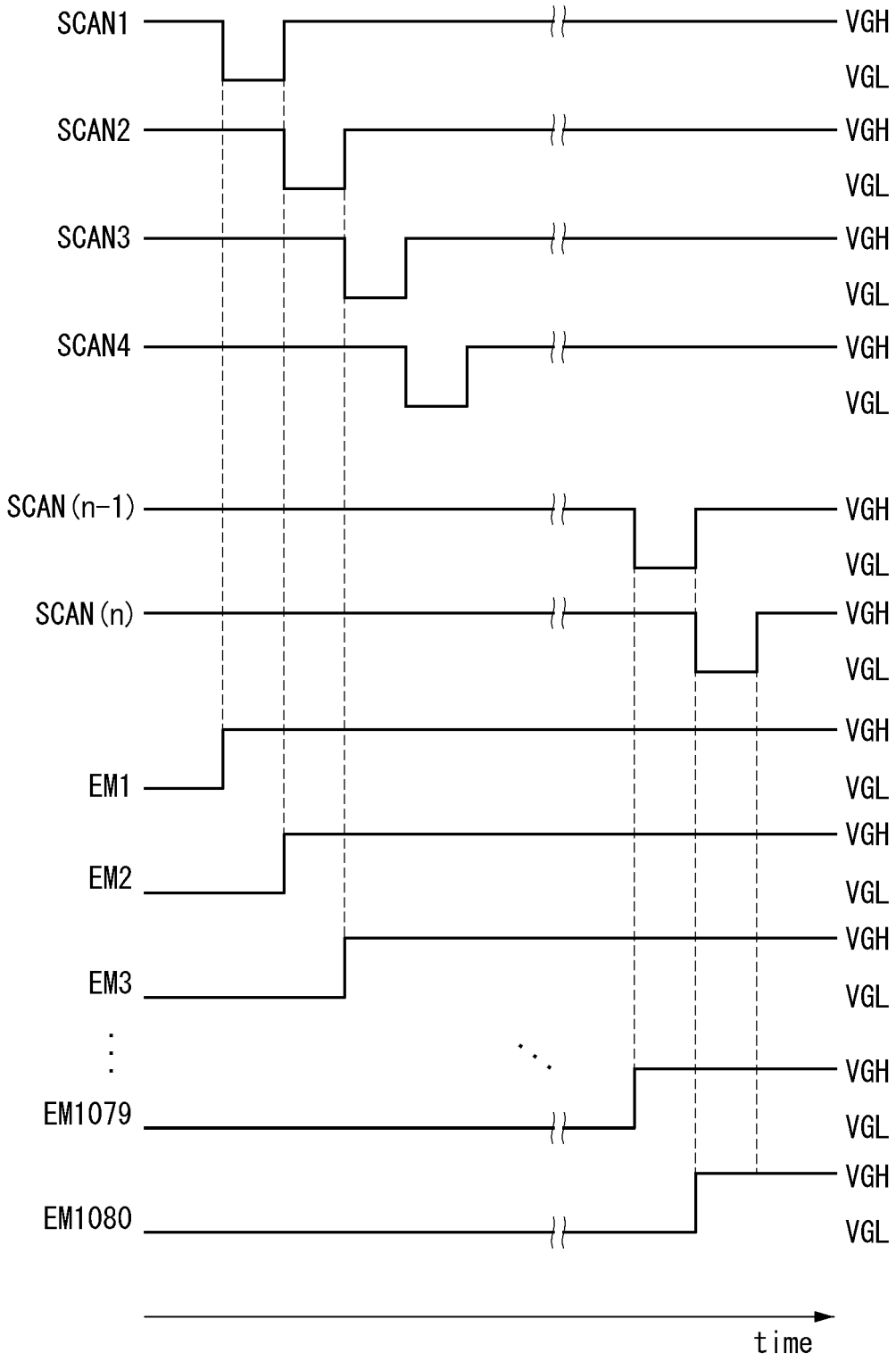
FIG. 21 is a diagram illustrating an example of the gate signal when the first screen is deactivated.

As shown in FIG. 21, the EM signal EM (N) applied to the pixels of the deactivated screen is applied as the gate off voltage VGH during one frame interval or more. This is because of preventing a residual charge of the drive element DT due to a previous data signal from influencing an anode potential of the light emitting element OLED by blocking a current path between ELVDD and the drive element DT and a current path between the drive element DT and the light emitting element OLED. The EM signal EM (N) of the gate off voltage VGH is applied to the gates of the third and fourth switching elements M3 and M4 to turn the third and fourth switching elements M3 and M4 off during one frame interval or more.

The drive IC 300 does not supply the data voltage Vdata to the pixels of the deactivated screen. In this case, an output buffer of the data driver 306 is turned off to not output the data voltage Vdata, and the data output channel of the data driver 306 become a high impedance state. When the data output channel is in the high impedance state, the data output channel is electrically separated from the data line.

In each pixel of the deactivated screen, the first, second, and sixth switching elements M1, M2, and M6 may be turned on according to the gate on voltage VGL of the Nth scan signal SCAN (N). In each pixel of the deactivated screen, the third, fourth, and fifth switching elements M3, M4, and M5 may be turned off according to the gate off voltage VGH of the (N−1)th scan signal SCAN (N−1).

Figure 19:
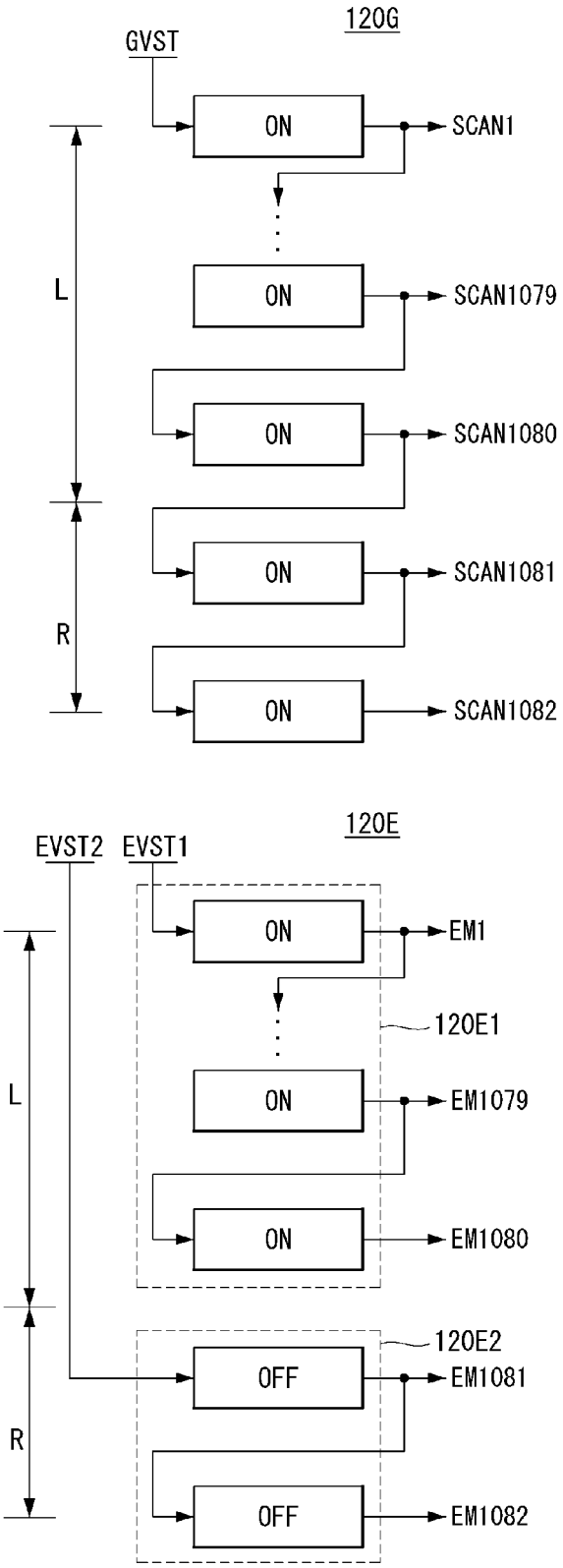
FIG. 19 is a diagram illustrating input signals and on/off states of the first and second shift registers in the gate driver.

FIG. 19 is a diagram illustrating input signals and on/off states of the first and second shift registers 120G and 120E in the gate driver 120. FIG. 19 illustrates an example in which the folding boundary A is assumed as being the minimum.

Referring to FIG. 19, the first shift register 120G receives one gate start pulse GVST for scanning and a gate shift clock. The first shift register 120G receives the gate start pulse GVST for scanning through a first stage and starts to output scan signals SCAN1 to SCAN1082. In the present embodiment, the scan signals SCAN1 to SCAN1082 are sequentially applied to all pixel lines of the screen in a pixel line unit. In the case of the deactivated screen, since the data voltage Vdata is not applied to the data lines, even when the scan signals SCAN1 to SCAN1082 are applied to the pixels, the drive element DT is not turned on and the light emitting element OELD does not emit light.

The second shift register 120E receives first and second gate start pulses EVST1 and EVST2 for light emission (EM) and a gate shift clock. The second shift register 120E includes a second-first shift register 120E1 which receives the first gate start pulse EVST1 for EM and supplies EM signals to the pixels of the first screen L, and a second-second shift register 120E2 which receives the second gate start pulse EVST2 for EM and supplies EM signals to the pixels of the second screen R.

The second-first shift register 120E1 supplies the EM signals to the pixels of the first screen L. The second-second shift register 120E2 supplies the EM signals to the pixels of the second screen R. When one of the first and second screens is deactivated, a gate start pulse for EM indicating a start timing of an EM signal of the deactivated screen is not generated and is generated as a DC voltage. Therefore, a normal gate start pulse for EM is not applied to the deactivated screen.

The first gate start pulse EVST1 for EM is input to a first stage of the second-first shift register 120E1. The first stage of the second-first shift register 120E1 supplies a first EM signal EM1 to a first pixel line in which scanning of the second screen R is started. A first stage of the second-second shift register 120E2 supplies a $1081^{st}$ EM signal EM1081 to a $1081^{st}$ pixel line in which scanning of the second screen R is started.

When the first screen L is activated, the first gate start pulse EVST1 for EM is input to the first stage. In this case, the EM signals EM1 to EM1080 are sequentially applied to the pixel lines of the first screen L.

When the first screen L is deactivated, the first gate start pulse EVST1 for EM is not input to the first stage of the first screen L. In this case, since the EM signals EM1 to EM1080 with the gate on voltage VGL are not applied to the pixel lines of the first screen L, a current does not flow in the light emitting element OLED, and thus the light emitting element OLED does not emit light.

The second gate start pulse EVST2 for EM is input to the first stage of the second screen R, for example, a 1081st stage ST1081 in which scanning of the second screen R is started.

When the second screen R is activated, the second gate start pulse EVST2 for EM is input to the first stage of the second screen R. In this case, EM signals EM1081 and EM1082 are sequentially applied to the pixel lines of the second screen R.

When the second screen R is deactivated, the second gate start pulse EVST2 for EM is not input to the first stage of the second screen R. In this case, since the EM signals EM1081 and EM1082 with the gate on voltage VGL are not applied to the pixel lines of the second screen R, a current does not flow in the light emitting element OLED, and thus the light emitting element OLED does not emit light.

FIG. 19 illustrates an example in which the flexible display panel 100 is folded, and thus the first screen L is activated and the second screen R is deactivated. The EM signal applied to the screen of the non-display area may be maintained at the gate off voltage VGH during one frame interval or more.

Figure 20:
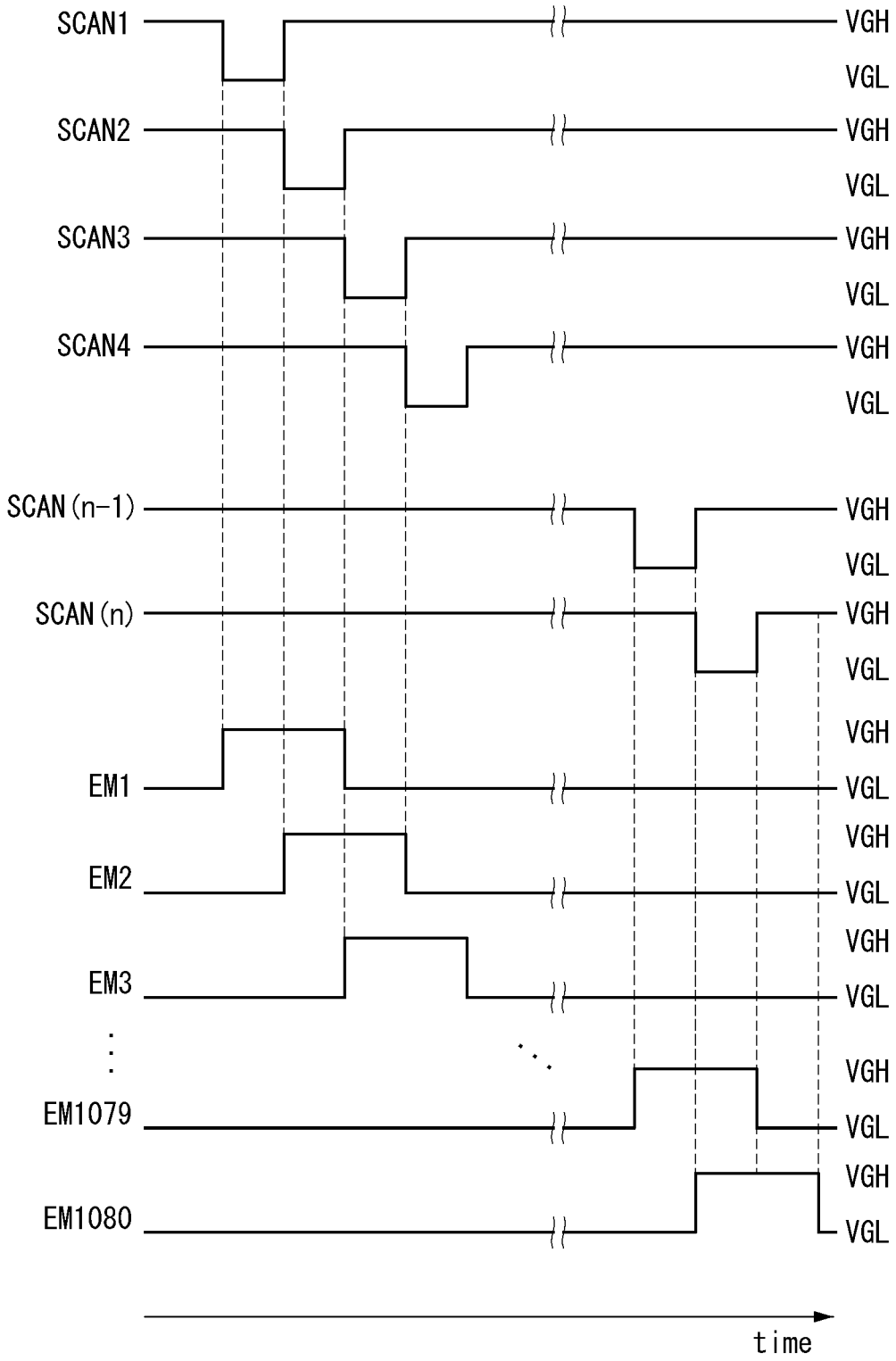
FIG. 20 is a diagram illustrating an example of a gate signal when a first screen is activated.

FIG. 20 is a diagram illustrating an example of a gate signal when a first screen is activated.

Referring to FIG. 20, the first screen L is activated so that an image may be displayed on the first screen L. The data output channels of the drive IC 300 output the data voltage Vdata of the input image at a scanning time of the activated first screen L. The scan signals SCAN1 to SCAN1080 may be pulses with the gate on voltage VGL synchronized with the data voltage Vdata and may be sequentially supplied to the pixel lines of the first screen L. The EM signals EM1 to EM1080 may be generated as pulses with the gate off voltage VGH synchronized with the $(N-1)^{th}$ and $N^{th}$ scan signals SCAN (N−1) and SCAN (N). The EM signals EM1 to EM1080 may be inverted into the gate on voltage VGL during at least a portion of the light emission time Tem to allow the current path between ELVDD and the light emitting element OLED to be formed.

FIG. 21 is a diagram illustrating an example of the gate signal when the first screen is deactivated.

Referring to FIG. 21, when the first screen L is deactivated, the first screen L displays a black color. In this case, the data output channels of the drive IC 300 become a high impedance state at the scanning time of the first screen L and do not output the data voltage Vdata. The scan signals SCAN1 to SCAN1080 are sequentially supplied to the pixel lines of the first screen L. The sixth switching elements M6 of the first screen L are turned on in response to the scan signals SCAN1 to SCAN1080 to apply Vini to the anodes of the light emitting elements OLED. The EM signals EM1 to EM1080 may be generated as pulses with the gate off voltage VGH during one frame interval or more. Consequently, since Vini is applied to the anodes of the light emitting elements OLED of the deactivated first screen L during one frame interval or more, the first screen L may stably maintain a black display state with minimum brightness without a variation in brightness.

Figure 22:
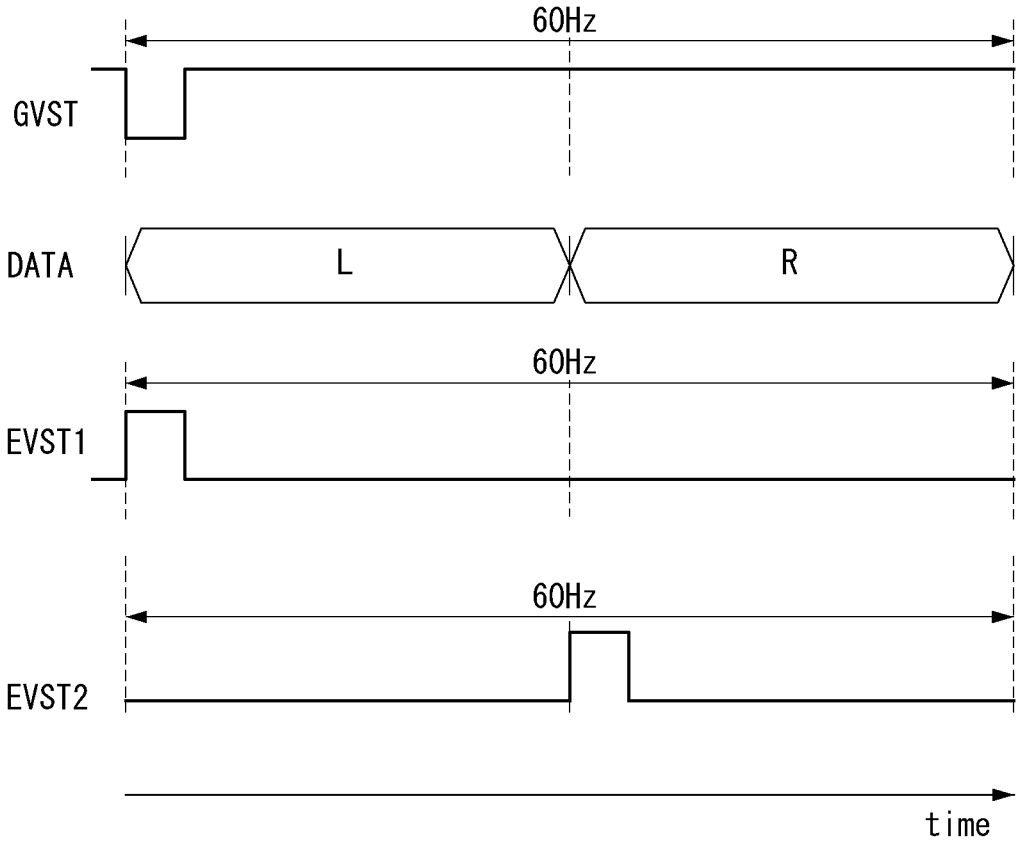
FIG. 22 is a waveform diagram showing a gate start pulse when an entire screen is activated.
Figure 25:
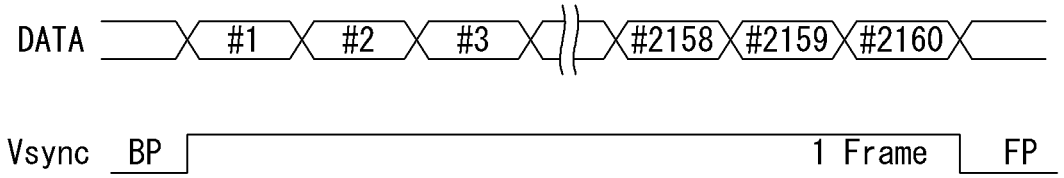
FIG. 25 is a waveform diagram showing a data signal and a vertical synchronization signal when the entire screen is activated.

FIG. 22 is a waveform diagram showing a gate start pulse when all the screens L, A, and R are activated. When the flexible display panel 100 is in an unfolded state, an input image may be displayed on the screens L, A, and R having the maximum resolution. In FIG. 25, #1, #2, . . . , and #2160 are pixel line numbers indicating data signals for the pixel lines.

Referring to FIGS. 22 and 25, the gate start pulse GVST for scanning is generated as the gate on voltage VGL at the beginning of one frame interval and then maintained at the gate off voltage VGH. The first shift register 120G starts to output a scan signal in response to the gate start pulse GVST for scanning and shifts the scan signal at every gate shift clock timing to sequentially provide the scan signal to all the pixel lines in the screens L, A, and R. The scan signal is synchronized with the data voltage Vdata of the input image.

In FIG. 22, the first gate start pulse EVST1 for EM is generated as a pulse with the gate off voltage VGH at the beginning of one frame interval and then inverted into the gate on voltage VGL. The second gate start pulse EVST2 for EM is generated as a pulse with the gate off voltage VGH at approximately half of the one frame interval and then inverted into the gate on voltage VGL.

The second-first shift register 120E1 starts to output a pulse of the EM signal to the first pixel line of the first screen L in response to the first gate start pulse EVST1 for EM and shifts the EM signal at every gate shift clock timing to sequentially supply the pulse of EM signal to all the pixel lines of the first screen L. The second-second shift register 120E2 starts to output a pulse of the EM signal to the first pixel line of the second screen R in response to the second gate start pulse EVST2 for EM and shifts the pulse of the EM signal at every gate shift clock timing to sequentially supply the pulse of EM signal to all the pixel lines of the second screen R.

Figure 23:
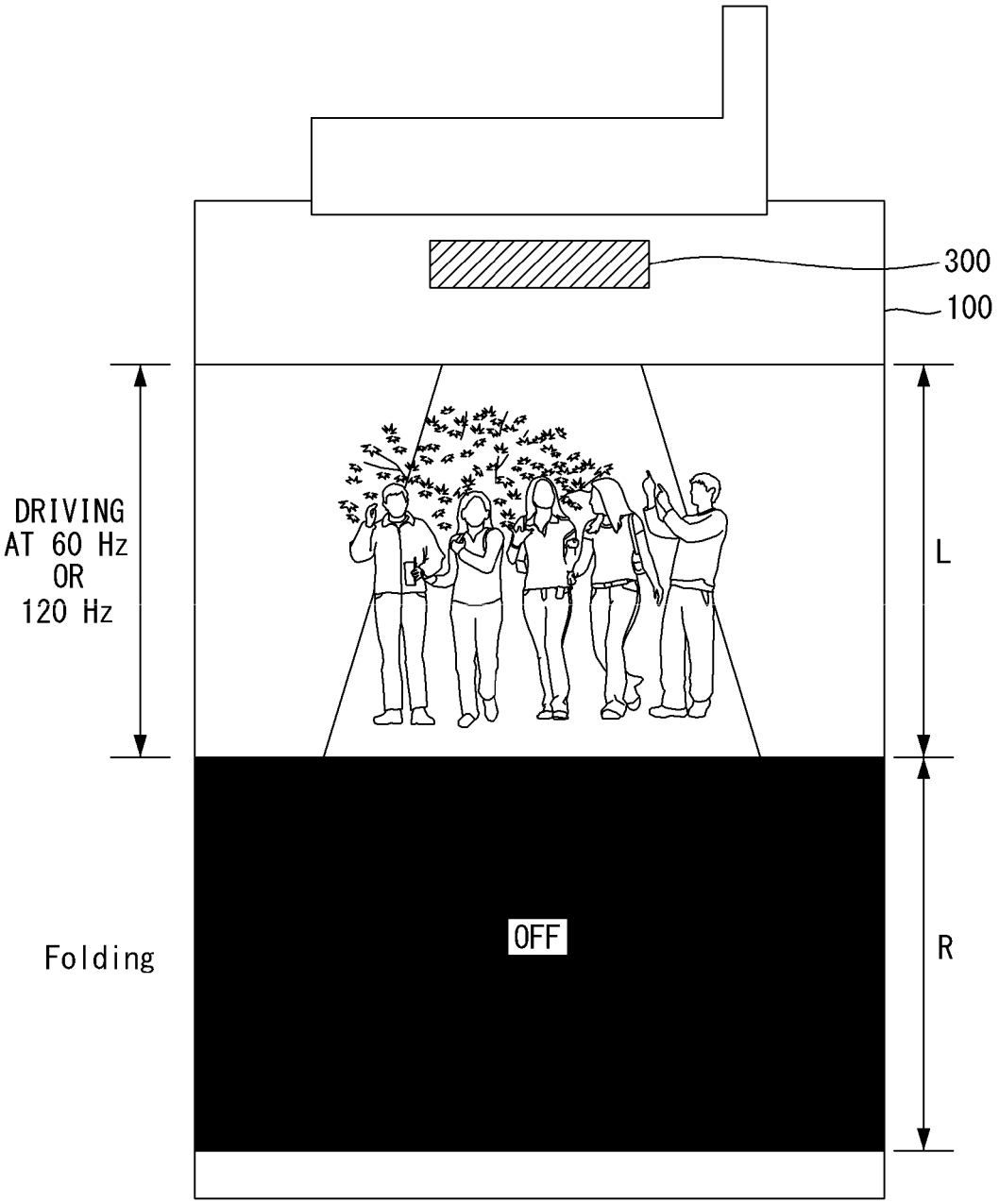
FIG. 23 is a diagram illustrating an example in which an image is displayed on only the first screen.

FIG. 23 is a diagram illustrating an example in which an image is displayed on only the first screen L. The first screen L is activated and driven at a frame frequency of 60 Hz or 120 Hz to display pixel data of the input image. The second screen R is deactivated to display a black color.

Figure 24A:
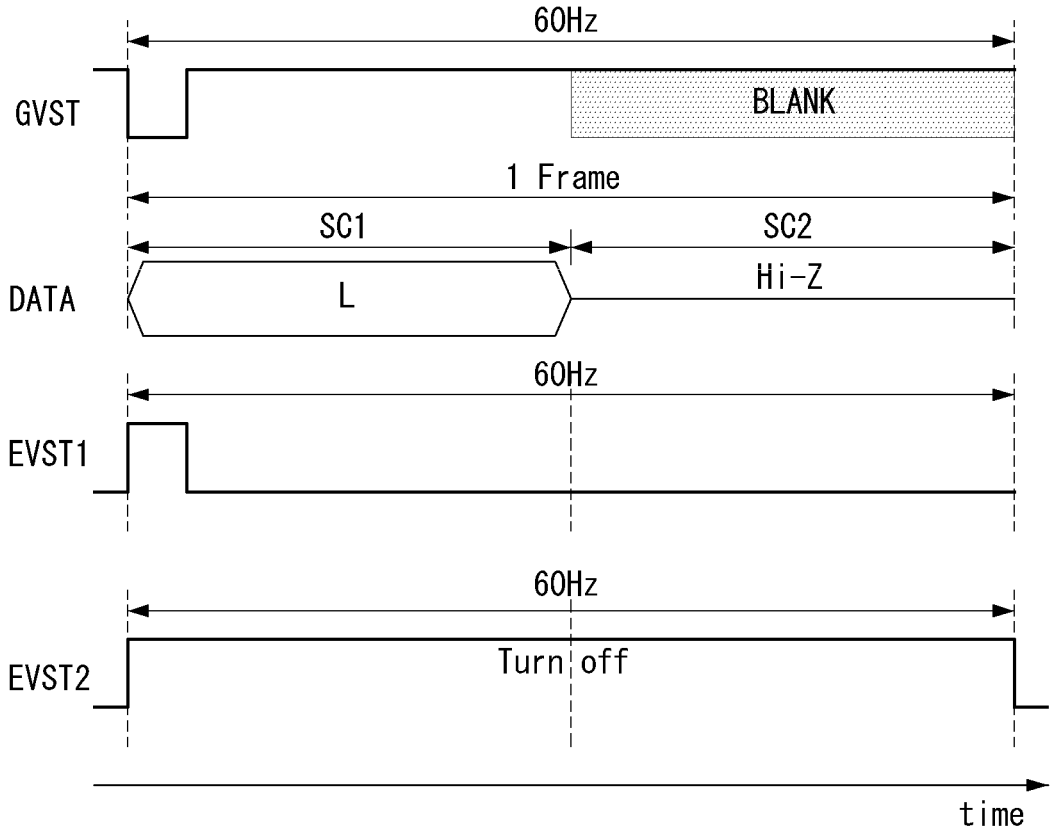
FIGS. 24A and 24B are waveform diagrams showing gate start pulses when the first screen is driven at a frame frequency of 60 Hz or 120 Hz.
Figure 26A:
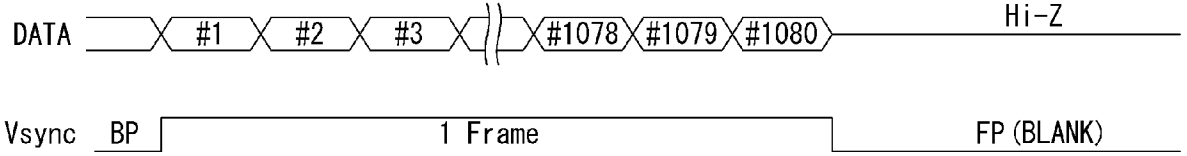
FIGS. 26A and 26B are waveform diagrams showing the data signal and the vertical synchronization signal when the first screen is driven at the frame frequency of 60 Hz or 120 Hz.

FIGS. 24A and 26A are waveform diagrams showing the gate start pulses GVST, EVST1, and EVST2 when the first screen L is driven at the frame frequency of 60 Hz. In FIG. 26A, #1, #2, . . . , and #2160 are pixel line numbers indicating data signals for the pixel lines.

Referring to FIGS. 24A and 26A, the screens L, A, and R are driven at the frame frequency of 60 Hz. In this case, the first screen L displays the input image, whereas the second screen R displays a black color having minimum brightness. The folding boundary A may display the input image or may display the same black color as the second screen R. Alternatively, at least a part of the folding boundary A may display the input image or may display the same black color as the second screen R.

The gate start pulse GVST for scanning is generated as the gate on voltage VGL at the beginning of one frame interval and then maintained at the gate off voltage VGH.

The first shift register 120G starts to output a scan signal at the frame frequency of 60 Hz in response to the gate start pulse GVST for scanning and shifts the scan signal at every gate shift clock timing to sequentially provide the scan signal to all the pixel lines in the screens L, A, and R. The scan signal is synchronized with the data voltage Vdata of the input image.

At the frame frequency of 60 Hz, one frame interval may be divided into a first scan interval SC1 and a second scan interval SC2.

During the first scan interval SC1, the drive IC 300 outputs the data voltage Vdata through the data output channels. The first scan interval SC1 may be a first half interval of one frame interval. The data voltage Vdata is applied to the pixels of the first screen L through the data lines. Thus, during the first scan interval SC1, the pixel data of the input image is written in the pixels of the first screen L.

During the second scan interval SC2, the drive IC 300 turns the output buffers of the data output channels off to maintain the data output channels at high impedance Hi-Z. The second scan interval SC2 may be a second half interval of one frame interval. Since the data voltage Vdata of the pixel data is not output from the drive IC 300 during the second scan interval SC2, the pixel data of the input image is not written in the pixels of the second screen R during the second scan interval SC2. During the second scan interval SC2, the sixth switching elements M6 of the second screen R are turned on in response to the scan signals to apply Vini to the anodes of the light emitting elements OLED so that the light emitting elements OLED are turned off. Thus, during the second scan interval SC2, the second screen R displays a black color.

As shown in FIGS. 24A and 26A, the second scan interval SC2 may be regarded as a part of the vertical blank interval, and thus the second scan interval SC2 may be interpreted as that the vertical blank interval (VB=BLANK) extends.

In FIG. 24A, the first gate start pulse EVST1 for EM is generated as a pulse with the gate off voltage VGH at the beginning of one frame interval and then inverted into the gate on voltage VGL. The second-first shift register 120E1 supplies the pulses of the EM signals to the pixel lines of the first screen L in response to the first gate start pulse EVST1 for EM and then supplies the gate on voltages VGL to allow the pixels in the first screen L to emit lights.

As shown in FIG. 24A, the second gate start pulse EVST2 for EM is maintained at the gate off voltage VGH during one frame interval. Since the voltage of the first gate start pulse EVST1 for EM is maintained at the gate off voltage VGH, the second-first shift register 120E1 maintains voltages of the EM signals of the pixel lines at the gate off voltage VGH. Accordingly, the switching elements M3 and M4 to which the EM signals are applied in the second screen R are turned off so that the current path of the light emitting element OLED is blocked.

The second-first shift register 120E1 starts to output a pulse of the EM signal to the first pixel line of the first screen L in response to the first gate start pulse EVST1 for EM and shifts the EM signal at every gate shift clock timing to sequentially supply the pulse of EM signal to all the pixel lines of the first screen L. The second-second shift register 120E2 starts to output a pulse of the EM signal to the first pixel line of the second screen R in response to the second gate start pulse EVST2 for EM and shifts the pulse of the EM signal at every gate shift clock timing to sequentially supply the pulse of EM signal to all the pixel lines of the second screen R.

Figure 24B:
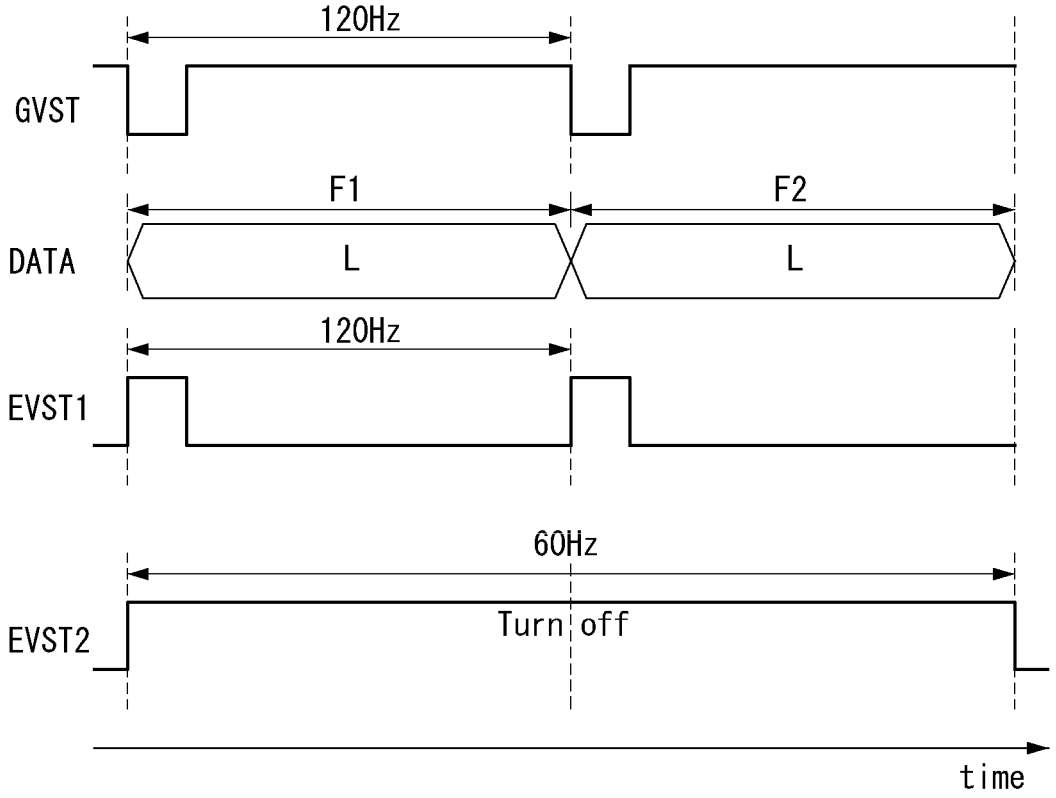
Figure 26B:
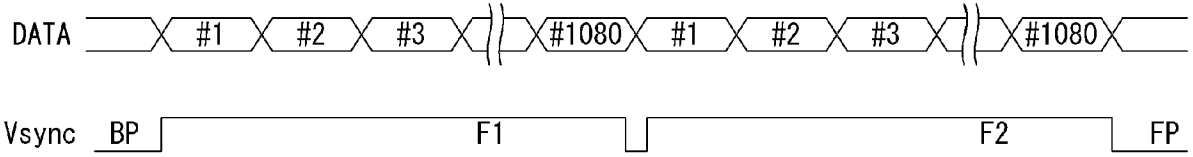

FIGS. 24B and 26B are waveform diagrams showing the gate start pulses GVST, EVST1, and EVST2 when the first screen L is driven at the frame frequency of 120 Hz.

Referring to FIGS. 24B and 26B, only the first screen L is driven at the frame frequency of 120 Hz. Since the first screen L is driven at the frame frequency of 120 Hz, frame data of the same input image is written twice in the first screen L during two frame intervals. In this case, the first screen L displays the input image, whereas the second screen R displays a black color having minimum brightness.

The gate start pulse GVST for scanning is generated twice during the two frame intervals of 120 Hz. The gate start pulse GVST for scanning is generated as a first start pulse with the gate on voltage VGL at the beginning of a first frame interval F1 and then maintained at the gate off voltage VGH. Subsequently, the gate start pulse GVST for scanning is generated again as a second start pulse with the gate on voltage VGL at the beginning of a second frame interval F2 and then maintained at the gate off voltage VGH.

The first shift register 120G starts to output a scan signal at the frame frequency of 120 Hz in response to the first start pulse and shifts the scan signal at every gate shift clock timing to sequentially provide the scan signal to all the pixel lines in the screens L, A, and R during the first scan interval SC1.

During the first frame interval F1, the drive IC 300 outputs a data voltage Vdata synchronized with the scan signal of the first screen L through the data output channels. During the first frame interval F1, pixel data of the input image is written in the pixels of the first screen L.

Subsequently, during the second frame interval F2, the drive IC 300 outputs a data voltage Vdata synchronized with the scan signal of the first screen L through the data output channels. Thus, during the first frame interval F1, the pixel data of the input image is written in the pixels of the first screen L. Therefore, the first screen L is driven at the frame frequency of 120 Hz so that the pixel data of the same image may be written twice in succession in the pixels of the first screen L.

In the case of the pixels of the second screen R, Vini is applied to the anodes of the light emitting elements OLED so that the second screen R maintains a black display.

Figures 27, 28:
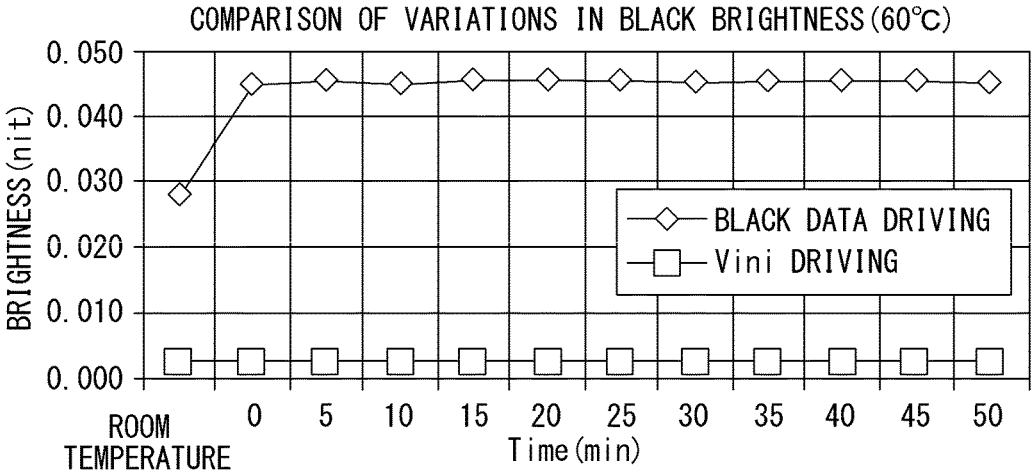
FIGS. 27 and 28 are diagrams showing measured experimental results of black gray scale brightness of a deactivated screen in the present disclosure and Comparative Example 1.

FIGS. 27 and 28 are diagrams showing measured experimental results of black gray scale brightness of a deactivated screen in the present disclosure and Comparative Example 1.

In Comparative Example 1, in order to display a black color on a deactivated screen, during a scan interval of the deactivated screen, data voltages of black gray scale may be supplied to data lines through a drive IC to drive pixels of the deactivated screen with black data. However, as can be seen from the experimental results of FIGS. 27 and 28, in Comparative Example 1, power consumption may be generated in the deactivated screen as well as brightness of the black gray scale being increased. This is because, even when the data voltages of the black gray scale are kept constant due to a temperature characteristic of a drive element DT, a leakage current may be generated in a channel of the drive element DT at a high temperature (60° C.).

In FIGS. 27 and 28, "Black Data Driving" is Comparative Example 1. "Vini driving" represents the present disclosure in which a black color is displayed on the second screen R in the same manner as in FIG. 24A.

As can be seen from FIGS. 27 and 28, when the data voltages of the black gray scale are applied to the pixels as in Comparative Example 1, brightness of the pixels are increased in a high temperature environment. Meanwhile, the present disclosure may suppress light emission of the light emitting element OLED by applying Vini to the anode of the light emitting element OLED, thereby maintaining brightness of the black gray scale of the pixels at minimum brightness even in the high temperature environment.

As shown in FIGS. 29A to 30B, the gate driver 120 may be driven for each screen according to a gate start pulse which is divided for the first screen L and the second screen R. Thus, since the gate driver 120 does not generate a gate signal output in a deactivated screen, power consumption may be minimized. FIGS. 29A to 30B illustrate an example in which the folding boundary A is assumed as being the minimum.

Figure 29A:
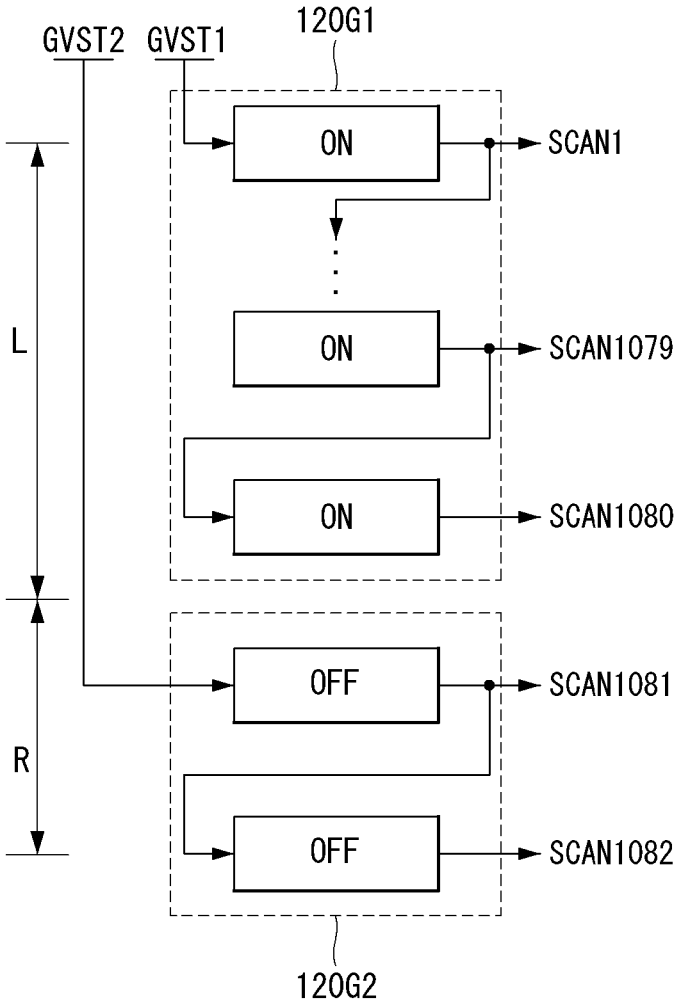
FIGS. 29A to 30B are diagrams illustrating input signals and on/off states of first and second shift registers in a gate driver according to another embodiment of the present disclosure.
Figure 29B:
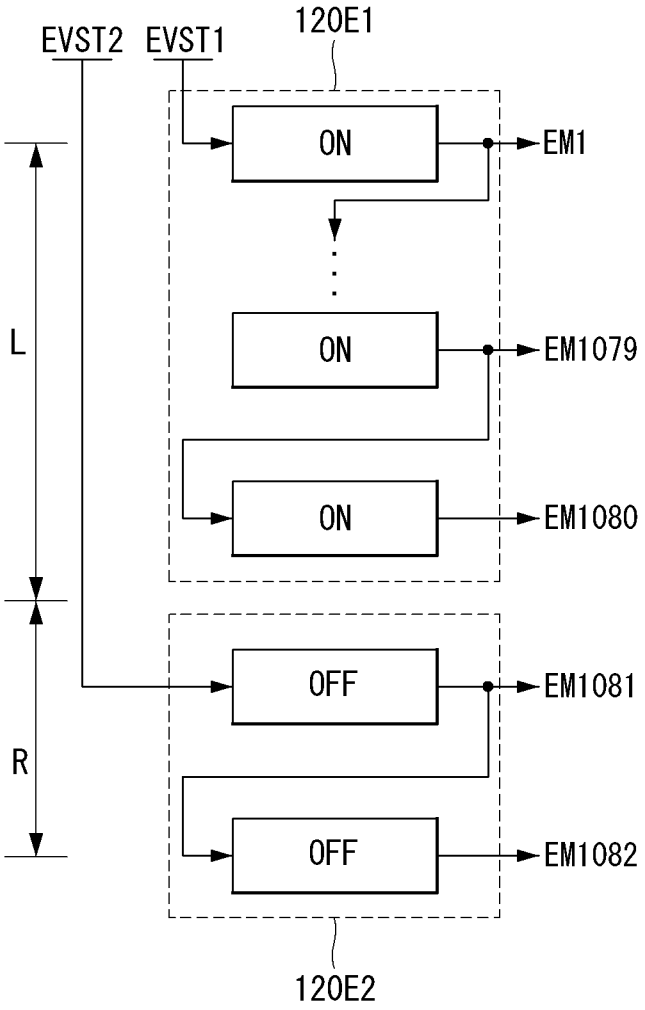
Figure 30A:
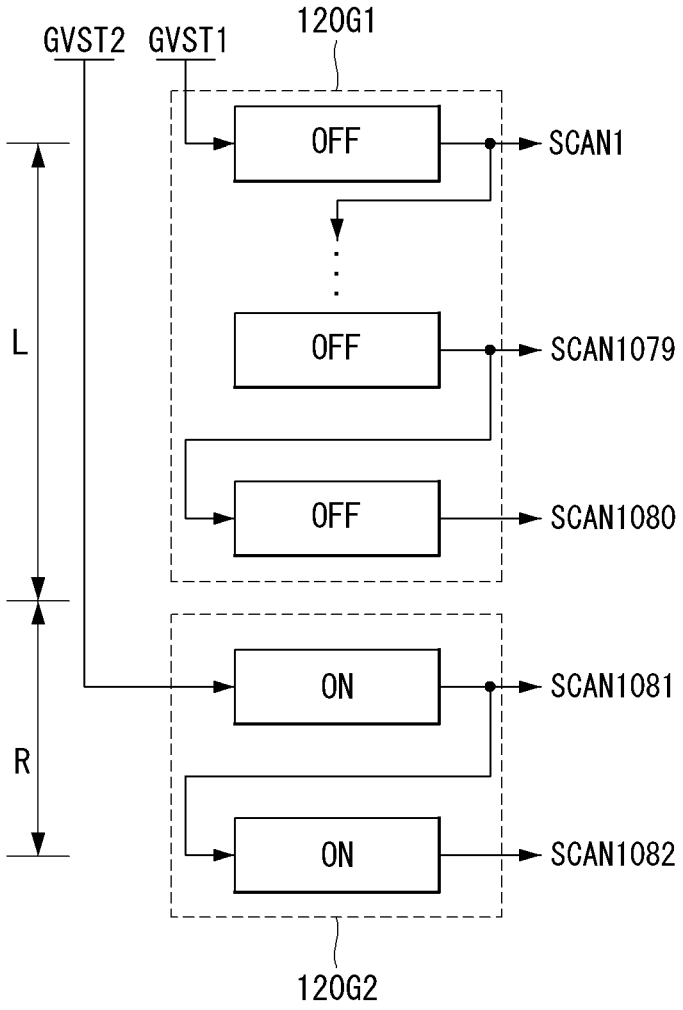
Figure 30B:
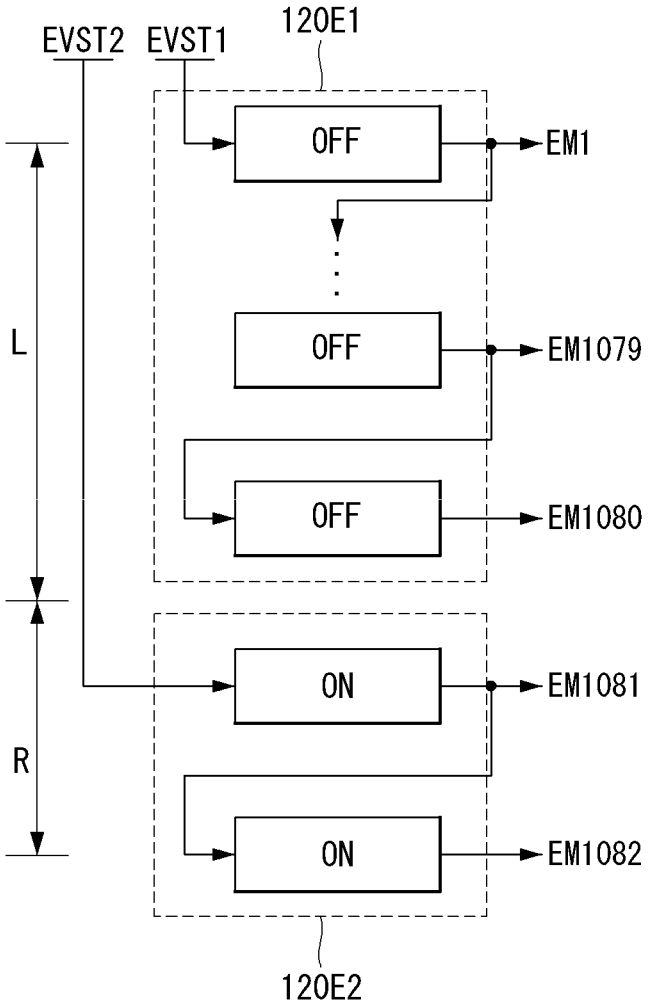

FIGS. 29A and 29B are diagrams illustrating input signals and on/off states of the first and second shift registers of the gate driver 120 when the first screen L is activated and the second screen R is deactivated, and thus only the first screen L is driven. FIGS. 30A and 30B are diagrams illustrating the input signals and the on/off states of the first and second shift registers of the gate driver 120 when the first screen L is deactivated and the second screen R is activated, and thus only the second screen R is driven.

Referring to FIGS. 29A and 30A, the first shift register 120G receives the first and second gate start pulses GVST1 and GVST2 for scanning and a gate shift clock.

The first shift register 120G includes a first-first shift register 120G1 which receives the first gate start pulse GVST1 for scanning and supplies scan signals to the pixels of the first screen L, and a first-second shift register 120G2 which receives the second gate start pulse GVST2 for scanning and supplies the scan signals to the pixels of the second screen R.

When the first screen L is activated to display the input image, the first gate start pulse GVST1 for scanning is input to a first stage of the first-first shift register 120G1. In this case, as shown in FIG. 29A, stages which are connected in cascade in the first-first shift register 120G1 operate as ON stages and output normal scan signals SCAN1 to SCAN1080. The first-first shift register 120G1 receives the first gate start pulse GVST1 for scanning, starts to output the scan signal, and shifts the scan signal according to the gate shift clock timing to sequentially supply the scan signals SCAN1 to SCAN1080, which are synchronized with the data voltages Vdata of the pixel data, to all the pixels of the first screen L in a pixel line unit. When the first screen L is activated, the drive IC 300 supplies the data voltages Vdata of the pixel data to the data lines DL1 to DL6 through the data output channels. The scan signals SCAN1 to SCAN1080 are synchronized with the data voltages Vdata.

When the first screen L is deactivated to display a black screen, the first gate start pulse GVST1 for scanning is not generated and a DC voltage of the gate off voltage VGH is applied to a start signal input node of the first stage of the first-first shift register 120G1. In this case, as shown in FIG. 30A, the stages of the first-first shift register 120G1 operate as OFF stages to output the gate off voltage VGH instead of outputting the normal scan signals. When the first screen L is deactivated, the drive IC 300 does not output the data voltages Vdata during a scan interval of the first screen L.

When the second screen R is activated to display the input image, the second gate start pulse GVST2 for scanning is input to a first stage of the first-second shift register 120G2. In this case, as shown in FIG. 30A, stages which are connected in cascade in the first-second shift register 120G2 operate as ON stages to output normal scan signals. The first-second shift register 120G2 receives the second gate start pulse GVST2 for scanning, starts to output the scan signal, and shifts the scan signal according to the gate shift clock timing to sequentially supply the scan signals SCAN1081 to SCAN2160, which are synchronized with the data voltages Vdata of the pixel data, to all the pixels of the second screen R in a pixel line unit. When the second screen R is activated, the drive IC 300 supplies the data voltages Vdata of the pixel data to the data lines DL1 to DL6 through the data output channels. The scan signals SCAN1081 to SCAN2160 are synchronized with the data voltages Vdata.

When the second screen R is deactivated to display a black screen, the second gate start pulse GVST2 for scanning is not generated and the DC voltage of the gate off voltage VGH is applied to a start signal input terminal of the first stage of the first-second shift register 120G2. In this case, as shown in FIG. 29A, the stages of the first-second shift register 120G2 operate as OFF stages to output the gate off voltage VGH instead of outputting the normal scan signals. When the second screen R is deactivated, the drive IC 300 does not output the data voltages Vdata during a scan interval of the second screen R.

Referring to FIGS. 29B and 30B, the second shift register 120E receives first and second gate start pulses EVST1 and EVST2 for EM and a gate shift clock.

The second shift register 120E includes the second-first shift register 120E1, which receives the first gate start pulse EVST1 for EM and supplies EM signals to the pixels of the first screen L, and the second-second shift register 120E2 which receives the second gate start pulse EVST2 for EM and supplies EM signals to the pixels of the second screen R.

When the first screen L is activated to display the input image, the first gate start pulse EVST1 for EM is input to a first stage of the second-first shift register 120E1. In this case, as shown in FIG. 29B, stages which are connected in cascade in the second-first shift register 120E1 operate as ON stages and output normal EM signals EM1 to EM1080. The second-first shift register 120E1 receives the first gate start pulse EVST1 for EM, starts to output the EM signal, and shifts the EM signal according to the gate shift clock timing to sequentially supply the EM signals EM1 to EM1080 to all the pixels of the first screen L in a pixel line unit.

When the first screen L is deactivated to display a black screen, the first gate start pulse EVST1 for EM is not generated and a DC voltage of the gate off voltage VGH is applied to a start signal input terminal of the first stage of the second-first shift register 120E1. In this case, as shown in FIG. 30B, the stages of the second-first shift register 120E1 operate as OFF stages to output the gate off voltage VGH instead of outputting the normal EM signals. When the first screen L is deactivated, the drive IC 300 does not output the data voltages Vdata.

When the second screen R is activated to display the input image, the second gate start pulse EVST2 for EM is input to the first stage of the second-second shift register 120E2. In this case, as shown in FIG. 30B, stages which are connected in cascade in the second-second shift register 120E2 operate as ON stages and output normal EM signals EM1081 to EM2160. The second-second shift register 120E2 receives the second gate start pulse EVST2 for EM, starts to output the EM signal, and shifts the EM signal according to the gate shift clock timing to sequentially supply the EM signals EM1081 to EM2160 to all the pixels of the second screen R in a pixel line unit.

When the second screen R is deactivated to display a black screen, the second gate start pulse EVST2 for EM is not generated and the DC voltage of the gate off voltage VGH is applied to a start signal input terminal of the first stage of the second-second shift register 120E2. In this case, as shown in FIG. 29B, the stages of the second-second shift register 120E2 operate as OFF stages to output the gate off voltage VGH instead of outputting the normal EM signals. When the second screen R is deactivated, the drive IC 300 does not output the data voltages Vdata during a scan interval of the second screen R.

Figure 31A:
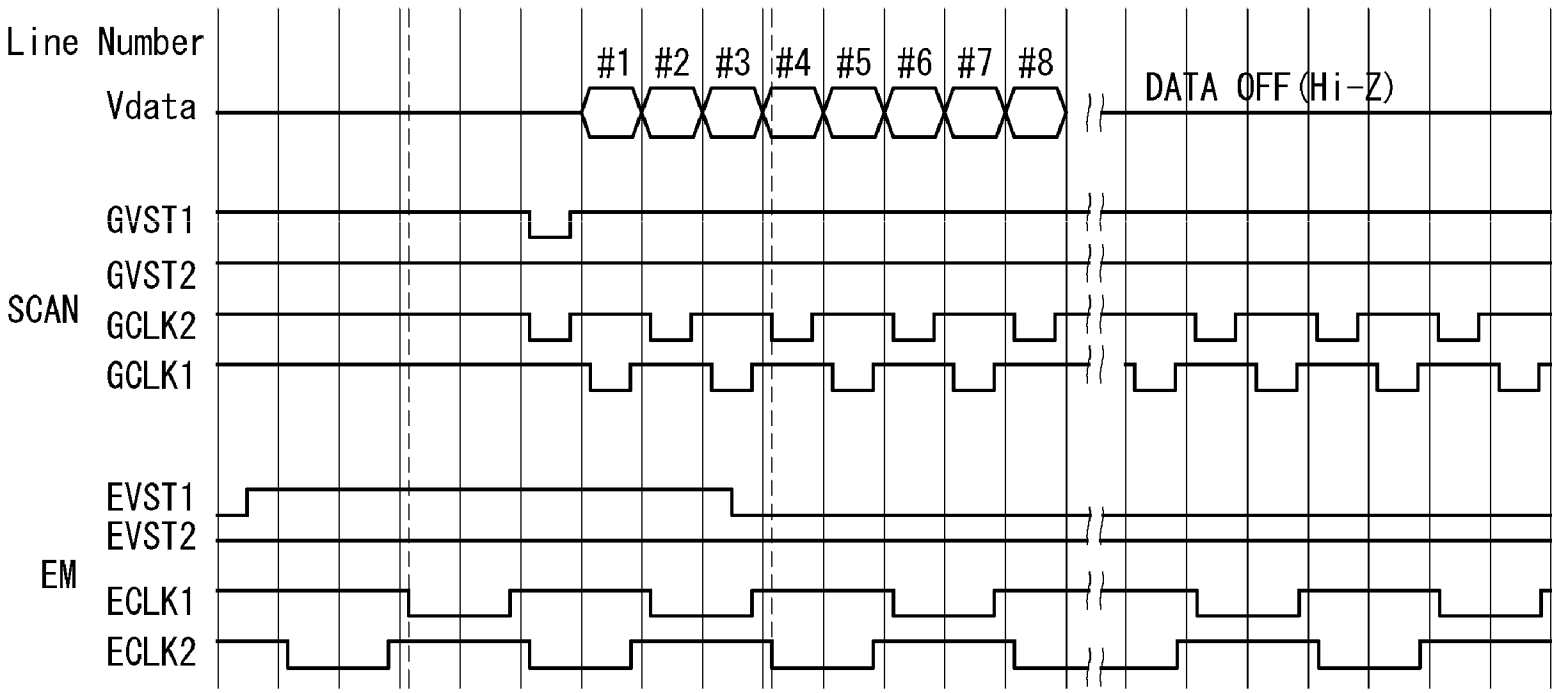
FIGS. 31A and 31B are waveform diagrams showing data signals and gate start pulses when only one of first and second screens is activated.
Figure 31B:
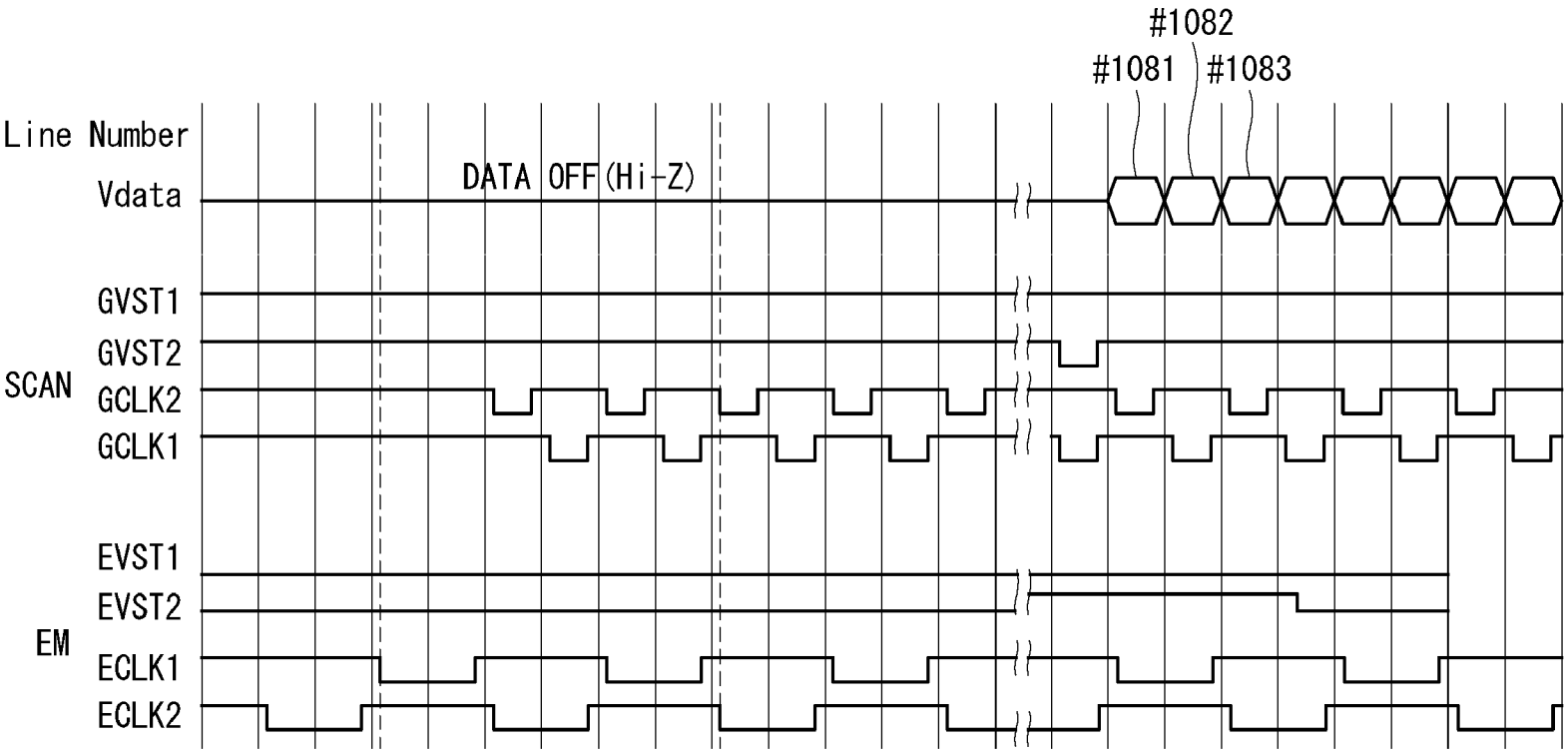

FIGS. 31A and 31B are waveform diagrams showing data signals and gate start pulses when only one of first and second screens is activated. In FIGS. 31A and 31B, GCLK1 and GCLK2 represent gate shift clocks input to the first shift register 120G. GCLK1 and GCLK2 represent gate shift clocks input to the second shift register 120E.

Referring to FIG. 31A, when only the first screen L is activated to display an input image, the first gate start pulse GVST1 for scanning of the gate on voltage VGL is generated. In this case, the second gate start pulse GVST2 for scanning is not generated.

The first gate start pulse GVST1 for scanning is input to the first stage of the first-first shift register 120G1. In this case, as shown in FIG. 29A, stages which are connected in cascade in the first-first shift register 120G1 operate as ON stages and output normal scan signals SCAN1 to SCAN1080.

The first-first shift register 120G1 shifts the first gate start pulse GVST1 for scanning at timings of the gate shift clocks GCLK1 and GCLK2 and sequentially outputs the scan signals SCAN1 to SCAN1080 to the first screen L. Since the second start pulse GVST2 for scanning is not input, the first-second shift register 120G2 does not generate an output.

When only the first screen L is activated to display the input image, the first gate start pulse EVST1 for EM of the gate off voltage VGH is generated. In this case, the second gate start pulse EVST2 for EM is not generated.

The first gate start pulse EVST1 for EM is input to the first stage of the second-first shift register 120E1. As shown in FIG. 29B, the stages which are connected in cascade in the second-first shift register 120E1 operate as ON stages to output the normal EM signals EM1 to EM1080. The second-first shift register 120E1 receives the first gate start pulse EVST1 for EM, starts to output the EM signal, and shifts the EM signal according to timings of the gate shift clocks ECLK1 and ECLK2 to sequentially supply the EM signals EM1 to EM1080 to the first screen L. Since the second start pulse EVST2 for EM is not input, the second-second shift register 120E2 does not generate an output.

Referring to FIG. 31B, when only the second screen R is activated to display the input image, the second gate start pulse GVST2 for scanning of the gate on voltage VGL is generated. In this case, the first gate start pulse GVST1 for scanning is not generated.

The second gate start pulse GVST2 for scanning is input to the first stage of the first-second shift register 120G2. In this case, as shown in FIG. 30A, the stages which are connected in cascade in the first-second shift register 120G2 operate as ON stages to output the normal scan signals SCAN1081 to SCAN2160.

The first-second shift register 120G2 shifts the second gate start pulse GVST2 for scanning at timings of the gate shift clocks GCLK1 and GCLK2 and sequentially outputs the scan signals SCAN1081 to SCAN2160 to the second screen R. Since the first gate start pulse GVST1 for scanning is not input, the first-first shift register 120G1 does not generate an output.

When only the second screen R is activated to display the input image, the second gate start pulse EVST2 for EM of the gate off voltage VGH is generated. In this case, the first gate start pulse EVST1 for EM is not generated.

The second gate start pulse EVST2 for EM is input to the first stage of the second-second shift register 120E2. As shown in FIG. 30B, the stages which are connected in cascade in the second-second shift register 120E2 operate as ON stages to output the normal EM signals EM1081 to EM2160. The second-second shift register 120E2 receives the second gate start pulse EVST2 for EM, starts to output the EM signal, and shifts the EM signal according to the timings of the gate shift clocks ECLK1 and ECLK2 to sequentially supply the EM signals EM1081 to EM2160 to the second screen R. Since the first start pulse EVST1 for EM is not input, the second-first shift register 120E1 does not generate an output.

Figure 32:
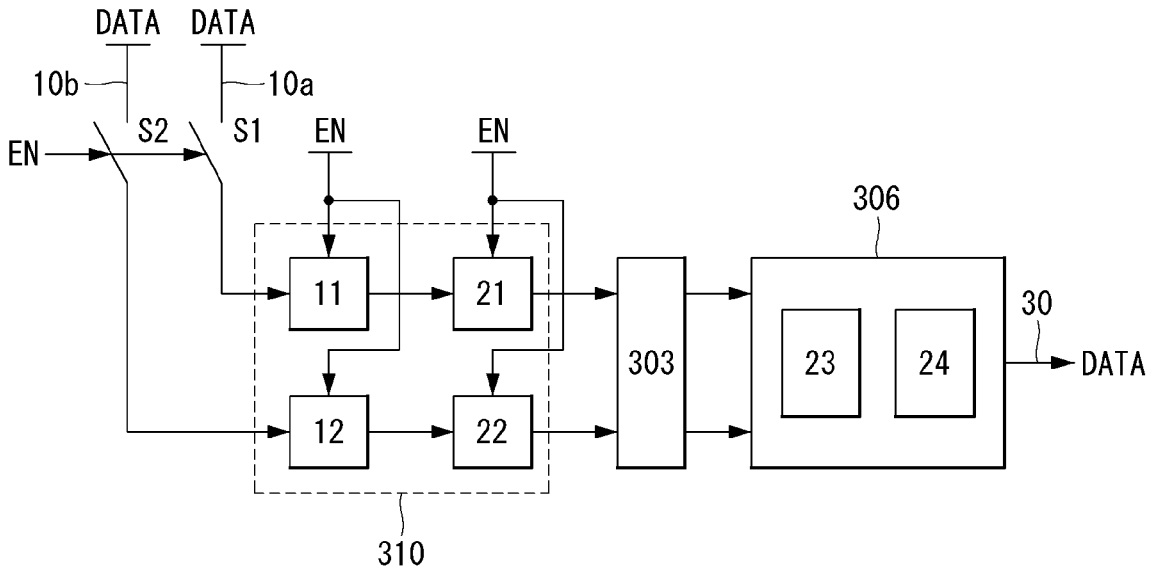
FIGS. 32 and 33 are detailed block diagrams illustrating a data receiving and calculating part.
Figure 33:
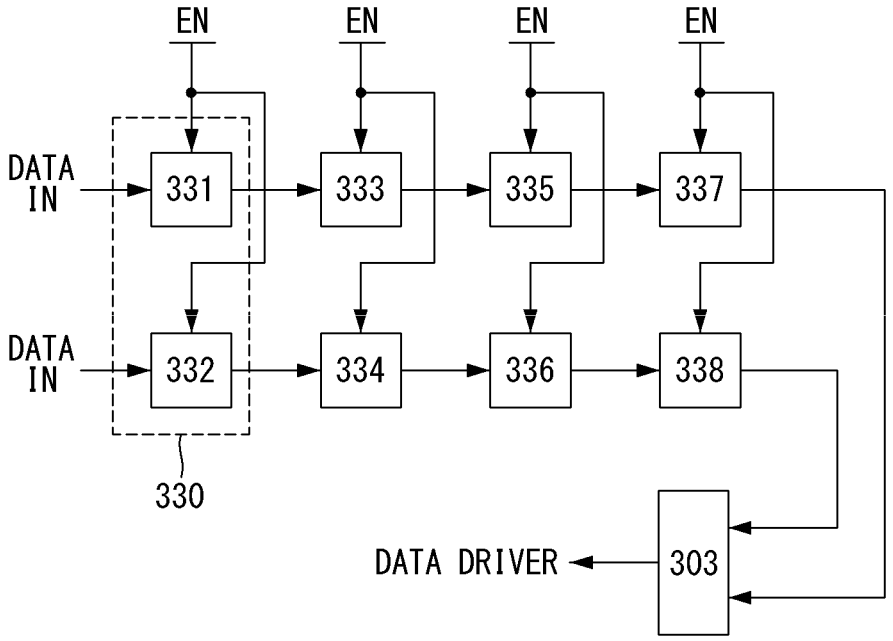

FIGS. 32 and 33 are detailed block diagrams illustrating the data receiving and calculating part 310.

Referring to FIGS. 32 and 33, the data receiving and calculating part 310 includes data receivers 11 and 12, and digital processors 21 and 22.

The data receivers 11 and 12 include a first data receiver 11 and a second data receiver 12 which are selectively enabled under the control of the host system 200. The digital processors 21 and 22 include a first digital processor 21 and a second digital processor 22 which are selectively enabled under the control of the host system 200.

The host system 200 selectively enables the first and second data receivers 11 and 12 and the first and second digital processors 21 and 22 according to a folded state or an unfolded state of the flexible display panel 100. The enable signal EN includes an identification code for distinguishing the first and second data receivers 11 and 12 and the first and second digital processors 21 and 22, and a control code for indicating an ON/OFF.

The first data receiver 11 is connected to a first data input channel 10*a*. The first data input channel 10*a* includes a first switching element S1. When the enable signal EN includes an identification code indicating the first switching element S1 and a control code indicating a turn-on of the first switching element S1, the first switching element S1 is turned on according to the enable signal EN to receive a first data signal and provide the first data signal to the first digital processor 21. The first data signal may include pixel data which is to be written in the pixels of the first screen L.

The second data receiver 12 is connected to a second data input channel 10*b*. The second data input channel 10*b* includes a second switching element S2. When the enable signal EN includes an identification code indicating the second switching element S2 and a control code indicating a turn-on of the second switching element S2, the second switching element S2 is turned on according to the enable signal EN to receive a second data signal and provide the second data signal to the second digital processor 22. The second data signal may include pixel data which is to be written in the pixels of the second screen R.

Pixel data which is to be written in the pixels of the folding boundary A may be received by any one of the first and second data receivers 11 and 12 through any one of the first and second data input channels 10*a* and 10*b*. Alternatively, the pixel data which is to be written in the pixels of the folding boundary A may be received by the first and second data receivers 11 and 12 by being distributed to the first and second data input channels 10*a* and 10*b*.

Each of the first and second data receivers 11 and 12 may be an MIPI data receiver.

When all the screens L, A, and R are activated in an unfolded state, the first and second switching elements S1 and S2 are turned on, and the first and second data receivers 11 and 12 are turned on.

When only the first screen L is activated, the first switching element S1 is turned on in response to the enable signal EN and the first data receiver 11 is enabled. Meanwhile, the second switching element S2 is turned off, and the second data receiver 12 is disabled. Thus, when only the first screen L is driven, only half of the first and second data receivers 11 and 12 are driven so that power consumption is reduced.

When only the second screen R is activated, the second switching element S2 is turned on in response to the enable signal EN and the second data receiver 12 is enabled. Meanwhile, the first switching element S1 is turned off, and the first data receiver 11 is disabled.

The first digital processor 21 includes a first memory 331, a first restoration part 333, a first algorithm application part 335, and a first optical compensator 337. When an enable signal EN includes an identification code indicating the first digital processor 21 and a control code indicating enabling of the first digital processor 21, the first digital processor 21 is enabled to process pixel data received from the first data receiver 11. Each of the first memory 331, the first restoration part 333, the first algorithm application part 335, and the first optical compensator 337 may be selectively enabled in response to the enable signal EN.

The second digital processor 22 includes a second memory 332, a second restoration part 334, a second algorithm application part 336, and a second optical compensator 338. When the enable signal EN includes an identification code indicating the second digital processor 22 and a control code indicating enabling of the second digital processor 22, the second digital processor 22 is enabled to process pixel data received from the second data receiver 12. Each of the second memory 332, the second restoration part 334, the second algorithm application part 336, and the second optical compensator 338 may be selectively enabled in response to the enable signal EN.

The frame memory 330 may be divided into the first and second memories 331 and 332.

The first memory 331 temporarily stores the pixel data which is to be written in the pixels of the first screen L and supplies the pixel data to the first restoration part 333. The second memory 332 temporarily stores the pixel data which is to be written in the pixels of the second screen R and supplies the pixel data to the second restoration part 334. Pixel data which is to be written in the pixels of the folding boundary A may be stored in either the first memory 331 or the second memory 332. Alternatively, the pixel data which is to be written in the pixels of the folding boundary A may be distributed and stored in the first memory 331 and the second memory 332.

The host system 200 may compress the pixel data and transmit the compressed data to the drive IC 300. The first restoration part 333 restores the compressed data input from the first memory 331 and supplies the restored data to the first algorithm application part 335. The first algorithm application part 335 calculates the pixel data input from the first restoration part 333 by applying a predetermined image quality enhancement algorithm and transmits the calculated pixel data to the first optical compensator 337. The image quality enhancement algorithm may be implemented of various image quality algorithms such as color temperature compensation and temperature compensation. The first optical compensator 337 applies a predetermined optical compensation value to the pixel data modulated by the first algorithm application part 335 to equalize image quality displayed on the screen.

The second restoration part 334 restores the compressed data input from the second memory 332 and supplies the restored data to the second algorithm application part 336. The second algorithm application part 336 calculates the pixel data input from the second restoration part 334 by applying a predetermined image quality enhancement algorithm and transmits the calculated pixel data to the second optical compensator 338. The image quality enhancement algorithm may be implemented of various image quality algorithms such as color temperature compensation and temperature compensation. The second optical compensator 338 applies a predetermined optical compensation value to the pixel data modulated by the second algorithm application part 336 to equalize image quality displayed on the screen.

When all the screens L, A, and R are activated in the unfolded state, the first and second digital processors 21 and 22 are enabled to process the pixel data and supply the processed pixel data to the data driver 306.

The data driver 306 samples the input pixel data and supplies the data voltage Vdata to the data line of the flexible display panel 100 through a DAC 23 and an output buffer 24. Each of data output channels 30 of the data driver 306 includes the DAC 23 and the output buffer 24.

When only the first screen L is activated, the first digital processor 21 is enabled in response to the enable signal EN. Meanwhile, when only the first screen L is activated, the second digital processor 22 is disabled. Thus, when only the first screen L is driven, only half of the first and second digital processors 21 and 22 are driven so that power consumption is reduced. The memories 331 and 332, the restoration parts 333 and 334, the algorithm application parts 335 and 336, and the optical compensators 337 and 338 may be driven only by half.

When only the second screen R is activated, the second digital processor 22 is enabled in response to the enable signal EN. Meanwhile, when only the second screen R is activated, the first digital processor 21 is disabled.

Figure 34:
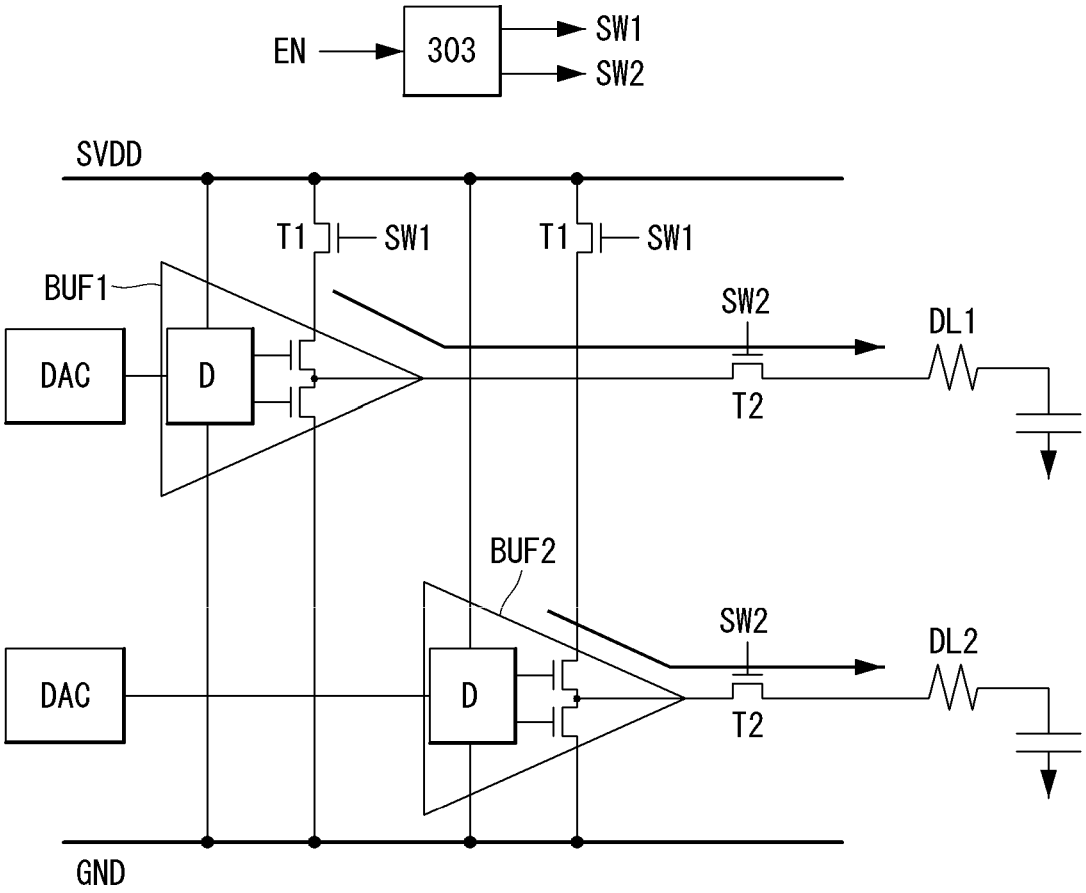
FIGS. 34 and 35 are circuit diagrams illustrating an output buffer switching circuit of a data driver.
Figure 35:
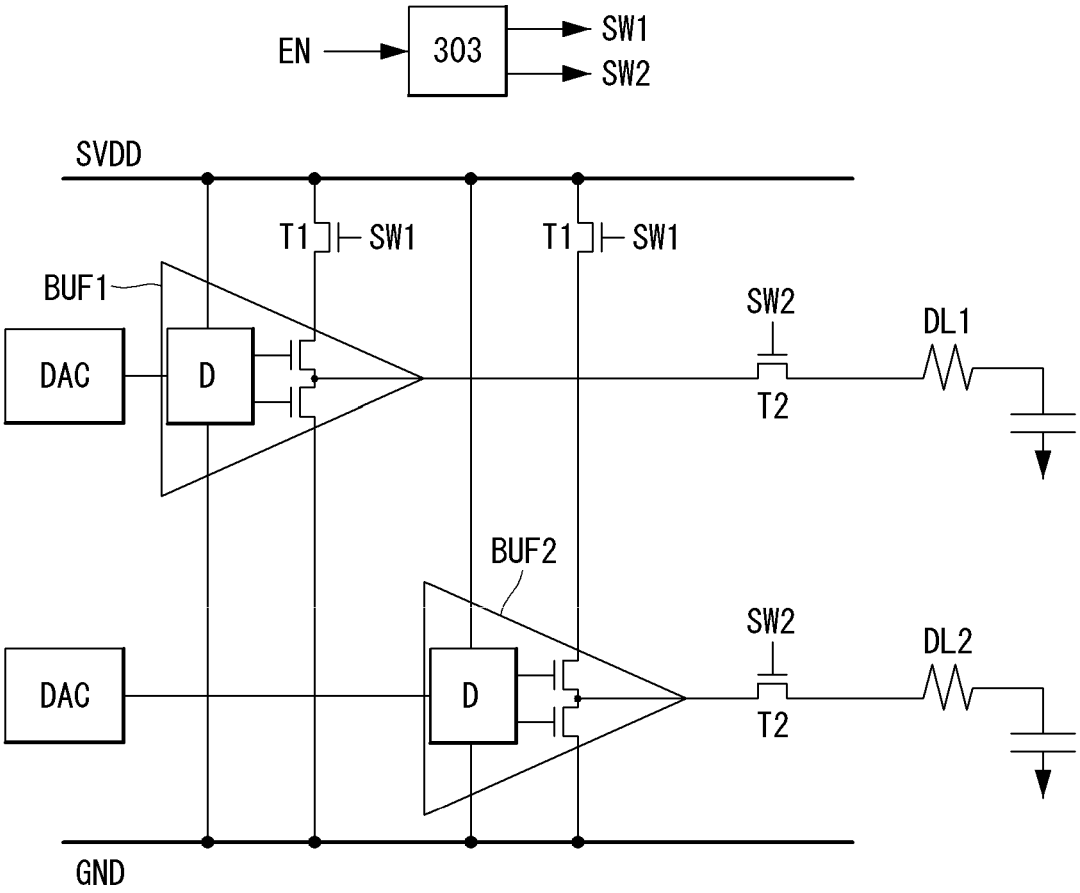

As shown in FIGS. 34 and 35, in order to further reduce power consumption of the foldable display, the present disclosure may turn the output buffer 24 on or off at each of the data output channels using an output buffer switching circuit.

Referring to FIGS. 34 and 35, each of the data output channels 30 of the data driver 306 includes first switching elements T1 connected to power lines of output buffers BUF1 and BUF2, and second switching elements T2 connected between the output buffers BUF1 and BUF2 and the data lines DL1 and DL2.

The output buffers BUF1 and BUF2 transmit input voltages D from DACs to the data lines DL1 and DL2 without loss. To this end, each of the output buffers BUF1 and BUF2 includes a pull-up transistor and a pull-down transistor in which the input voltage D is applied to gates thereof. The pull-up transistors are turned on according to high potential voltages of the input voltages D to charge the data lines DL1 and DL2 with a high potential driving voltage SVDD. The pull-down transistors are turned on according to low potential voltages of the input voltages D to supply a ground voltage GND to the data lines DL1 and DL2 to discharge the data lines DL1 and DL2.

The timing controller 303 receives the enable signal EN to generate switch control signals SW1 and SW2, thereby controlling ON/OFF timings of the switching elements T1 and T2.

The first switching elements T1 are connected between a power supply line to which the high potential driving voltage SVDD is applied and power input nodes of the output buffers BUF1 and BUF2. The first switching elements T1 are turned on according to a first logic value of the first switching control signal SW1 in an activated data output channel. Simultaneously, the second switching elements T2 are turned on according to a first logic value of the second switching control signal SW2 in an activated data output channel. As shown in FIG. 34, when the first and second switching elements T1 and T2 are turned on, the output buffers BUF1 and BUF2 are driven so that the data voltages Vdata are supplied to the data lines DL1 and DL2.

When the high potential driving voltage SVDD is not applied to the output buffers BUF1 and BUF2, since the output buffers BUF1 and BUF2 are not driven, the data voltages Vdata are not output at the data output channels.

The first switching elements T1 are turned off according to a second logic value of the first switching control signal SW1 in a deactivated data output channel. Simultaneously, the second switching elements T2 are turned off according to a second logic value of the second switching control signal SW2 in a deactivated data output channel. As shown in FIG. 35, when the first and second switching elements T1 and T2 are turned off, since the output buffers BUF1 and BUF2 are not driven and the data output channel is blocked between the output buffers BUF1 and BUF2 and the data lines DL1 and DL2, the data voltages Vdata cannot be supplied to the data lines DL1 and DL2. In this case, the data output channels 30 become a high impedance state.

When the first screen L is activated and the second screen R is deactivated among the first and second screens L and R, the data output channels 30 of the drive IC 300 may be activated during a scan interval of the first screen L. During a scan interval of the second screen R, the data output channels 30 of the drive IC 300 may be deactivated.

Figure 36:
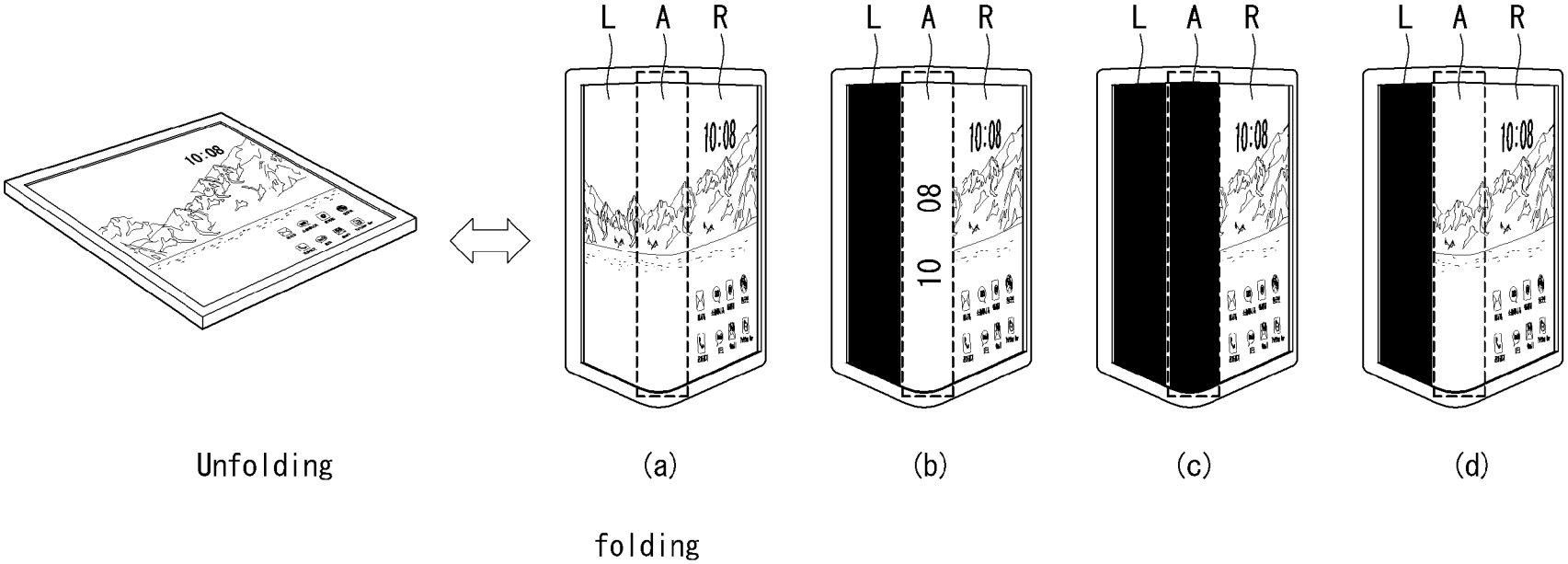
FIG. 36 is a diagram illustrating an example of variable resolution of an activated screen when folded and unfolded.

FIG. 36 is a diagram illustrating an example of variable resolution of an activated screen when folded and unfolded.

Referring to FIG. 36, the foldable display of the present disclosure may display an input image on all the screens L, A, and R in an unfolded state. In the foldable display, a size and resolution of a screen activated in folded states (a) to (d) may be varied in a variety of ways.

In the folded state (a), all the screens L, A, and R are activated so that the input image may be displayed at a maximum screen size and maximum resolution. In the folded states (b) and (d), either the first screen L and the second screen R and the folding boundary A are activated to display the input image on the reduced screen.

As shown in the folded state (b), information irrelevant to the input image, for example, time information, a battery power level, transmission and reception sensitivity, a received message content, and the like may be displayed on the folding boundary A as shown in FIG. 36(*b*). In the folded state (c), the folding boundary A may be controlled as a deactivated screen displaying a black screen. In the unfolded state (e), all the screens L, A, and R are activated so that the input image may be displayed at a maximum screen size (i.e., full portion of the flexible display panel 100) and maximum resolution as shown in FIG. 36(*e*).

FIGS. 37 to 40 are diagrams illustrating data signals DATA and gate start pulses VST according to the activated screen shown in FIG. 36. The gate start pulse VST may be divided into a gate start pulse GVST for scanning and a gate start pulse for EM.

Figure 37:
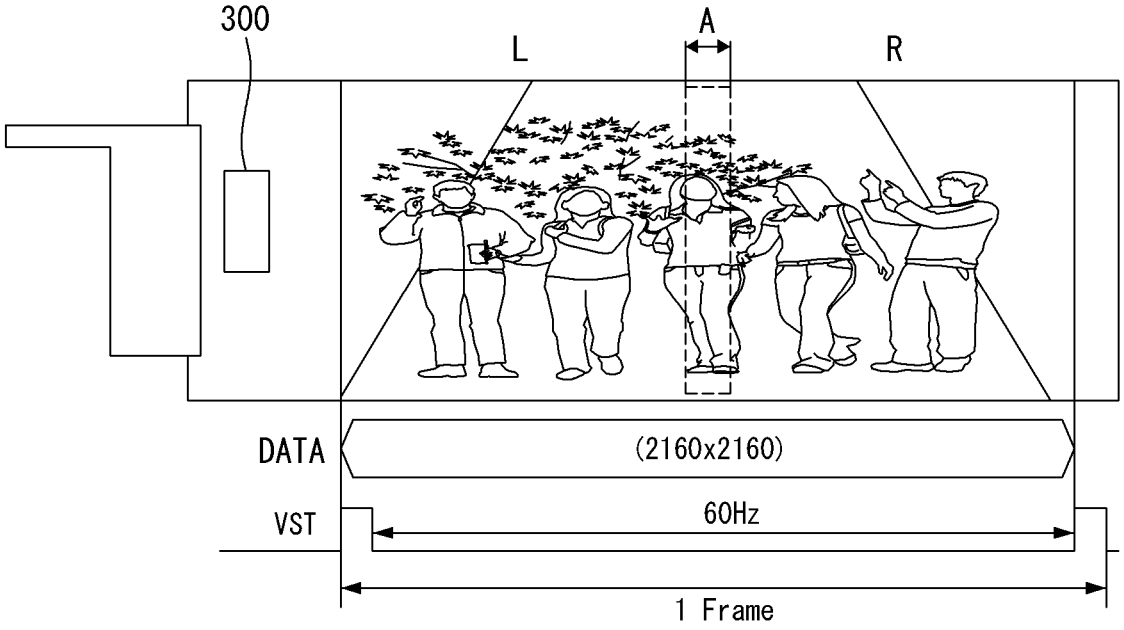
FIGS. 37 to 40 are diagrams illustrating data signals and gate start pulses according to the activated screen shown in FIG. 36.
Figure 38:
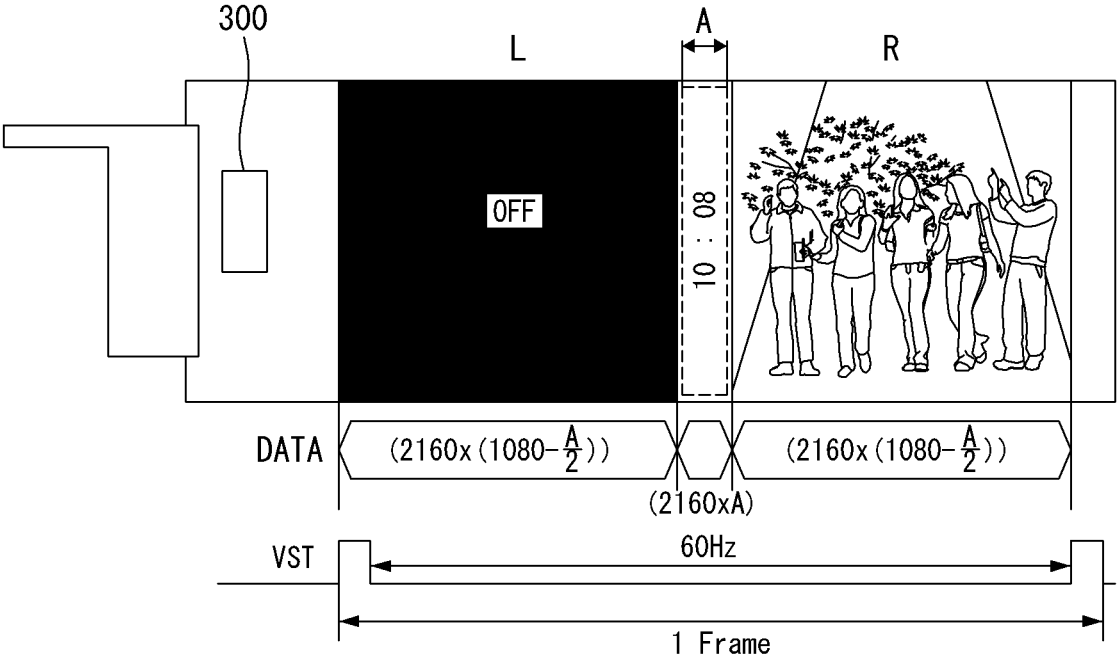
Figure 39:
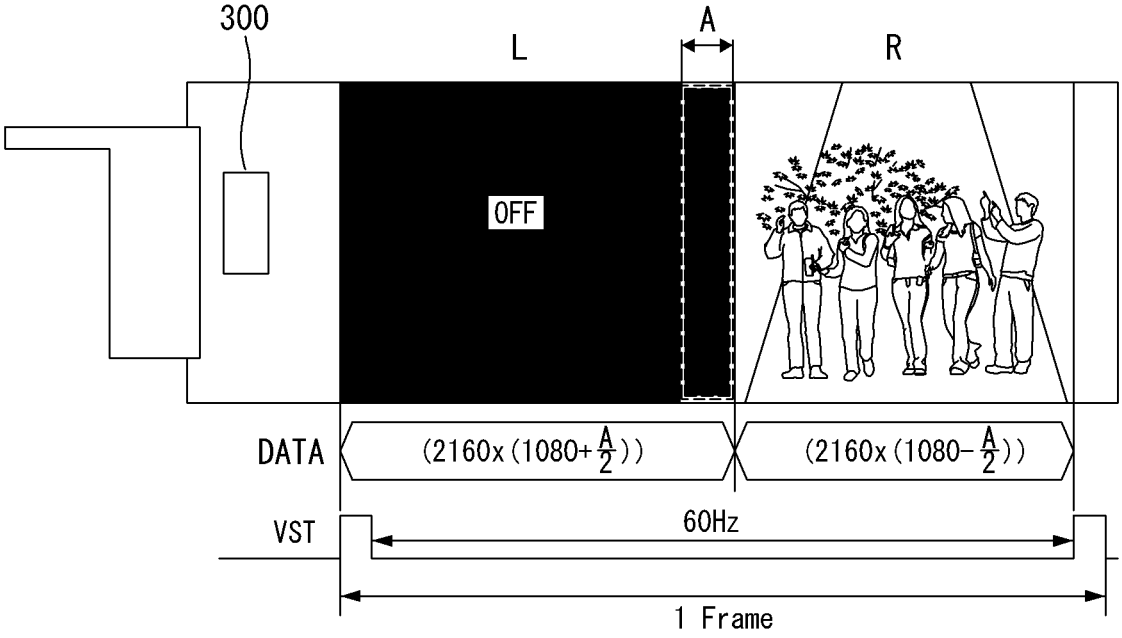

FIG. 37 illustrates an example in which all the screens L, A, and R are activated. FIG. 38 illustrates an example in which the first screen L is deactivated to display a black screen, and the folding boundary A and the second screen R are activated. Time information may be displayed on the folding boundary A. In FIG. 38, a resolution of each of the first and second screens L and R is reduced by as much as half of a width of the folding boundary A in the Y-axis direction, and the resolution of each of the first and second screens L and R is 2160*(1080−(A/2)). FIG. 39 illustrates an example in which the first screen L and the folding boundary A are deactivated and the second screen R is activated. In FIG. 39, a resolution obtained by combining the first screen L and the folding boundary A is 2160*(1080+(A/2)). In FIG. 39, a resolution of the second screen R is 2160*(1080−(A/2)).

Figure 40:
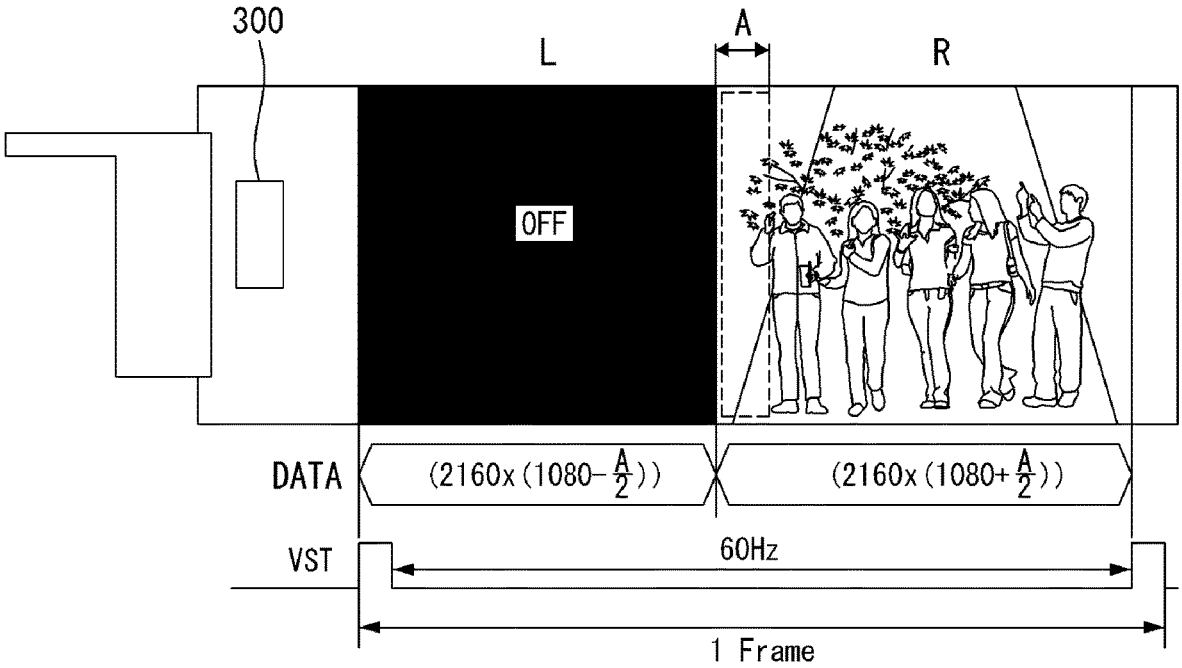

FIG. 40 illustrates an example in which the folding boundary A and the second screen R are activated and the first screen L is deactivated. In FIG. 40, a resolution obtained by combining the folding boundary A and the second screen R is 2160*(1080+(A/2)). In FIG. 40, a resolution of each of the first and second screens L and R is 2160*(1080−(A/2)).

Figure 41:
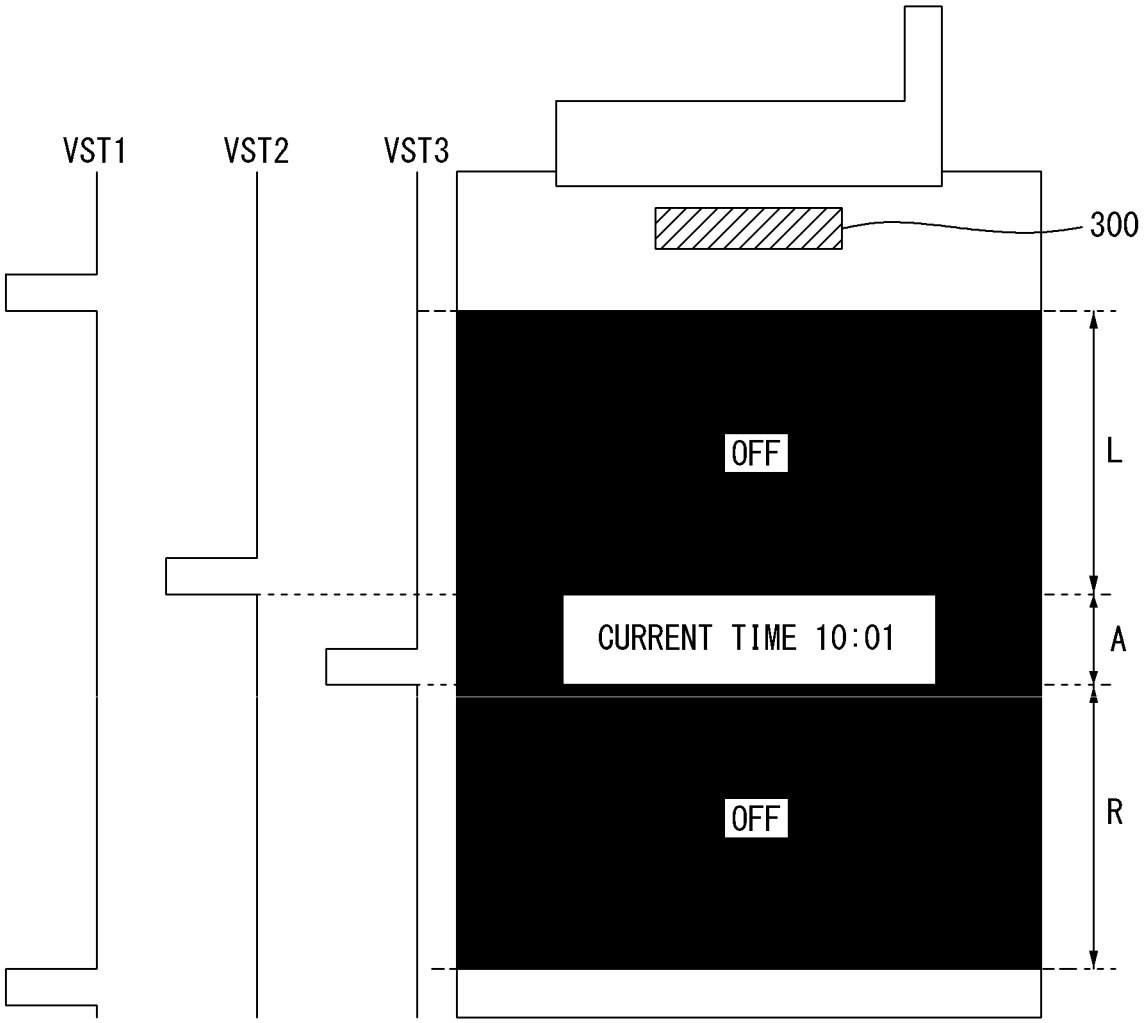
FIG. 41 is a diagram illustrating first to third gate start pulses for independently driving a first screen, a folding boundary, and a second screen.

FIG. 41 is a diagram illustrating first to third gate start pulses VST1, VST2, and VST3 for independently driving the first screen L, the folding boundary A, and the second screen R. As shown in FIGS. 36 to 40, the foldable display of the present disclosure may control the screen in various manners when folded. To this end, as shown in FIG. 41, the timing controller 303 may control the gate driver 120 by generating the first gate start pulse VST1 controlling the gate signals SCAN and EM applied to the first screen L, the second gate start pulse VST2 controlling the gate signals SCAN and EM applied to the folding boundary A, and the third gate start pulse VST3 controlling the gate signals SCAN and EM applied to the second screen R.

As shown in FIG. 42, the first to third gate start pulses VST1, VST2, and VST3 may be divided into gate start pulses GVST1, GVST2, and GVST3 for scanning, and gate start pulses EVST1, EVST2, and EVST3 for EM.

Figure 42A:
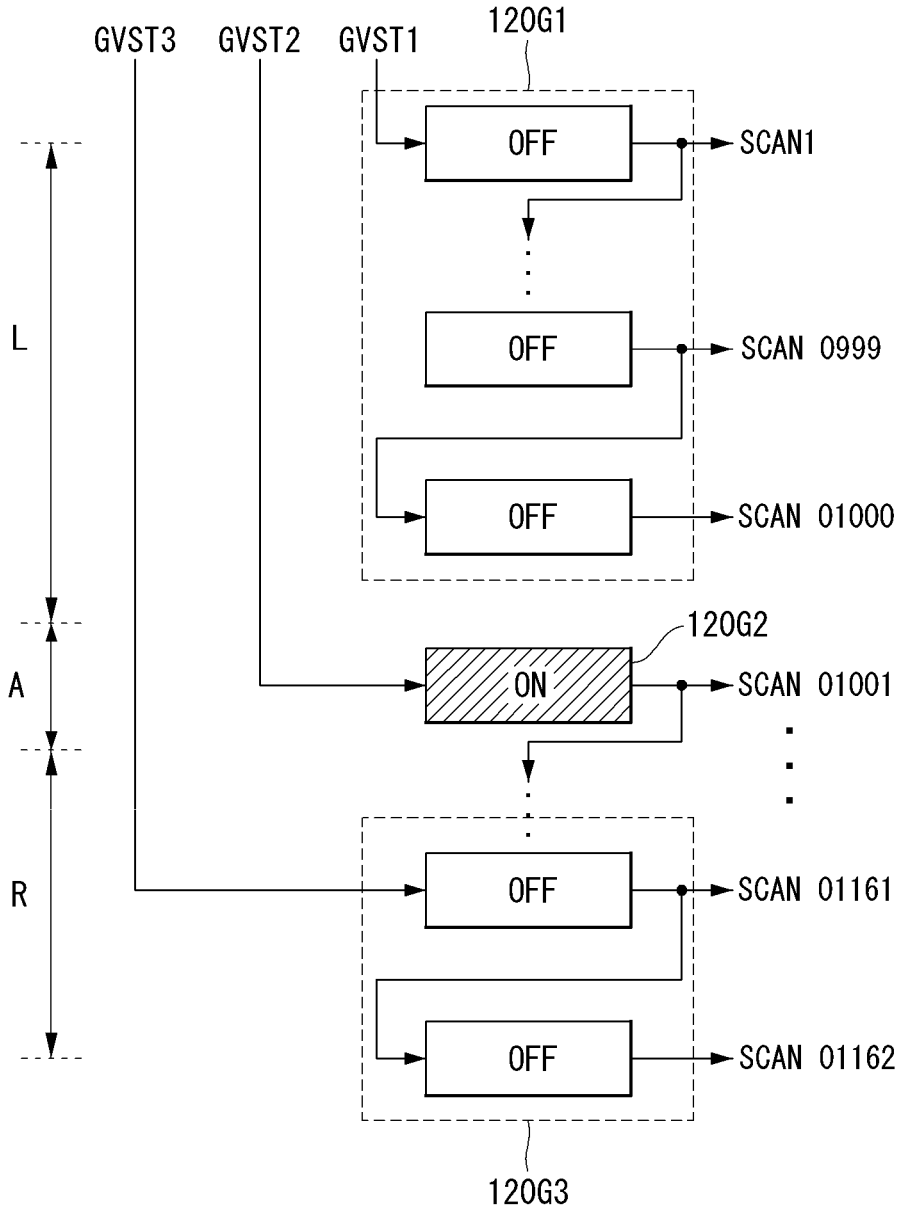
FIGS. 42A and 42B are diagrams illustrating first and second shift registers to which the first to third gate start pulses are input.

Referring to FIG. 42A, the first shift register 120G receives first to third gate start pulses GVST1, GVST2, and GVST3 for scanning and a gate shift clock.

The first shift register 120G includes a first-first shift register 120G1 which receives the first gate start pulse GVST1 for scanning and supplies scan signals to the pixels of the first screen L, a first-second shift register 120G2 which receives the second gate start pulse GVST2 for scanning and supplies scan signals to the pixels of the folding boundary A, and a first-third shift register 120G3 which receives the third gate start pulse GVST3 for scanning and supplies scan signals to the pixels of the second screen R.

When the first screen L is activated to display the input image, the first gate start pulse GVST1 for scanning is input to a first stage of the first-first shift register 120G1. When the first screen L is activated, the drive IC 300 supplies the data voltages Vdata of the pixel data to the data lines DL1 to DL6 through the data output channels. The scan signals SCAN1 to SCAN1080 are synchronized with the data voltages Vdata.

When the first screen L is deactivated to display a black screen, the first gate start pulse GVST1 for scanning is not generated and a DC voltage of the gate off voltage VGH is applied to a start signal input terminal of the first stage of the first-first shift register 120G1. In this case, as shown in FIG. 42A, the stages of the first-first shift register 120G1 operate as OFF stages to output the gate off voltage VGH instead of outputting the normal scan signals. When the first screen L is deactivated, the drive IC 300 does not output the data voltages Vdata during a scan interval of the first screen L.

When the folding boundary A is activated to display the input image or separate information, the second gate start pulse GVST2 for scanning is input to a first stage of the first-second shift register 120G2. In this case, as shown in FIG. 42A, the stages of the first-second shift register 120G2 operate as ON stages outputting scan signals. When the folding boundary A is activated, the drive IC 300 supplies data voltages Vdata of pixel data to the data lines DL1 to DL6 through the data output channels. The scan signal is synchronized with the data voltage Vdata. The separate information may be information irrelevant to the input image and selectable by a user, for example, time information, but the present disclosure is not limited thereto.

When the folding boundary A is deactivated to display a black screen, the second gate start pulse GVST2 for scanning is not generated and a DC voltage of the gate off voltage VGH is applied to a start signal input terminal of the first stage of the first-second shift register 120G2. In this case, the stages of the first-second shift register 120G2 operate as OFF stages to output the gate off voltage VGH instead of outputting normal scan signals. When the folding boundary A is deactivated, the drive IC 300 does not output the data voltages Vdata during a scan interval of the folding boundary A.

When the second screen R is activated to display the input image, the third gate start pulse GVST3 for scanning is input to a first stage of the first-third shift register 120G3. In this case, the stages which are connected in cascade in the first-third shift register 120G3 operate as ON stages to output normal scan signals. The first-third shift register 120G3 receives the third gate start pulse GVST3 for scanning, starts to output the scan signal, and shifts the scan signal according to the gate shift clock timing to sequentially supply scan signals SCAN1081 to SCAN2160, which are synchronized with the data voltages Vdata of the pixel data, to all the pixels of the second screen R in a pixel line unit. When the second screen R is activated, the drive IC 300 supplies the data voltages Vdata of the pixel data to the data lines DL1 to DL6 through the data output channels. The scan signal is synchronized with the data voltage Vdata.

When the second screen R is deactivated to display a black screen, the third gate start pulse GVST3 for scanning is not generated and the DC voltage of the gate off voltage VGH is applied to a start signal input terminal of the first stage of the first-third shift register 120G3. In this case, as shown in FIG. 42A, the stages of the first-third shift register 120G3 operate as OFF stages to output the gate off voltage VGH instead of outputting the normal scan signals. When the second screen R is deactivated, the drive IC 300 does not output the data voltages Vdata during a scan interval of the second screen R.

Figure 42B:
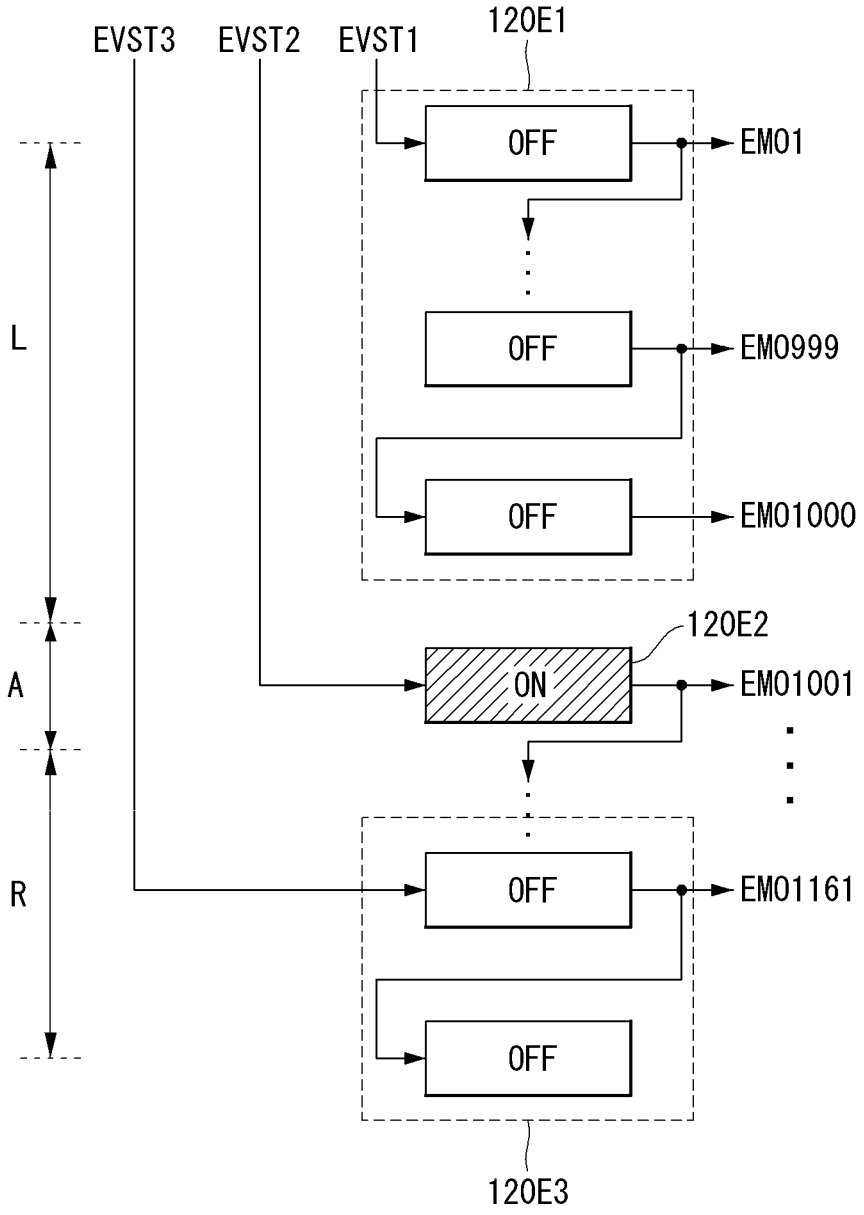

Referring to FIG. 42B, the second shift register 120E receives first to third gate start pulses EVST1, EVST2, and EVST3 for EM and a gate shift clock.

The second shift register 120E includes a second-first shift register 120E1 which receives the first gate start pulse EVST1 for EM and supplies EM signals to the pixels of the first screen L, a second-second shift register 120E2 which receives the second gate start pulse EVST2 for EM and supplies EM signals to the pixels of the folding boundary A, and a second-third shift register 120E3 which receives the third gate start pulse EVST3 for EM and supplies EM signals to the pixels of the second screen R.

When the first screen L is activated to display the input image, the first gate start pulse EVST1 for EM is input to a first stage of the second-first shift register 120E1. In this case, the stages which are connected in cascade in the second-first shift register 120E1 operate as ON stages to output normal EM signals. The second-first shift register 120E1 receives the first gate start pulse EVST1 for EM, starts to output the EM signal, and shifts the EM signal according to the gate shift clock timing to sequentially supply the EM signals to all the pixels of the first screen L in a pixel line unit.

When the first screen L is deactivated to display a black screen, the first gate start pulse EVST1 for EM is not generated and a DC voltage of the gate off voltage VGH is applied to a start signal input terminal of the first stage of the second-first shift register 120E1. In this case, as shown in FIG. 42B, the stages of the second-first shift register 120E1 operate as OFF stages to output the gate off voltage VGH instead of outputting the normal EM signals. When the first screen L is deactivated, the drive IC 300 does not output the data voltages Vdata.

When the folding boundary A is activated to display the input image, the second gate start pulse EVST2 for EM is input to the first stage of the second-second shift register 120E2. In this case, as shown in FIG. 42B, the stages which are connected in cascade in the second-second shift register 120E2 operate as ON stages to output the normal EM signals. The second-second shift register 120E2 receives the second gate start pulse EVST2 for EM, starts to output the EM signal, and shifts the EM signal according to the gate shift clock timing to sequentially supply the EM signals to all the pixels of the folding boundary A in a pixel line unit.

When the folding boundary A is deactivated to display a black screen, the second gate start pulse EVST2 for EM is not generated and a DC voltage of the gate off voltage VGH is applied to a start signal input terminal of the first stage of the second-second shift register 120E2. In this case, the stages of the second-second shift register 120E2 operate as OFF stages to output the gate off voltage VGH instead of outputting the normal EM signals. When the first screen L is deactivated, the drive IC 300 does not output the data voltages Vdata.

When the second screen R is activated to display the input image, the third gate start pulse EVST3 for EM is input to the first stage of the second-third shift register 120E3. In this case, the stages which are connected in cascade in the second-third shift register 120E3 operate as ON stages to output the normal EM signals. The second-third shift register 120E3 receives the third gate start pulse EVST3 for EM, starts to output the EM signal, and shifts the EM signal according to the gate shift clock timing to sequentially supply the EM signals to all the pixels of the second screen R in a pixel line unit.

When the second screen R is deactivated to display a black screen, the third gate start pulse EVST3 for EM is not generated and the DC voltage of the gate off voltage VGH is applied to a start signal input terminal of the first stage of the second-third shift register 120E3. In this case, as shown in FIG. 42B, the stages of the second-third shift register 120E3 operate as OFF stages to output the gate off voltage VGH instead of outputting the normal EM signals. When the second screen R is deactivated, the drive IC 300 does not output the data voltages Vdata during a scan interval of the second screen R.

Figure 43:
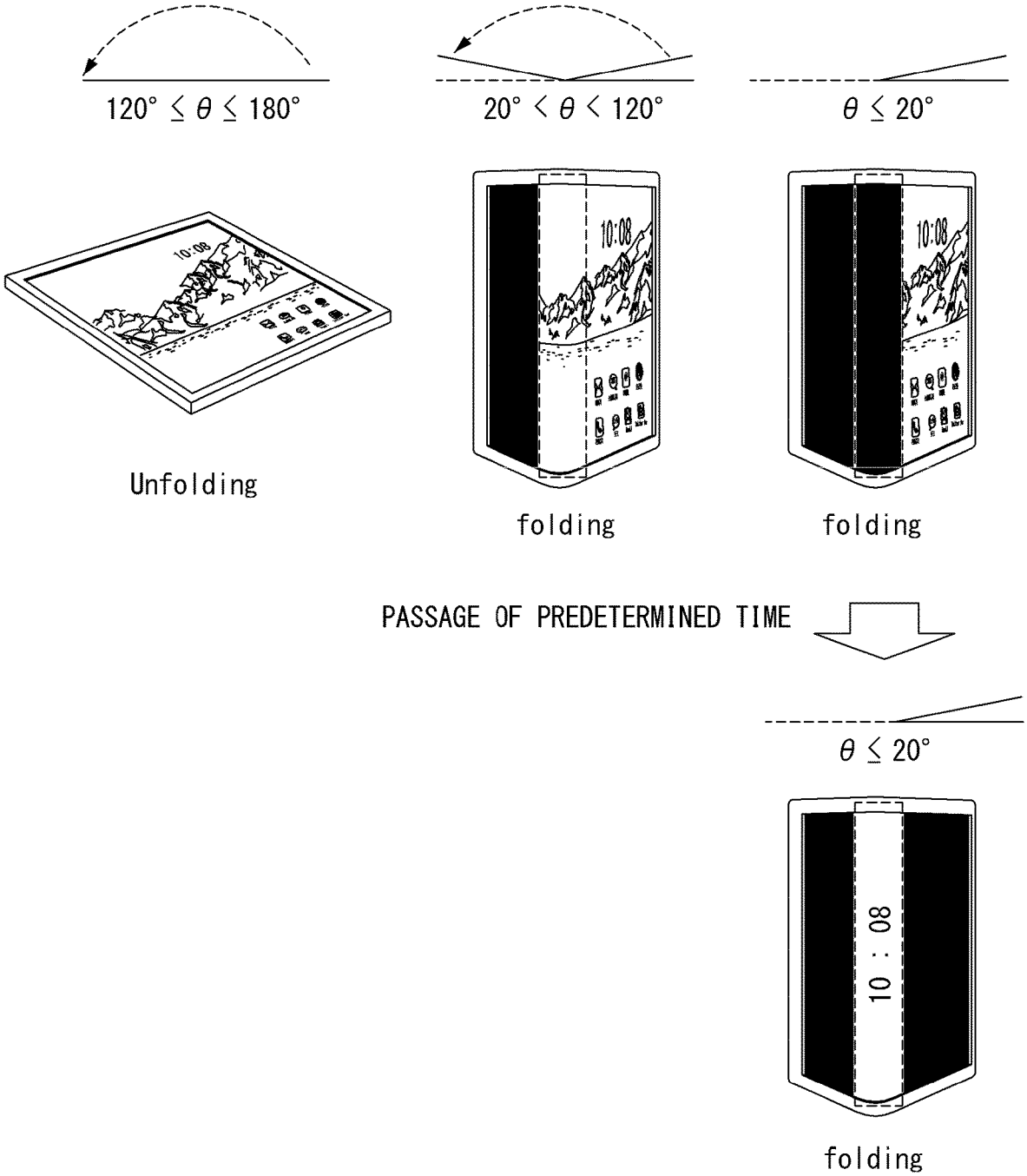
FIG. 43 is a diagram illustrating an example of variable resolution of an activated screen interlocked with a folded angle.
Figure 44:
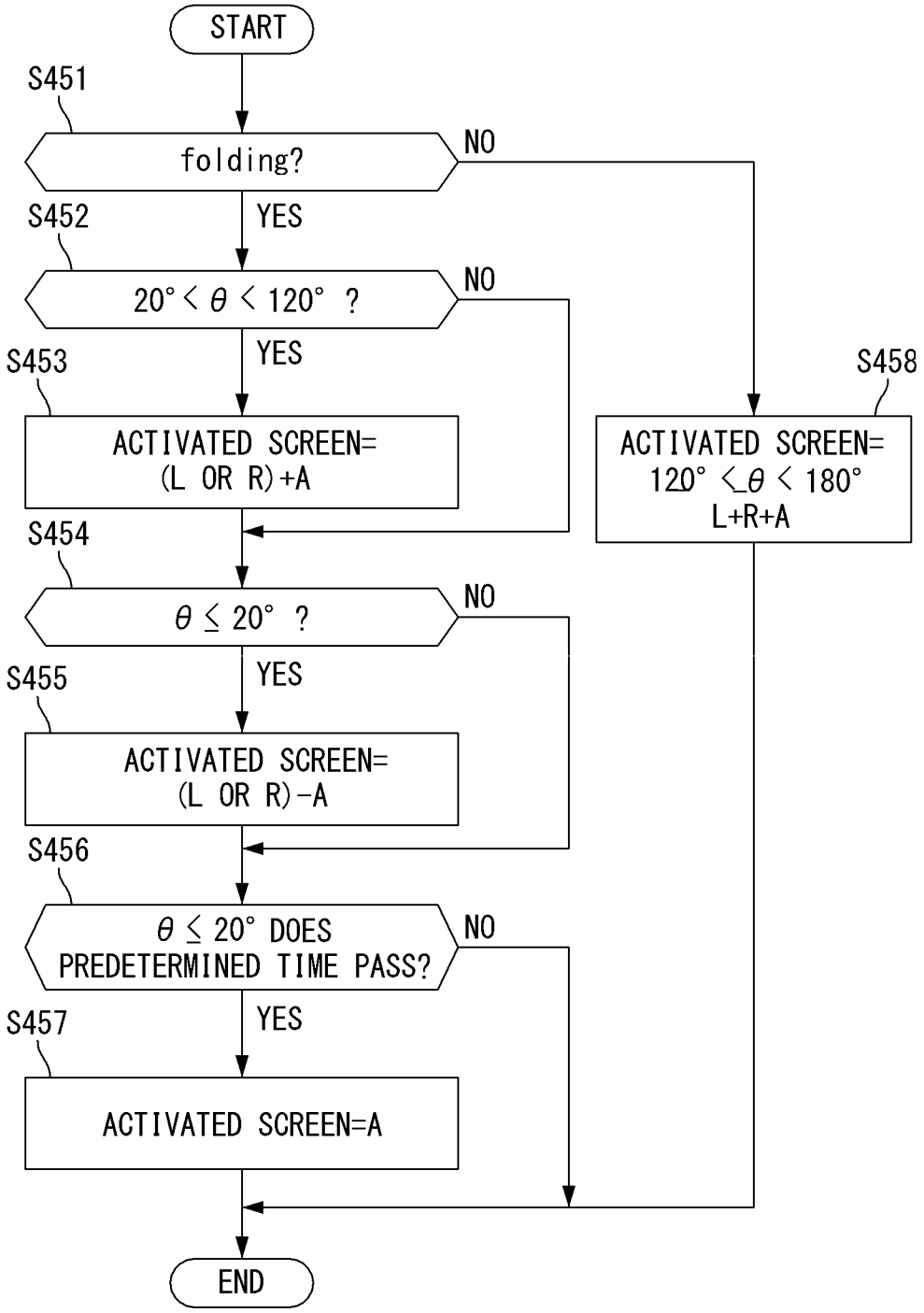
FIG. 44 is a flow chart showing steps in the activation of the screen.

FIG. 43 is a diagram illustrating an example of variable resolution of an activated screen interlocked with a folded angle. FIG. 44 is a flow chart showing steps in the activation of the screen.

Referring to FIGS. 43 and 44, the foldable display of the present disclosure may vary in a size and resolution of the screen according to a folded angle.

When an angle θ between the first and second screens L and R of the flexible display panel 100 ranges from 120 degrees to 180 degrees, all the screens L, A, and R are activated to display an image at a maximum screen size and maximum resolution as shown in FIG. 43A (S451 and S458).

When the flexible display panel 100 is folded and the angle θ between the first and second screens L and R ranges from 20 degrees to 120 degrees, since a screen opposite to the activated screen at which a user looks among the first and second screens L and R is deactivated, the size and resolution of the activated screen is reduced as shown in FIG. 43 (S452 and S453). In this case, the size of the activated screen may be (L or R)+A. An input image may be displayed on a pixel array of the folding boundary A.

When the flexible display panel 100 is further folded and thus the angle θ between the first and second screens L and R is less than or equal to 20 degrees, a screen opposite to the user is deactivated among the folding boundary A and the first and second screens L and R so that the size and resolution of the activated screen is further reduced as shown in FIG. 43 (S454 and S454). In this case, the size of the activated screen may be (L or R)-A. The folding boundary A is deactivated to display a black screen.

When a state in which the angle θ between the first and second screens L and R is less than or equal to 20 degrees is elapsed for a predetermined time, only the folding boundary A is activated to display predetermined information, and the first and second screens L and R are deactivated as shown in FIG. 43 (S456 and S457). In this case, the size and resolution of the activated screen are further reduced so that the size of the activated screen corresponds to that of the folding boundary A. The folding boundary A may be deactivated and may display the predetermined information, for example, time information, a battery power level, transmission and reception sensitivity, a received message content, and the like.

The host system 200 may be connected to a folding angle sensing device 201.

Figure 45:
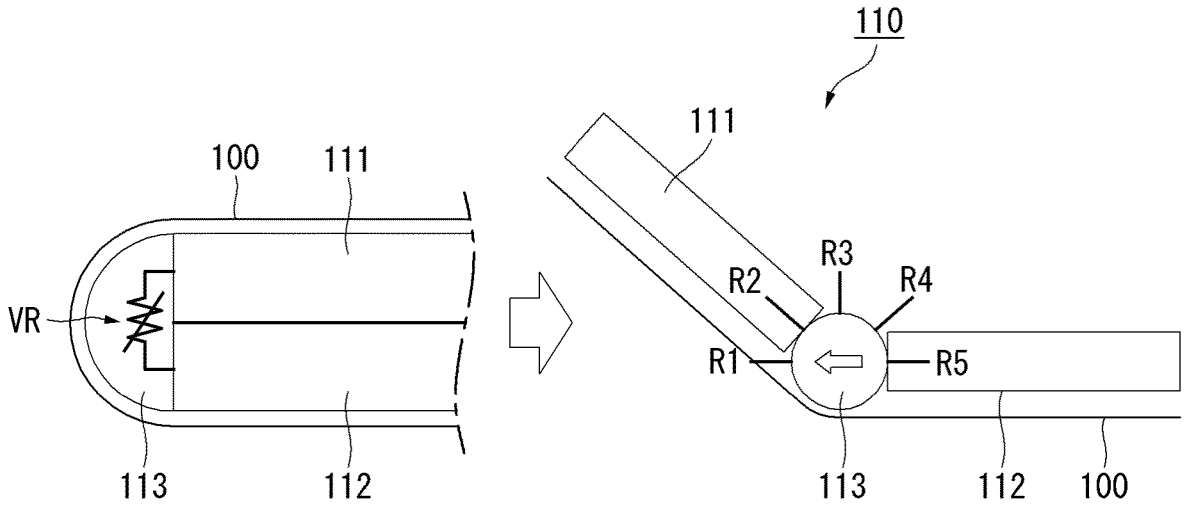
FIG. 45 shows diagrams illustrating a folded angle sensing device.
Figure 45:
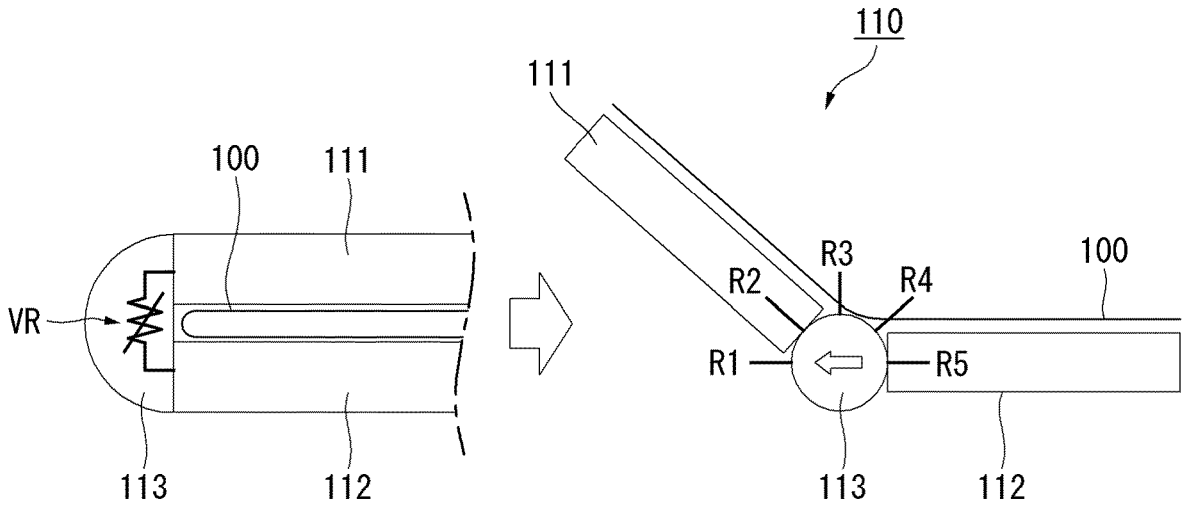
Figure 46:
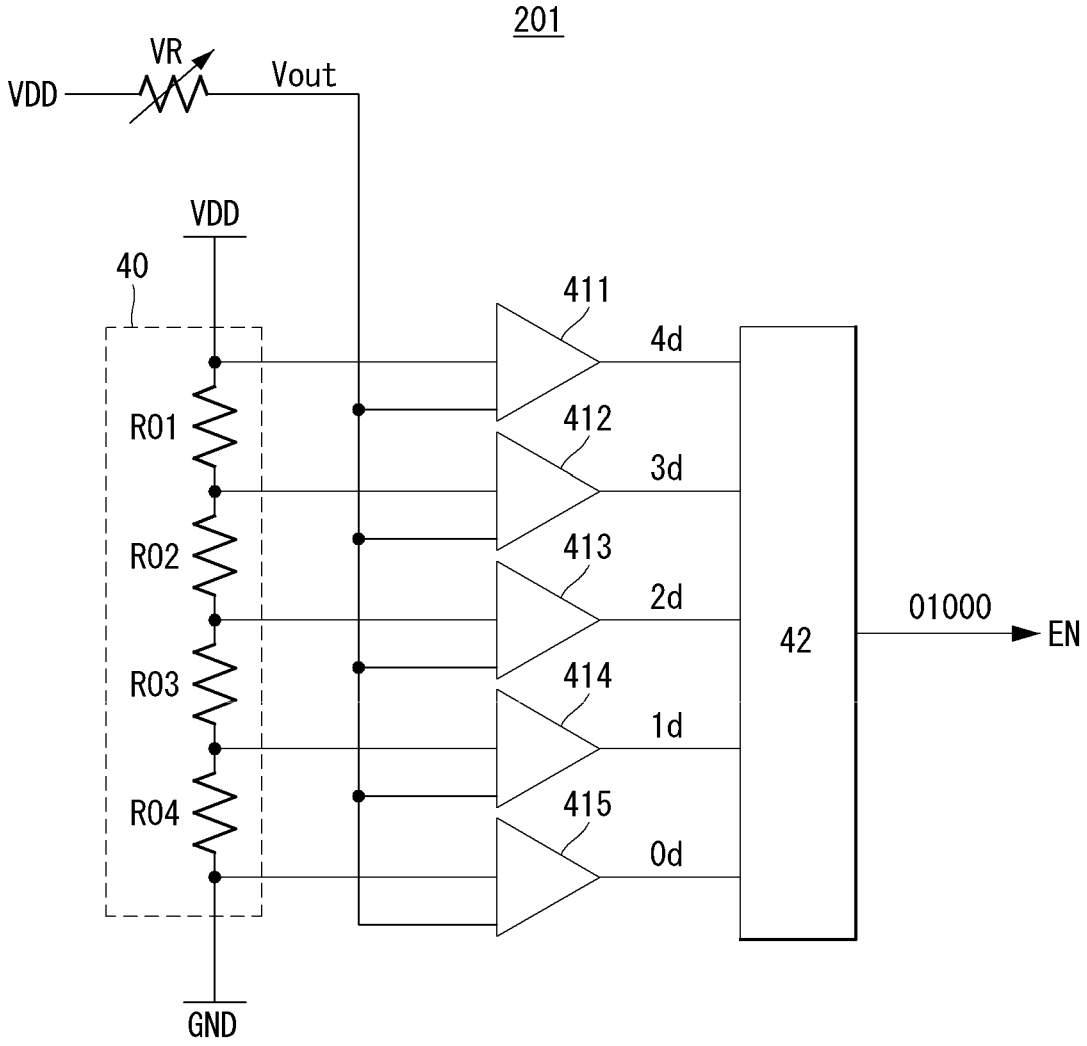
FIG. 46 illustrates a block diagram of a sensing circuit.

As shown in FIGS. 45 and 46, the folding angle sensing device 201 includes a variable resistor VR, a reference voltage generator 40, a plurality of comparators 411 to 415, and an encoder 42.

In FIG. 45, (a) illustrates an out-folding type foldable display. In FIG. 45, (b) illustrates an in-folding type foldable display.

The flexible display panel 100 may be adhered to a base plate 110. The base plate 110 includes a first support layer 111, a second support layer 112, and a hinge 113 for connecting the first support layer 111 to the second support layer 112.

The first screen L of the flexible display panel 100 is adhered onto the first support layer 111, and the second screen R thereof is adhered onto the second support layer 112. The folding boundary A is located in a portion of the hinge 113 of the base plate 110.

The user may fold the flexible display panel 100 together with the base plate 110. The variable resistor VR includes a plurality of resistors R1 to R5 connected through the hinge 113 according to a folded angle. At the folded angle as shown in FIGS. 45A and 45B, the variable resistor VR is R2+R5. The variable resistor VR may be varied to R1+R5, R2+R5, R3+R5, or R4+R5 according to the folded angle of the flexible display panel 100. A folding voltage Vout, which is a voltage dropped by as much as a resistance value of the variable resistor VR, is applied to the comparators 411 to 415.

The reference voltage generator 40 divides a high potential reference voltage VDD and a ground voltage source GND and outputs a plurality of reference voltages having different voltage levels through voltage dividing nodes. Each of the comparators 411 to 415 compares a reference voltage from the reference voltage generator 40 with the folding voltage Vout, outputs a high voltage when the folding voltage Vout is larger than the reference voltage, and outputs a low voltage when the folding voltage Vout is less than or equal to the reference voltage. In FIG. 46, the first comparator 411 outputs a first voltage 4d as a comparison result between a highest level reference voltage and the folding voltage Vout. The first comparator 411 outputs the first voltage 4d as the comparison result between the highest level reference voltage and the folding voltage Vout. A fifth comparator 415 outputs a fifth voltage 0d as a comparison result between a lowest level reference voltage and the folding voltage Vout.

The encoder 42 may convert voltages from the comparators 411 to 415 into a digital code and output an enable signal EN. For example, when the first voltage 4d output from the first comparator 411 is a low voltage, the encoder 42 may output a most significant bit as 0, and, when a second voltage 3d output from the second comparator 412 is a low voltage, the encoder 42 may output a next most significant bit as 1. When the fifth voltage 0d output from the fifth comparator 415 is a low voltage, the encoder 42 may output a least significant bit as 0.

The foldable display of the present disclosure and a driving method thereof will be described below.

The foldable display of the present disclosure includes the flexible display panel 100 having a screen in which data lines, to which data voltages are applied, cross gate lines to which a scan signal SCAN and a light emission control signal EM are applied, and pixels P are disposed, and display panel drivers 120 and 300 configured to activate an entirety of the screen of the flexible display panel 100 and display an image on a maximum screen when the flexible display panel is unfolded in an unfolded state or activate a part of the screen when the flexible display panel is folded in a folded state to display the image on a screen that is smaller than the maximum screen and to display a black color on a deactivated screen. The screen of the flexible display panel 100 at least includes the first screen L, the second screen R, and the folding boundary A which is located between the first screen L and the second screen R and which is foldable. Each of the pixels P includes the light emitting element OLED, the drive element DT disposed between the pixel drive voltage ELVDD and the light emitting element OLED and configured to supply a current to the light emitting element OLED, first switching elements M3 and M4 configured to switch or control a current path between the pixel drive voltage ELVDD and the light emitting element OLED in response to the light emission control signal EM, and a second switching element M6 configured to apply an initialization voltage Vini, which suppresses light emission of the light emitting element OLED, to an anode of the light emitting element OLED in response to the scan signal SCAN in the folded state.

A resolution of the maximum screen is larger than that of the small screen.

The initialization voltage Vini is set to a DC voltage that is lower than the pixel drive voltage ELVDD and a threshold voltage of the light emitting element OLED.

The initialization voltage Vini is applied to the anode of the light emitting element OLED of each of the pixels P disposed in the deactivated screen for one frame interval or more.

The data voltages are applied only to the pixels P of the activated screen. In the pixels P of the activated screen, the second switching element M6 supplies the initialization voltage Vini to the anode of the light emitting element OLED prior to the data voltage in response to a (N−1)th scan signal (N is a natural number). In the pixels P of the deactivated screen, the second switching element M6 supplies the initialization voltage Vini to the anode of the light emitting element OLED in response to an Nth scan signal.

The initialization voltage Vini is set to a DC voltage that is lower than the pixel drive voltage ELVDD and the threshold voltage of the light emitting element OLED.

The initialization voltage Vini is applied to the anode of the light emitting element OLED of each of the pixels P disposed in the deactivated screen for one frame interval or more.

The display panel drivers 120 and 300 include the gate driver 120 having a first shift register configured to supply the scan signals SCAN to the pixels P and a second shift register configured to supply the light emission control signal EM to the pixels P, the data driver 306 configured to convert pixel data into the data voltages and supply the data voltages to the data lines through data output channels, and the timing controller 303 configured to activate the data output channels of the data driver 306 according to the folded angle of the flexible display panel 100 and control operating timings of the data driver 306 and the gate driver 120.

The timing controller 303 controls an output of the data driver 306 by generating a first gate start pulse indicating a start timing of the first shift register, a second gate start pulse indicating a start timing of the second shift register, and a gate shift clock defining shift timings of the first and second shift registers.

The first shift register receives the first gate start pulse and the gate shift clock and supplies pulses of the scan signal SCAN to the pixels P of the activated screen and the deactivated screen. The second shift register receives the second gate start pulse and the gate shift clock and supplies pulses of the light emission control signal EM to only the pixels P of the activated screen.

The second gate start pulse includes a second-first gate start pulse indicating a start timing of the light emission control signal EM with respect to the first screen L, and a second-second gate start pulse indicating a start timing of the light emission control signal EM with respect to the second screen R. The second shift register includes a second-first shift register configured to supply the pulses of the light emission control signal EM to the pixels P of the first screen L in response to the second-first gate start pulse and the gate shift clock which are input when the first screen L is activated, and a second-second shift register configured to supply the pulses of the light emission control signal EM to the pixels P of the second screen R in response to the second-second gate start pulse and the gate shift clock which are input when the second screen R is activated.

When the first screen L is deactivated, a gate off voltage is applied to the second-first shift register instead of the second-first gate start pulse under the control of the timing controller 303. When the second screen R is deactivated, the gate off voltage is applied to the second-second shift register instead of the second-second gate start pulse under the control of the timing controller 303. The gate off voltage is set to a voltage at which switching elements of the pixels P are turned off.

The gate off voltage is applied to a start signal input node of a shift register connected to the pixels P of the deactivated screen among the second-first and second-second shift registers for one frame interval or more.

The first shift register receives the first gate start pulse and the gate shift clock and supplies the pulses of the scan signal SCAN to only the pixels P of the activated screen. The second shift register receives the second gate start pulse and the gate shift clock and supplies the pulses of the light emission control signal EM to only the pixels P of the activated screen.

The first gate start pulse includes a first-first gate start pulse indicating a start timing of the scan signal SCAN with respect to the first screen L, and a first-second gate start pulse indicating a start timing of the scan signal SCAN with respect to the second screen R.

The first shift register includes a first-first shift register configured to supply the pulses of the scan signal SCAN to the pixels P of the first screen L in response to the first-first gate start pulse and the gate shift clock which are input when the first screen L is activated, and a first-second shift register configured to supply the pulses of the scan signal SCAN to the pixels P of the second screen R in response to the first-second gate start pulse and the gate shift clock which are input when the second screen R is activated.

The second gate start pulse includes a second-first gate start pulse indicating a start timing of the light emission control signal EM with respect to the first screen L, and a second-second gate start pulse indicating a start timing of the light emission control signal EM with respect to the second screen R. The second shift register includes a second-first shift register configured to supply the pulses of the light emission control signal EM to the pixels P of the first screen L in response to the second-first gate start pulse and the gate shift clock which are input when the first screen L is activated, and a second-second shift register configured to supply the pulses of the light emission control signal EM to the pixels P of the second screen R in response to the second-second gate start pulse and the gate shift clock which are input when the second screen R is activated.

When the first screen L is deactivated, the gate off voltage is applied to the first-first shift register instead of the first-first gate start pulse under the control of the timing controller 303. When the second screen R is deactivated, the gate off voltage is applied to the first-second shift register instead of the first-second gate start pulse under the control of the timing controller 303. When the first screen L is deactivated, the gate off voltage is applied to the second-first shift register instead of the second-first gate start pulse under the control of the timing controller 303. When the second screen R is deactivated, the gate off voltage is applied to the second-second shift register instead of the second-second gate start pulse under the control of the timing controller 303. The gate off voltage is set to a voltage at which the switching elements of the pixels P are turned off.

The gate off voltage is applied to a start signal input node of a shift register connected to the pixels P of the deactivated screen among the first-first and first-second shift registers for one frame interval or more. The gate off voltage is applied to a start signal input node of a shift register connected to the pixels P of the deactivated screen among the second-first and second-second shift registers for one frame interval or more.

The first gate start pulse includes a first-first gate start pulse indicating a start timing of the scan signal SCAN with respect to the first screen L, a first-second gate start pulse indicating a start timing of the scan signal SCAN with respect to the folding boundary A, and a first-third gate start pulse indicating a start timing of the scan signal SCAN with respect to the second screen R. The first shift register includes a first-first shift register configured to supply the pulses of the scan signal SCAN to the pixels P of the first screen L in response to the first-first gate start pulse and the gate shift clock which are input when the first screen L is activated, a first-second shift register configured to supply the pulses of the scan signal SCAN to the pixels P of the folding boundary A in response to the first-second gate start pulse and the gate shift clock which are input when the folding boundary A is activated, and a first-third shift register configured to supply the pulses of the scan signal SCAN to the pixels of the second screen R in response to the first-third gate start pulse and the gate shift clock which are input when the second screen R is activated.

The second gate start pulse includes a second-first gate start pulse indicating a start timing of the light emission control signal EM with respect to the first screen L, a second-second gate start pulse indicating a start timing of the light emission control signal EM with respect to the folding boundary A, and a second-third gate start pulse indicating a start timing of the light emission control signal EM with respect to the second screen R.

The second shift register includes a second-first shift register configured to supply the pulses of the light emission control signal EM to the pixels P of the first screen L in response to the second-first gate start pulse and the gate shift clock which are input when the first screen L is activated, a second-second shift register configured to supply the pulses of the light emission control signal EM to the pixels P of the folding boundary A in response to the second-second gate start pulse and the gate shift clock which are input when the folding boundary A is activated, and a second-third shift register configured to supply the pulses of the light emission control signal EM to the pixels P of the second screen R in response to the second-third gate start pulse and the gate shift clock which are input when the second screen R is activated.

When the first screen L is deactivated, the gate off voltage is applied to the first-first shift register instead of the first-first gate start pulse under the control of the timing controller 303. When the folding boundary A is deactivated, the gate off voltage is applied to the first-second shift register instead of the first-second gate start pulse under the control of the timing controller 303. When the second screen R is deactivated, the gate off voltage is applied to the first-third shift register instead of the first-third gate start pulse under the control of the timing controller 303. When the first screen L is deactivated, the gate off voltage is applied to the second-first shift register instead of the second-first gate start pulse under the control of the timing controller 303. When the folding boundary A is deactivated, the gate off voltage is applied to the second-second shift register instead of the second-second gate start pulse under the control of the timing controller 303. When the second screen R is deactivated, the gate off voltage is applied to the second-third shift register instead of the second-third gate start pulse under the control of the timing controller 303. The gate off voltage is set to a voltage at which the switching elements of the pixels P are turned off.

The gate off voltage is applied to a start signal input node of a shift register connected to the pixels P of the deactivated screen among the first-first to first-third shift registers for one frame interval or more.

The gate off voltage is applied to a start signal input node of a shift register connected to the pixels P of the deactivated screen among the second-first to second-third shift registers for one frame interval or more.

The data output channels of the data driver 306 are activated to output the data voltages during a scan interval of the activated screen under the control of the timing controller 303. The data output channels are deactivated to be separated from the data lines during a scan interval of the deactivated screen under the control of the timing controller 303.

The foldable display further includes a host system configured to transmit an enable signal indicating an unfolded state or a folded state of the flexible display panel 100 to the timing controller 303 together with the pixel data. The timing controller 303 controls a size and resolution of the activated screen in response to the enable signal.

The foldable display further includes a host system configured to transmit an enable signal indicating a folded angle of the flexible display panel 100 to the timing controller 303 together with the pixel data. The timing controller 303 controls a size and resolution of the activated screen in response to the enable signal.

When the first screen L of the flexible display panel 100 is coplanar with the second screen R thereof, the timing controller 303 controls the size and resolution of the activated screen to be a maximum screen and maximum resolution. As an angle between the first screen L and the second screen R is decreased, the timing controller 303 gradually reduces the size and resolution of the activated screen. When a predetermined time elapses in a state in which the angle between the first screen L and the second screen R is at a predetermined folded angle, only the folding boundary A is activated.

When an input frequency of the display panel driver is varied in the folded state of the flexible display panel 100, the display panel driver drives the small screen at the varied frequency. When the input frequency of the display panel driver is varied in the unfolded state of the flexible display panel 100, the display panel driver drives the maximum screen at the varied frequency.

In the unfolded state of the flexible display panel 100, the display panel driver drives the maximum screen at a predetermined reference frequency. In the folded state of the flexible display panel 100, the display panel driver drives the small screen at the reference frequency.

In the unfolded state of the flexible display panel 100, the display panel driver drives the maximum screen at a predetermined reference frequency. In the folded state of the flexible display panel 100, the display panel driver drives the small screen at a frequency that is higher than the reference frequency.

In the folded state of the flexible display panel 100, the display panel driver writes the same image twice in succession in the pixels of the small screen during two frame intervals.

The data driver includes a data receiving and calculating part configured to receive and process the pixel data, a DAC configured to convert the pixel data from the data receiving and calculating part into a gamma compensation voltage to generate the data voltage, and an output buffer disposed between the DAC and the data line to transfer the data voltage to the data line. In the folded state of the flexible display panel 100, the timing controller 303 enables only a portion of the data receiving and calculating part in response to the enable signal.

In the folded state of the flexible display panel 100, the timing controller 303 cuts off driving power of the output buffer in response to the enable signal.

In the folded state of the flexible display panel 100, the timing controller 303 enables only the portion of the data receiving and calculating part and cuts off the driving power of the output buffer in response to the enable signal.

The method of driving a foldable display includes activating an entirety of a screen of a flexible display panel when the flexible display panel is in an unfolded state in which the screen is unfolded to display an image on a maximum screen thereof, and activating a part of the maximum screen when the flexible display panel is folded in a folded state to display the image on a screen that is smaller than the maximum screen and display a black color on a deactivated screen.

The screen of the flexible display panel at least includes a first screen, a second screen, and a folding boundary which is located between the first screen and the second screen and which is foldable.

Each of pixels of the screen includes a light emitting element, a drive element DT disposed between a pixel drive voltage and the light emitting element and configured to supply a current to the light emitting element, a first switching element configured to switch or control a current path between the pixel drive voltage and the light emitting element in response to a light emission control signal, and a second switching element configured to apply an initialization voltage, which suppresses light emission of the light emitting element, to an anode of the light emitting element in response to a scan signal in the folded state.

A resolution of the maximum screen is larger than that of the small screen.

The method of driving a foldable display further includes supplying data voltages of pixel data to only the pixels of the activated screen.

The method of driving a foldable display further includes generating an enable signal indicating an unfolded state or a folded state of the flexible display panel, and controlling a size and resolution of the activated screen in response to the enable signal.

The method of driving a foldable display further includes generating an enable signal indicating a folded angle of the flexible display panel, and controlling a size and resolution of the activated screen in response to the enable signal.

The controlling of the size and resolution of the activated screen in response to the enable signal includes when the first screen of the flexible display panel is coplanar with the second screen thereof, controlling the size and resolution of the activated screen to be a maximum screen and maximum resolution, and as an angle between the first screen and the second screen is decreased, gradually reducing the size and resolution of the activated screen.

The controlling of the size and resolution of the activated screen in response to the enable signal further includes when a predetermined time elapses in a state in which the angle between the first screen and the second screen is at a predetermined folded angle, activating only the folding boundary and displaying an image or predetermined information irrelevant to the image on the folding boundary.

In accordance with the present disclosure, in a folded state in which a foldable display is folded, a screen at which a user does not look is deactivated (processing a non-driven screen), and a voltage which suppresses light emission of a light emitting element in the deactivated screen is applied so that it is possible to reduce power consumption, increase a battery lifetime, and allow the deactivated screen to display a full black color.

In accordance with the present disclosure, a gate driver is divided into two or more gate drivers to drive a screen to be divided without applying data voltages to pixels of the deactivated screen in the folded state of the foldable display so that it is possible to sufficiently secure a blank interval during which the pixels are not driven.

In accordance with the present disclosure, the activated screen at which a user looks can be driven on the foldable display at a high speed. In a VR mode, the screen is driven at a high speed so that it is possible to reduce motion sickness and fatigue of the user.

In accordance with the present disclosure, in the folded state, only a part of a digital circuit unit is driven by as much as reduction in amount of the pixel data of an input signal so that it is possible to reduce power consumption of the drive IC, and power of output buffers connected to data output channels is cut off during a scan interval of the deactivated screen so that it is possible to further reduce power consumption. In accordance with the present disclosure, in the folded state, only a part of a gate driver is driven so that it is possible to further reduce power consumption.

Since the content of the present disclosure described in the problems to be solved, the problem-solving means, and effects does not specify essential features of the claims, the scope of the claims is not limited to matters described in the content of the disclosure.

While the embodiments of the present disclosure have been described in detail above with reference to the accompanying drawings, the present disclosure is not limited to the embodiments, and various changes and modifications may be made without departing from the technical spirit of the present disclosure. Accordingly, the embodiments disclosed herein are to be considered descriptive and not restrictive of the technical spirit of the present disclosure, and the scope of the technical spirit of the present disclosure is not limited by the embodiments. Therefore, it should be understood that the above embodiments are illustrative rather than restrictive in all respects. The scope of the disclosure should be construed by the appended claims, and all technical spirits within the scopes of their equivalents should be construed as being included in the scope of the disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A foldable display, comprising:

a flexible display panel including a screen having a plurality of pixels, a plurality of data lines to which data voltages are applied, and a plurality of gate lines to which a respective scan signal and a light emission control signal are applied; and a display panel driver configured to activate a full portion of the screen of the flexible display panel and display an image on the full portion of the screen when the flexible display panel is in an unfolded state or activate a partial portion of the screen of the flexible display panel and display the image on only the partial portion of the screen that is smaller than the full portion of the screen when the flexible display panel is in a folded state and to display a black color on a deactivated portion of the screen, wherein the screen of the flexible display panel at least includes a first screen, a second screen, and a folding boundary which is located between the first screen and the second screen, and the folding boundary is foldable, wherein the display panel driver includes:

a data driver configured to convert pixel data into the data voltages and supply the data voltages to the data lines through data output channels;

a gate driver having a first shift register configured to supply the scan signals to the pixels and a second shift register configured to supply the light emission control signal to the pixels; and a timing controller configured to:

activate the data output channels of the data driver based on a folded angle of the flexible display panel and control operating timings of the data driver and the gate driver, and control an output of the data driver by generating a first gate start pulse, a second gate start pulse, and a gate shift clock defining shift timings of the first and second shift registers, wherein the first gate start pulse indicating a start timing of the first shift register is input to the first shift register, and the second gate start pulse indicating a start timing of the second shift register is input to the second shift register, wherein each of the pixels includes:

a light emitting element;

a drive element disposed between a pixel drive voltage and the light emitting element, the drive element configured to supply a current to the light emitting element;

a first switching element configured to control a current path between the pixel drive voltage and the light emitting element in response to the light emission control signal; and a second switching element configured to apply an initialization voltage, which suppresses light emission from the light emitting element, to an anode of the light emitting element in response to the scan signal in the folded state.

2. The foldable display of claim 1, wherein a resolution for the full portion of the screen is greater than a resolution for the partial portion of the screen that is smaller than the full portion of the screen.

3. A foldable display comprising:

a flexible display panel including a screen having a plurality of pixels, a plurality of data lines to which data voltages are applied, and a plurality of gate lines to which a respective scan signal and a light emission control signal are applied; and a display panel driver configured to activate a full portion of the screen of the flexible display panel and display an image on the full portion of the screen when the flexible display panel is in an unfolded state or activate a partial portion of the screen of the flexible display panel and display the image on only the partial portion of the screen that is smaller than the full portion of the screen when the flexible display panel is in a folded state and to display a black color on a deactivated portion of the screen, wherein each of the pixels includes:

a light emitting element;

a drive element disposed between a pixel drive voltage and the light emitting element, the drive element configured to supply a current to the light emitting element;

a first switching element configured to control a current path between the pixel drive voltage and the light emitting element in response to the light emission control signal; and a second switching element configured to apply an initialization voltage, which suppresses light emission from the light emitting element, to an anode of the light emitting element in response to the scan signal in the folded state;

wherein the data voltages are applied only to the pixels of the activated portion of the screen;

in the pixels of the activated portion of the screen, the second switching element supplies the initialization voltage to the anode of the light emitting element prior to the data voltages in response to a (N−1)th scan signal (N is a natural number); and in the pixels of the deactivated portion of the screen, the second switching element supplies the initialization voltage to the anode of the light emitting element in response to an Nth scan signal.

4. The foldable display of claim 1, wherein the initialization voltage is set to a DC voltage that is lower than the pixel drive voltage and a threshold voltage of the light emitting element.

5. The foldable display of claim 1, wherein the initialization voltage is applied to the anode of the light emitting element of each of the pixels disposed in the deactivated portion of the screen for one frame interval or more.

6. The foldable display of claim 1, wherein:

the first shift register receives the first gate start pulse and the gate shift clock and supplies pulses of the scan signal to the pixels of the activated portion of the screen and the deactivated portion of the screen; and the second shift register receives the second gate start pulse and the gate shift clock and supplies pulses of the light emission control signal to only the pixels of the activated portion of the screen.

7. The foldable display of claim 6, wherein the second gate start pulse includes:

a second-first gate start pulse indicating a start timing of the light emission control signal with respect to the first screen; and a second-second gate start pulse indicating a start timing of the light emission control signal with respect to the second screen, and wherein the second shift register includes:

a second-first shift register configured to supply the pulses of the light emission control signal to the pixels of the first screen in response to the second-first gate start pulse and the gate shift clock which are input when the first screen is the activated portion of the screen; and a second-second shift register configured to supply the pulses of the light emission control signal to the pixels of the second screen in response to the second-second gate start pulse and the gate shift clock which are input when the second screen is the activated portion of the screen.

8. The foldable display of claim 7, wherein:

when the first screen is the deactivated portion of the screen, a gate off voltage is applied to the second-first shift register instead of the second-first gate start pulse by the timing controller;

when the second screen is the deactivated portion of the screen, the gate off voltage is applied to the second-second shift register instead of the second-second gate start pulse by the timing controller; and the gate off voltage is a voltage at which the switching elements of the pixels are turned off.

9. The foldable display of claim 8, wherein the gate off voltage is applied to a start signal input node of a shift register connected to the pixels of the deactivated portion of the screen among the second-first and second-second shift registers for one frame interval or more.

10. The foldable display of claim 1, wherein:

the first shift register receives the first gate start pulse and the gate shift clock and supplies pulses of the scan signal to only the pixels of the activated portion of the screen; and the second shift register receives the second gate start pulse and the gate shift clock and supplies pulses of the light emission control signal to only the pixels of the activated portion of the screen.

11. The foldable display of claim 10, wherein the first gate start pulse includes:

a first-first gate start pulse indicating a start timing of the scan signal with respect to the first screen; and a first-second gate start pulse indicating a start timing of the scan signal with respect to the second screen, wherein the first shift register includes:

a first-first shift register configured to supply the pulses of the scan signal to the pixels of the first screen in response to the first-first gate start pulse and the gate shift clock which are input when the first screen is the activated portion of the screen; and a first-second shift register configured to supply the pulses of the scan signal to the pixels of the second screen in response to the first-second gate start pulse and the gate shift clock which are input when the second screen is the activated portion of the screen, wherein the second gate start pulse includes:

a second-first gate start pulse indicating a start timing of the light emission control signal with respect to the first screen; and a second-second gate start pulse indicating a start timing of the light emission control signal with respect to the second screen, and wherein the second shift register includes:

a second-first shift register configured to supply the pulses of the light emission control signal to the pixels of the first screen in response to the second-first gate start pulse and the gate shift clock which are input when the first screen is the activated portion of the screen; and a second-second shift register configured to supply the pulses of the light emission control signal to the pixels of the second screen in response to the second-second gate start pulse and the gate shift clock which are input when the second screen is the activated portion of the screen.

12. The foldable display of claim 11, wherein:

when the first screen is the deactivated portion of the screen, a gate off voltage is applied to the first-first shift register instead of the first-first gate start pulse under the control of the timing controller;

when the second screen is the deactivated portion of the screen, the gate off voltage is applied to the first-second shift register instead of the first-second gate start pulse under the control of the timing controller;

when the first screen is the deactivated portion of the screen, the gate off voltage is applied to the second-first shift register instead of the second-first gate start pulse under the control of the timing controller;

when the second screen is the deactivated portion of the screen, the gate off voltage is applied to the second-second shift register instead of the second-second gate start pulse under the control of the timing controller; and the gate off voltage is a voltage at which the switching elements of the pixels are turned off.

13. The foldable display of claim 12, wherein:

the gate off voltage is applied to a start signal input node of a shift register connected to the pixels of the deactivated portion of the screen among the first-first and first-second shift registers for one frame interval or more; and the gate off voltage is applied to a start signal input node of a shift register connected to the pixels of the deactivated portion of the screen among the second-first and second-second shift registers for one frame interval or more.

14. The foldable display of claim 10, wherein the first gate start pulse includes:

a first-first gate start pulse indicating a start timing of the scan signal with respect to the first screen;

a first-second gate start pulse indicating a start timing of the scan signal with respect to the folding boundary; and a first-third gate start pulse indicating a start timing of the scan signal with respect to the second screen, wherein the first shift register includes:

a first-first shift register configured to supply the pulses of the scan signal to the pixels of the first screen in response to the first-first gate start pulse and the gate shift clock which are input when the first screen is the activated portion of the screen;

a first-second shift register configured to supply the pulses of the scan signal to the pixels of the folding boundary in response to the first-second gate start pulse and the gate shift clock which are input when the folding boundary is the activated portion of the screen; and a first-third shift register configured to supply the pulses of the scan signal to the pixels of the second screen in response to the first-third gate start pulse and the gate shift clock which are input when the second screen is the activated portion of the screen, wherein the second gate start pulse includes:

a second-first gate start pulse indicating a start timing of the light emission control signal with respect to the first screen;

a second-second gate start pulse indicating a start timing of the light emission control signal with respect to the folding boundary; and a second-third gate start pulse indicating a start timing of the light emission control signal with respect to the second screen, and wherein the second shift register includes:

a second-first shift register configured to supply the pulses of the light emission control signal to the pixels of the first screen in response to the second-first gate start pulse and the gate shift clock which are input when the first screen is the activated portion of the screen;

a second-second shift register configured to supply the pulses of the light emission control signal to the pixels of the folding boundary in response to the second-second gate start pulse and the gate shift clock which are input when the folding boundary is the activated portion of the screen; and a second-third shift register configured to supply the pulses of the light emission control signal to the pixels of the second screen in response to the second-third gate start pulse and the gate shift clock which are input when the second screen is the activated portion of the screen.

15. The foldable display of claim 14, wherein:

when the first screen is the deactivated portion of the screen, a gate off voltage is applied to the first-first shift register instead of the first-first gate start pulse under the control of the timing controller;

when the folding boundary is the deactivated portion of the screen, the gate off voltage is applied to the first-second shift register instead of the first-second gate start pulse under the control of the timing controller;

when the second screen is the deactivated portion of the screen, the gate off voltage is applied to the first-third shift register instead of the first-third gate start pulse under the control of the timing controller;

when the first screen is the deactivated portion of the screen, the gate off voltage is applied to the second-first shift register instead of the second-first gate start pulse under the control of the timing controller;

when the folding boundary is the deactivated portion of the screen, the gate off voltage is applied to the second-second shift register instead of the second-second gate start pulse under the control of the timing controller;

when the second screen is the deactivated portion of the screen, the gate off voltage is applied to the second-third shift register instead of the second-third gate start pulse under the control of the timing controller; and the gate off voltage is a voltage at which the switching elements of the pixels are turned off.

16. The foldable display of claim 15, wherein:

the gate off voltage is applied to a start signal input node of a shift register connected to the pixels of the deactivated portion of the screen among the first-first to first-third shift registers for one frame interval or more; and the gate off voltage is applied to a start signal input node of a shift register connected to the pixels of the deactivated portion of the screen among the second-first to second-third shift registers for one frame interval or more.

17. The foldable display of claim 1, further comprising a host system configured to transmit an enable signal indicating an unfolded state or a folded state of the flexible display panel to the timing controller together with the pixel data, wherein the timing controller controls a size and resolution of the activated portion of the screen in response to the enable signal.

18. The foldable display of claim 1, further comprising a host system configured to transmit an enable signal indicating the folded angle of the flexible display panel to the timing controller together with the pixel data, wherein the timing controller controls a size and resolution of the activated portion of the screen in response to the enable signal.

19. The foldable display of claim 3, wherein the initialization voltage is set to a DC voltage that is lower than the pixel drive voltage and a threshold voltage of the light emitting element.

20. The foldable display of claim 3, wherein the initialization voltage is applied to the anode of the light emitting element of each of the pixels disposed in the deactivated portion of the screen for one frame interval or more.

* * * * *